US012313269B2

(12) United States Patent
Kim et al.

(10) Patent No.: US 12,313,269 B2
(45) Date of Patent: May 27, 2025

(54) INDOOR UNIT OF AIR CONDITIONER AND CONTROLLING METHOD OF THE AIR CONDITIONER

(71) Applicant: SAMSUNG ELECTRONICS CO., LTD., Suwon-si (KR)

(72) Inventors: Jinbaek Kim, Suwon-si (KR); Junghyeon Kim, Suwon-si (KR); Donggi Han, Suwon-si (KR); Deoggwen Kang, Suwon-si (KR); Eungryeol Seo, Suwon-si (KR); Hyungsok Yeo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 394 days.

(21) Appl. No.: 17/722,941

(22) Filed: Apr. 18, 2022

(65) Prior Publication Data

US 2022/0316716 A1 Oct. 6, 2022

Related U.S. Application Data

(63) Continuation of application No. PCT/KR2022/004157, filed on Mar. 24, 2022.

(30) Foreign Application Priority Data

Mar. 30, 2021 (KR) ..... 10-2021-0041416

(51) Int. Cl.
*F24F 1/0014* (2019.01)
*F04D 29/44* (2006.01)
(Continued)

(52) U.S. Cl.
CPC ..... *F24F 1/0014* (2013.01); *F04D 29/447* (2013.01); *F24F 1/0033* (2013.01); *F24F 1/0063* (2019.02)

(58) Field of Classification Search
CPC ..... F24F 1/0014; F24F 1/0033; F24F 1/0063; F04D 19/022; F04D 29/325; F04D 29/542; F04D 25/08
See application file for complete search history.

(56) References Cited

U.S. PATENT DOCUMENTS 9,551,498 B2 1/2017 Kim et al.
9,726,385 B2 8/2017 Yun et al.
(Continued)

FOREIGN PATENT DOCUMENTS

CN 104776581 7/2015
CN 210861376 U * 6/2020 ..... F24F 1/0011
(Continued)

OTHER PUBLICATIONS

International Search Report dated Jul. 21, 2022 for International Application No. PCT/KR2022/004157.

*Primary Examiner* — Jorge A Pereiro
*Assistant Examiner* — Michael James Giordano
(74) *Attorney, Agent, or Firm* — STAAS & HALSEY LLP

(57) ABSTRACT

An indoor unit of an air conditioner includes a housing having an opening, a heat exchanger arranged in the housing to heat exchange air drawn into the housing, a fan arranged in the housing and rotatable around a rotation axis. The rotation axis formed to extend along a direction toward the opening and a diffuser placed at the opening and through which heat exchanged air blown by the fan is discharged. The diffuser including a plurality of vanes configured to guide the heat exchanged air blown by the fan. The diffuser being further configured to be selectively rotatable in the same direction as a rotation direction of the fan. The fan and the plurality of vanes being arranged to guide the heat
(Continued)

exchanged air blown by the fan in the rotation direction of the diffuser while the diffuser is rotated.

13 Claims, 25 Drawing Sheets

(51) Int. Cl.
*F24F 1/0033* (2019.01)
*F24F 1/0063* (2019.01)

(56) References Cited

U.S. PATENT DOCUMENTS

| | | | | |
|---|---|---|---|---|
| 10,473,339 | B2 | 11/2019 | Song et al. | |
| 2016/0327297 | A1* | 11/2016 | Song | F24F 1/005 |
| 2021/0123611 | A1 | 4/2021 | Yoon et al. | |

FOREIGN PATENT DOCUMENTS

| | | |
|---|---|---|
| KR | 10-2005-0119735 | 12/2005 |
| KR | 10-1271056 | 6/2013 |
| KR | 10-2014-0028192 | 3/2014 |
| KR | 10-2014-0034383 | 3/2014 |
| KR | 10-2014-0048363 | 4/2014 |
| KR | 10-2014-0049101 | 4/2014 |
| KR | 10-2015-0082969 | 7/2015 |
| KR | 10-2016-0017587 | 2/2016 |
| KR | 10-2018-0056615 | 5/2018 |
| KR | 10-2018-0072630 | 6/2018 |
| KR | 10-2203939 | 1/2021 |

* cited by examiner

INDOOR UNIT OF AIR CONDITIONER AND CONTROLLING METHOD OF THE AIR CONDITIONER

CROSS-REFERENCE TO RELATED APPLICATION

This application is a bypass continuation application of International Application No. PCT/KR2022/004157 filed on Mar. 24, 2022, which claims priority under 35 U. S. C. § 119 from Korean Patent Application No. 10-2021-0041416 filed on Mar. 30, 2021, the disclosure of which is incorporated herein by reference in its entirety.

FIELD

The disclosure relates to an indoor unit of an air conditioner, and more particularly, to an air conditioner with an enhanced discharge structure.

BACKGROUND

In general, air conditioners are devices that use a refrigeration cycle to control the temperature, humidity, air current, air distribution, etc., to be suitable for human activity as well as remove dust or the like contained in the air, and include a compressor, a condenser, an evaporator, a blower fan, etc.

The air conditioners may be classified into split air conditioners with indoor and outdoor units separately installed, and packaged air conditioners with indoor and outdoor units installed together in a single cabinet.

Among them, the indoor unit of the split air conditioner includes a heat exchanger for forcing the air sucked into the panel to be subject to heat exchange, and the blower fan for sucking the room air into the panel and blowing out the air back into the room.

To control the direction and fluid velocity distribution of the air discharged from the indoor unit of the split air conditioner, a variable structure to change the flow path or the direction is usually used, in which case, however, resistance of the flow path increases and a flow loss occurs.

SUMMARY

According to an embodiment of the disclosure, an indoor unit of an air conditioner includes a housing having an opening, a heat exchanger arranged in the housing to heat exchange air drawn into the housing, a fan arranged in the housing and rotatable around a rotation axis, the rotation axis formed to extend along a direction toward the opening, and a diffuser placed at the opening and through which heat exchanged air blown by the fan is discharged, wherein the diffuser includes a plurality of vanes configured to guide the heat exchanged air blown by the fan, and the diffuser being further configured to be selectively rotatable in the same direction as the rotation direction of the fan, and the plurality of vanes being arranged to guide the heat exchanged air blown by the fan in the rotation direction of the diffuser while the diffuser is rotated.

The diffuser may be arranged to be selectively rotatable in an opposite direction of the rotation direction of the fan.

The opening may be formed in the shape of a circle, the diffuser may further include a ring corresponding to the opening and a center part arranged in the middle of the ring, and the plurality of vanes may be arranged to extend to the ring from the center part.

The opening may be formed in the shape of a circle, the diffuser may further include a ring corresponding to the opening and a center part arranged in the middle of the ring, and the plurality of vanes may be arranged to extend to the ring from the center part and guide the heat exchanged air blown from the fan in an opposite direction of the rotation direction of the fan while the diffuser is rotated in the opposite direction of the rotation direction of the fan.

Each vane of the plurality of vanes may have one end placed to be adjacent to the center part, respectively, and another end connected to the ring, respectively, and each of the plurality of vanes may be curved from the one end in the rotation direction of the fan to extend to the other end, respectively.

Each vane of the plurality of vanes has an end connected to the center part, respectively, and another end connected to the ring, respectively, and each of the plurality of vanes may be curved from the one end in the opposite direction of the rotation direction of the fan to the other end, respectively.

Each vane of the plurality of vanes has one end connected to the center part, respectively, and another end connected to the ring, respectively, and each vane of the plurality of vanes may extend from the one end to the other end in a radial direction of the ring, respectively.

A controller for controlling rotation of the diffuser may be further included, and the controller may control the diffuser by selecting one of a first state in which the diffuser is rotated in the rotation direction of the fan and a second state in which the diffuser is stopped.

A controller for controlling rotation of the diffuser may be further included, and the controller may control the diffuser by selecting one of a first state in which the diffuser is rotated in the rotation direction of the fan, a second state in which the diffuser is stopped, and a third state in which the diffuser is rotated in the opposite direction of the rotation direction of the fan.

An auxiliary fan arranged in the housing may be further included, and the housing may further include an auxiliary outlet arranged for air blown from the auxiliary fan to be discharged.

The housing may further include an auxiliary flow path for auxiliary air brought into the housing to flow to the auxiliary outlet through the auxiliary fan, and the auxiliary flow path may be arranged to prevent the auxiliary air flowing in the auxiliary flow path from passing through the heat exchanger.

The opening may include a first opening and a second opening arranged separately from the first opening, the diffuser may include a first diffuser arranged on the first opening and a second diffuser arranged on the second opening, and the first diffuser and the second diffuser may be arranged to be independently rotated.

A controller for controlling rotation of the first diffuser and the second diffuser may be further included, and the controller may be configured to control the first diffuser and the second diffuser by selecting one of a first state in which both the first diffuser and the second diffuser are rotated in the rotation direction of the fan, a second state in which one of the first diffuser and the second diffuser is stopped while the other is rotated in the rotation direction of the fan, and a third state in which both the first diffuser and the second diffuser are stopped.

The opening may include a first opening and a second opening arranged separately from the first opening, the diffuser may include a first diffuser arranged on the first opening and a second diffuser arranged on the second opening, and the first diffuser and the second diffuser may be arranged to be rotated separately.

A controller for controlling the rotation of the first diffuser and the second diffuser may be further included, and the controller may be configured to control the first diffuser and the second diffuser by selecting one of a first state in which both the first diffuser and the second diffuser are rotated in the rotation direction of the fan, a second state in which one of the first diffuser and the second diffuser is stopped while the other is rotated in the rotation direction of the fan, a third state in which both the first diffuser and the second diffuser are stopped, a fourth state in which both the first diffuser and second diffuser are rotated in an opposite direction of the rotation direction of the fan, a fifth state in which one of the first diffuser and the second diffuser is stopped while the other is rotated in the opposite direction of the rotation direction of the fan, and a sixth state in which one of the first diffuser and the second diffuser is rotated in the rotation direction of the fan while the other is rotated in the opposite direction of the rotation direction of the fan.

According to an embodiment of the disclosure, an indoor unit of air conditioner includes a housing having an opening shaped like a circle, a heat exchanger arranged in the housing, a fan rotated around a rotation axis extending in a direction to which the opening is opened, and a diffuser placed at the opening and arranged for air having exchanged heat with the heat exchanger to be discharged by the fan, wherein the diffuser includes a ring corresponding to the opening, a center part arranged in the middle of the ring, and a plurality of vanes extending from the center portion to the ring, and is arranged to be selectively rotated around a rotation axis extending in the same direction as the rotation axis of the fan in the same direction as the rotation direction of the fan, and wherein the plurality of vanes are arranged to guide the air discharged by the fan in the rotation direction of the diffuser when the diffuser is rotated.

A fan driving motor for driving the fan may be further included, and the fan driving motor may be arranged on the rear surface of the center part.

A diffuser driving motor for driving the diffuser may be further included, and the diffuser driving motor may be arranged on the rear surface of the center part.

The plurality of vanes may each have an end connected to the center part and the other end connected to the ring, and each of the plurality of vanes may be curved from the one end in the rotation direction of the fan or the opposite direction of the rotation direction of the fan to extend to the other end.

According to an embodiment of the disclosure, an indoor unit of air conditioner includes a housing having an opening shaped like a circle, a heat exchanger arranged in the housing, a fan rotated around a rotation axis extending in a direction to which the opening is opened, a diffuser rotationally arranged at the opening for air blown by the fan to be discharged, and a controller configured to control the diffuser to be rotated selectively, wherein the diffuser includes a ring corresponding to the opening, a center part arranged in the middle of the ring, and a plurality of vanes each extending from the center part to the ring, and wherein the plurality of vanes may be arranged to guide air discharged by the fan in a rotation direction of the diffuser when the diffuser is rotated.

An aspect of the disclosure provides an indoor unit of an air conditioner with a discharge-airflow-control structure enhanced to reduce a flow loss of discharged air.

The disclosure also provides an indoor unit of an air conditioner enhanced to enable efficient diffusion of air discharged from the indoor unit and enable efficient concentration of the air discharged from the indoor unit.

According to the disclosure, an indoor unit of an air conditioner may efficiently control a discharge airflow while reducing a flow loss of the discharged air by changing the airflow discharged by rotation of a diffuser.

Embodiments of the disclosure are only the most preferred examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

As used herein, the singular forms "a", "an" and "the" are intended to include the plural forms as well, unless the context clearly indicates otherwise. For the sake of clarity, the elements of the drawings are drawn with exaggerated forms and sizes.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification, the term 'identical' includes meanings of being similar in attributes to each other or similar to each other within a certain range. The term 'being same' means being substantially the same. The expression 'substantially the same' should be construed that a numerical value within an error range or a numerical value having a difference in a non-meaningful range to a reference value falls within a range of 'being the same'.

Reference will now be made in detail to embodiments of the disclosure, which are illustrated in the accompanying drawings.

Figure 1:
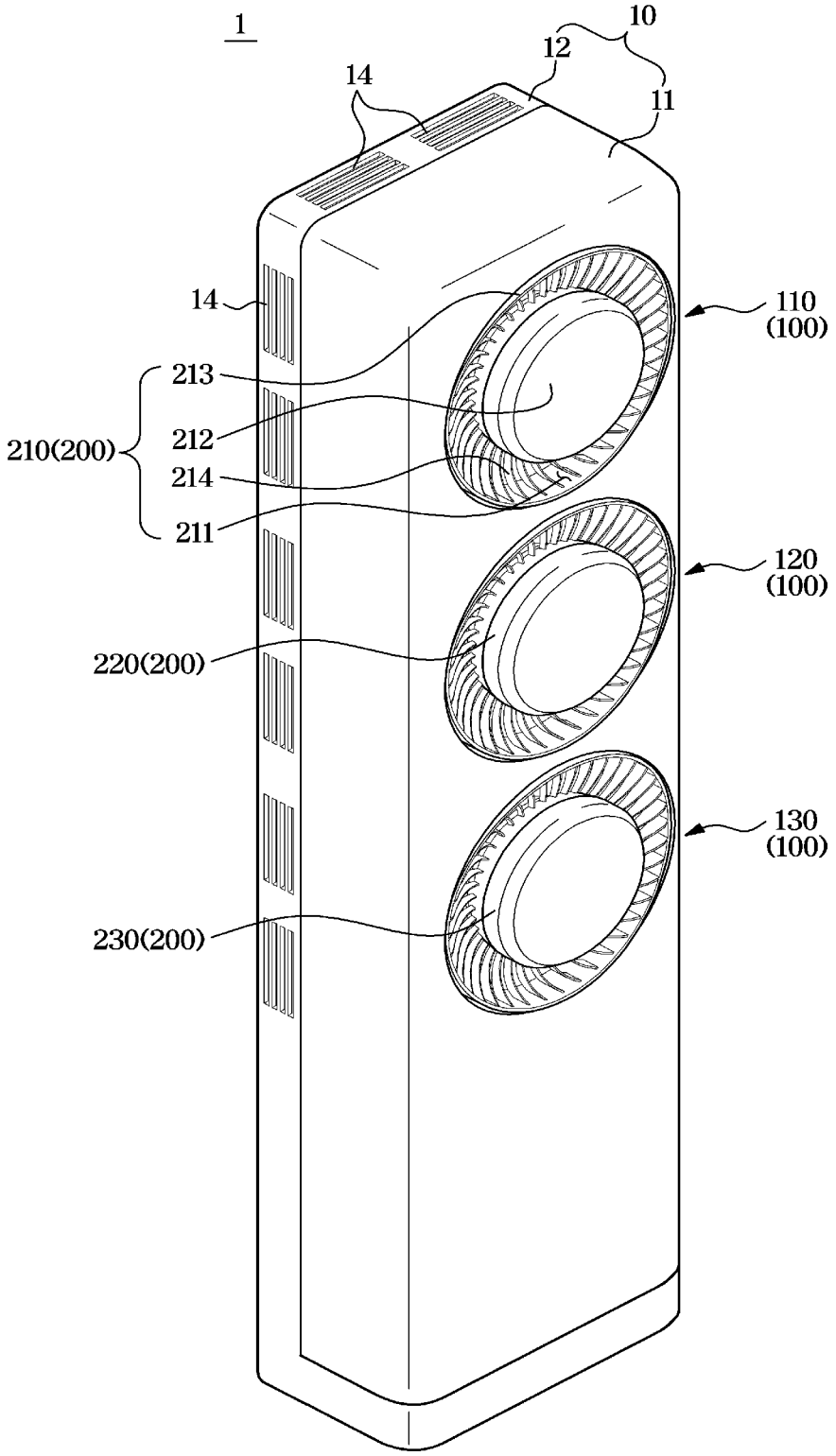
FIG. 1 illustrates an indoor unit of an air conditioner, according to a first embodiment of the disclosure.
Figure 2:
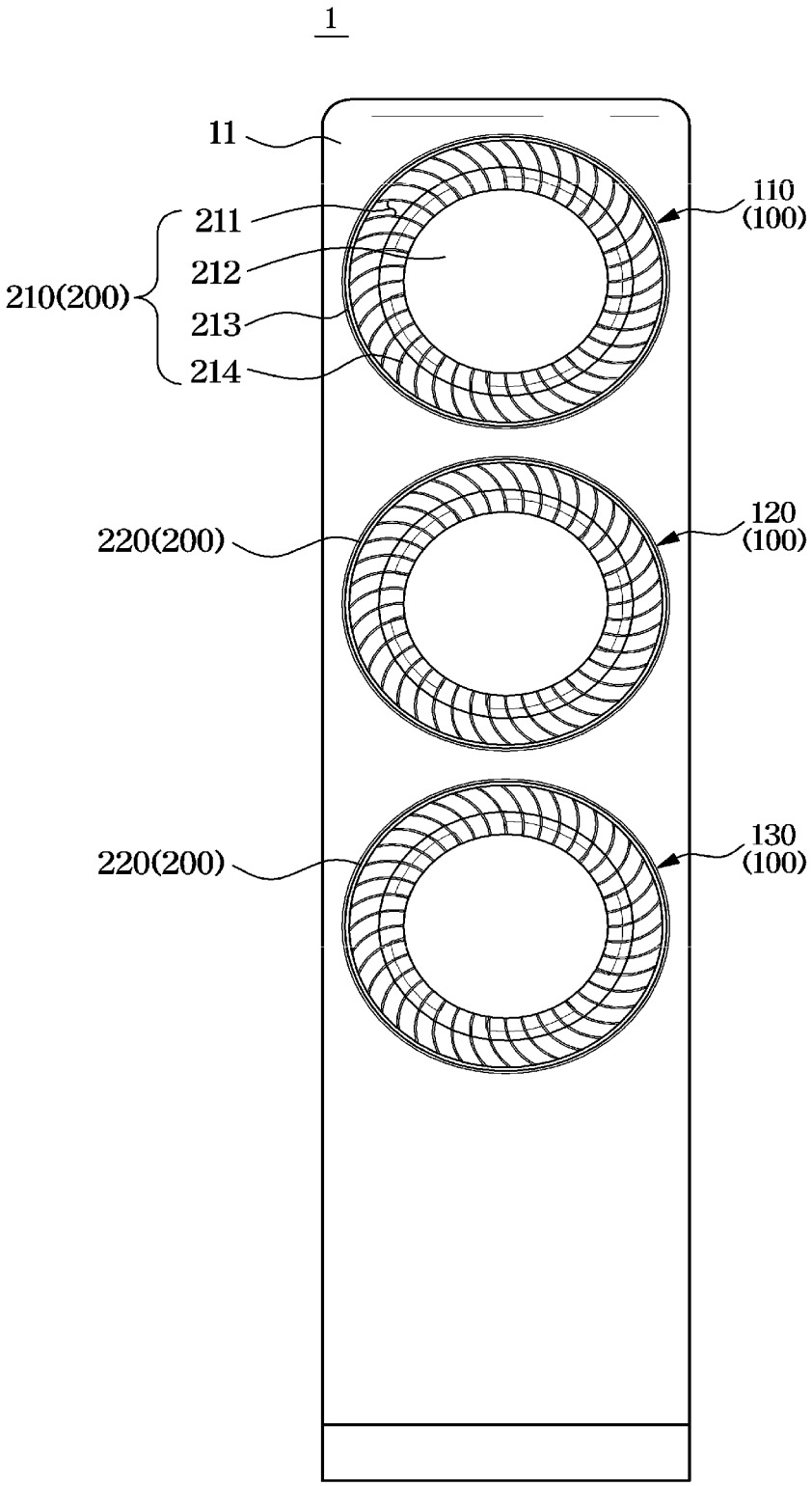
FIG. 2 is a front view of the indoor unit shown in FIG. 1.
Figure 3:
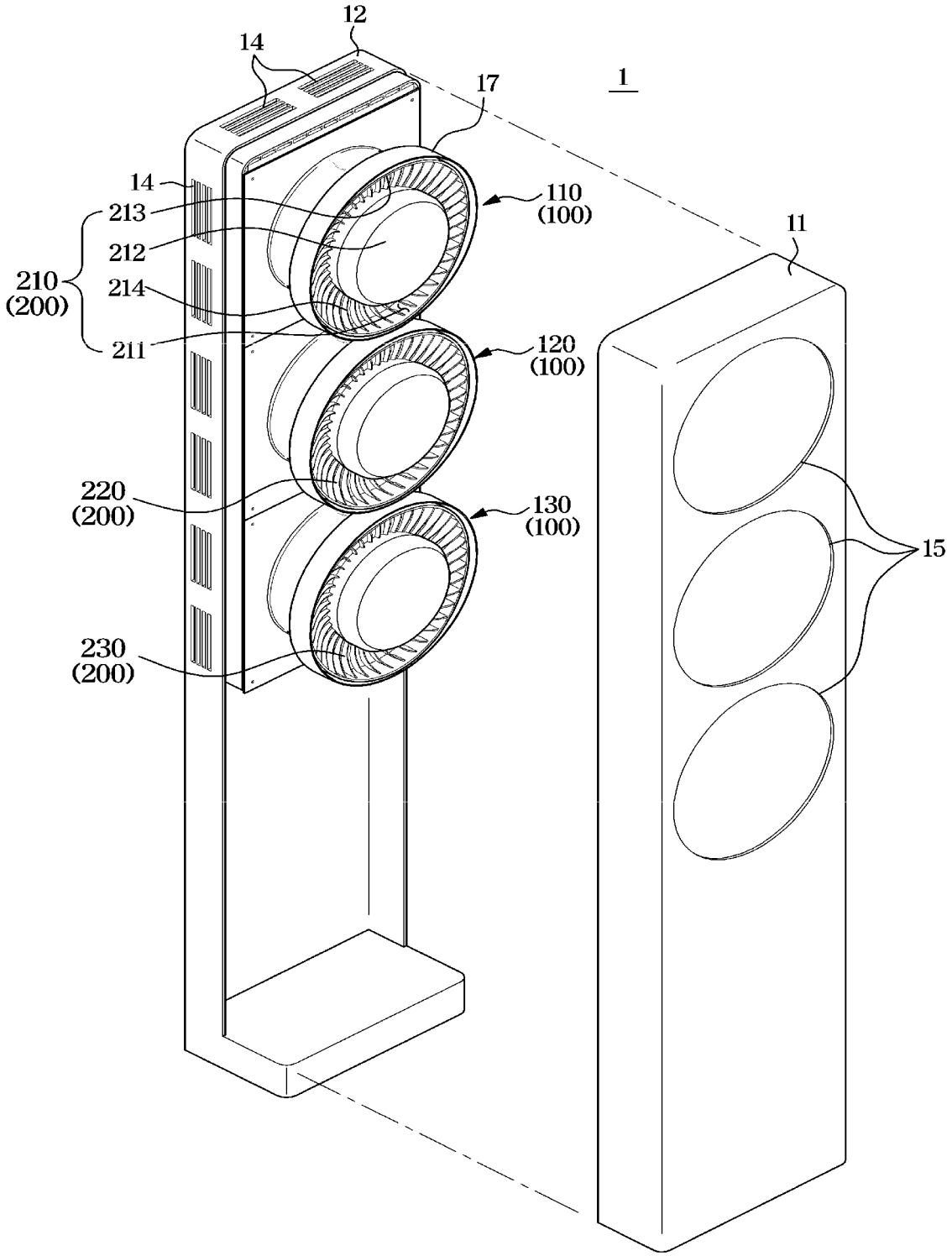
FIG. 3 illustrates the indoor unit shown in FIG. 1 with a front panel separated therefrom.
Figure 4:
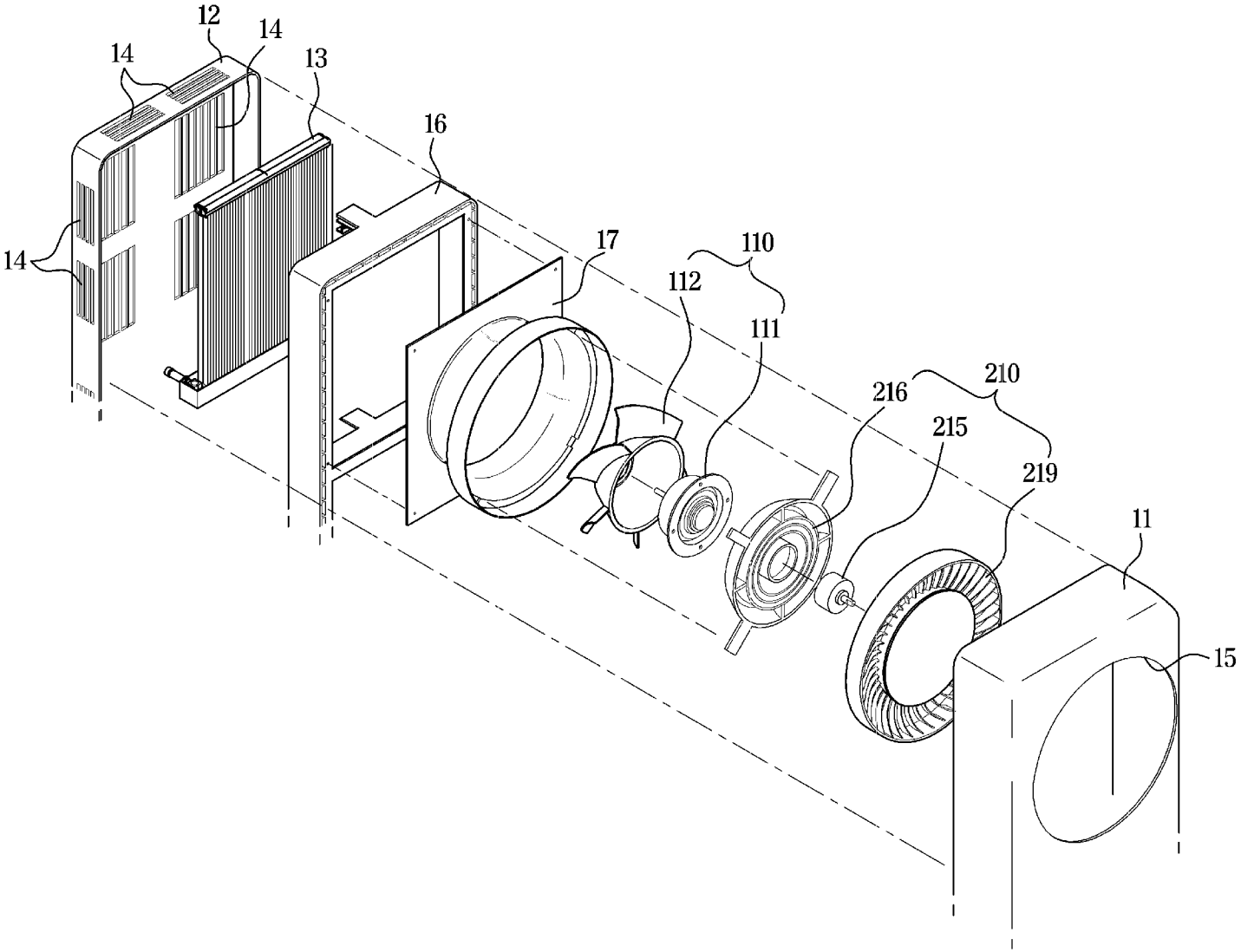
FIG. 4 is an exploded perspective view of a portion of the indoor unit shown in FIG. 1.
Figure 5:
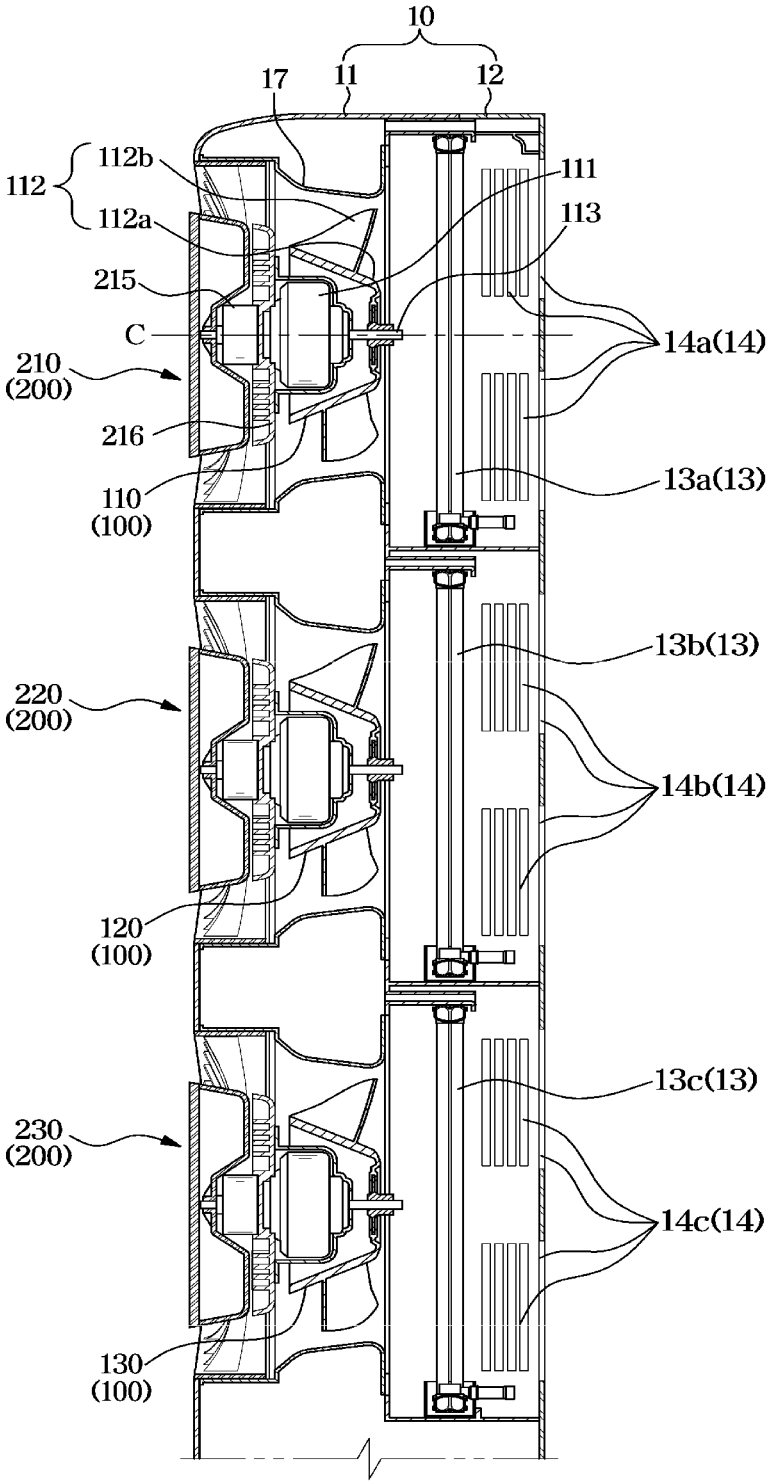
FIG. 5 is a cross-sectional view of the indoor unit shown in FIG. 1.

FIG. 1 illustrates an indoor unit of an air conditioner, according to a first embodiment of the disclosure, FIG. 2 is a front view of the indoor unit shown in FIG. 1, and FIG. 3 illustrates the indoor unit shown in FIG. 1 with a front panel separated therefrom. FIG. 4 is an exploded perspective view of a portion of the indoor unit shown in FIG. 1, and FIG. 5 is a cross-sectional view of the indoor unit shown in FIG. 1.

As shown in FIGS. 1 to 5, an indoor unit 1 of an air conditioner includes a housing 10 that constitutes an exterior of the indoor unit 1, a blower fan unit 100 arranged in the housing 10, at least one heat exchanger 13 arranged behind the blower fan unit 100 in the housing 10, and an inlet 14 arranged on the rear surface of the housing 10.

Unlike the embodiment of the disclosure, the indoor unit 1 of the air conditioner may not include the heat exchanger. In this case, the indoor unit 1 of the air conditioner may be configured to capture foreign materials in indoor air while circulating the indoor air and discharge air with the foreign materials removed therefrom. Alternatively, the indoor unit 1 of the air conditioner may simply circulate the indoor air without capturing the foreign materials in the air.

However, in the following description, it is assumed, for example, that the indoor unit 1 of the air conditioner includes the heat exchanger 11 to remove the foreign materials in the indoor air, and delivers warm or cool air into the room by exchanging heat with the heat exchanger 11.

The housing 10 includes a front panel 11 at which an opening 15 opened to the front of the housing 10 to expose the blower fan unit 100 to the front is formed, and a housing body 12 coupled to the back of the front panel 11. The opening 15 may be shaped like a circle.

The indoor unit 1 of the air conditioner may include a diffuser 200 that forms an outlet 211 of the blower fan unit 100 and that is arranged on the opening 15 of the housing 10.

The air blown by the blower fan unit 100 may be discharged out of the housing 10 through the diffuser 200.

The indoor unit 1 of the air conditioner is not limited to the embodiment of the disclosure, but may further include a grill (not shown) to be arranged in front of the diffuser 200. The grill may be provided to prevent a hand of the user from coming into the diffuser 200. The grill may be arranged to extend to the front of the front panel 11 to cover at least some area of the front panel 11 of the housing 10. It is not, however, limited thereto, and the grill may be selectively arranged in front of the diffuser 200.

The blower fan unit 100 may be provided with a mixed flow fan. It is not, however, limited thereto, but may be provided with another type of fan. The blower fan unit 100 may be provided as a plurality of blower fan units 110, 120, and 130. The blower fan unit 100 may be formed with a single fan, but according to an embodiment of the disclosure, the blower fan unit 100 may be provided as the plurality of blower fan units 110, 120, and 130. The plurality of blower fan units 110, 120, and 130 may be separately placed in a direction of the length of the housing 10. Specifically, in an embodiment of the disclosure, the plurality of blower fan units 110, 120, and 130 may be separately arranged in the vertical direction of the indoor unit 1 of the air conditioner.

The opening 15 of the housing 10 may be provided in the plural to match the plurality of blower fan units 110, 120, and 130. The plurality of openings 15 may be separately placed in a direction of the length of the front panel 11. Specifically, the plurality of openings 15 may be arranged to match the plurality of blower fan units 110, 120 and 130, so they may be separately placed in the vertical direction of the indoor unit 1 of the air conditioner.

The diffuser 200 may be provided in the plural, i.e., 210, 220, and 230, to match the plurality of blower fan units 110, 120, and 130. The plurality of diffusers 210, 220, and 230 may be arranged to match the plurality of openings 15.

The plurality of blower fan units 110, 120 and 130 or the plurality of diffusers 210, 220 and 230 are the same as each other, so one of the blower fan units, e.g., 110 or one of the diffusers, e.g., 210, will be described as a representative to avoid repetition of explanation.

The blower fan unit 110 may include a fan driving motor 111 arranged on the rear surface of the diffuser 210, and a blower fan 112 rotationally coupled to the fan driving motor 111.

The indoor unit 1 of the air conditioner may include a duct 17 arranged to cover at least some of the diffuser 210 from behind the diffuser 210 to form a flow path in which air flows while the air sucked in by the blower fan 112 is being discharged to the outlet 211 of the diffuser 210.

The diffuser 210 may be arranged in front of the blower fan 112 for the air blown by the blower fan 112 to be discharged out of the housing 10 through the diffuser 210.

The diffuser 210 may include a center part 212 arranged in the middle of the opening 15, a ring 213 arranged outside of the center part 212 to form sides of the diffuser 210, and the outlet 211 formed between the center part 212 and the ring 213.

The center part 212 may be provided as a round disc plate. It is not, however, limited thereto, but may be provided to have various shapes.

The ring 213 may have a shape that approximately matches the inner circumferential surface of the opening 15. The ring 213 may be provided to have a ring shape. Hence, the outlet 211 may be provided to have a ring shape formed between the outer circumferential surface of the center part 212 and the inner circumferential surface of the ring 213. Accordingly, the air flowing through the blower fan 112 may be discharged out of the housing 10 through the outlet 211.

The diffuser 210 may include a plurality of vanes 214 arranged between the center part 212 and the ring 213. Some of the outlet 211 may be partitioned by the plurality of vanes 214, and accordingly, the plurality of vanes 214 may guide the air discharged through the outlet 211.

One end 214*a* of each of the plurality of vanes 214 may be connected to the outer circumferential surface of the center part 212 and the other end of each of the plurality of vanes 214 may be connected to the inner circumferential surface of the ring 213. This will be described in detail later.

The wind direction and wind volume of the air discharged through the outlet 211 may be controlled by adjusting the number, the shape, a placement angle or the like of the plurality of vanes 214.

Furthermore, the wind direction and wind volume of the air discharged through the outlet 211 may be controlled by adjusting the gap between the center part 212 and the ring 213 to reduce or increase the width in the radial direction of the outlet 211, and the wind direction and wind volume of the air discharged through the outlet 211 may be controlled by adjusting the diameter of the center part 212.

The diffuser 210 may include a diffuser body 219 into which the center part 212, the ring 213, and the plurality of vanes 214 are integrally formed. Although the center part 212, the ring 213, and the plurality of vanes 214 are integrally formed into the diffuser body 219 in the embodiment of the disclosure, each of the components 212, 213 and 214 may be provided separately.

The diffuser 210 may include a diffuser driving motor 215 provided to rotate the plurality of vanes 214 in a rotation direction of the blower fan 112 or in the opposite direction of the rotation direction. The diffuser driving motor 215 may be provided to rotate the diffuser body 219.

The diffuser driving motor 215 may be placed on the rear surface of the center part 212. The diffuser driving motor 215 may deliver rotational power to the plurality of vanes 214 to rotate the plurality of vanes 214.

The diffuser 210 may include a bracket 216 to support the diffuser driving motor 215. At least some of the bracket 216 may be arranged on the rear surface of the center part 212 of the diffuser 210 so that the diffuser driving motor 215 are arranged on the rear surface of the center part 212.

The bracket 216 may be coupled to the duct 17 not to restrict rotation of the plurality of vanes 214 and support the diffuser driving motor 215. It is also not limited thereto, and the bracket 216 may be coupled directly to the housing 10 to support the diffuser driving motor 215.

Although the bracket 216 is described as a part of the diffuser 210 in the embodiment of the disclosure, it is not limited thereto, and the bracket 216 may be a part of the duct 17 or may be a separate part not included in the diffuser 210 nor the duct 17.

The fan driving motor 111 may also be supported by being coupled to the bracket 216.

Based on a direction to which the opening 15 is opened, the diffuser driving motor 215 may be coupled onto the front surface of the bracket 216 and the fan driving motor 111 may be coupled onto the rear surface of the bracket 216. It is not, however, limited thereto, and the fan driving motor 111 and the diffuser driving motor 215 may be arranged on the same surface of the bracket 216.

The fan driving motor 111 is arranged on the rear surface of the center part 212 so that a rotation axis 113 of the fan driving motor 111 is placed in a direction toward the rear surface of the housing body 12, to rotate the blower fan 112. The diffuser driving motor 215 is arranged on the rear surface of the center part 212 so that a rotation axis (not shown) of the diffuser driving motor 215 is placed in a direction toward the opening 15 of the front panel 11, to rotate the plurality of vanes 214.

The blower fan 112 has a structure arranged between the diffuser 210 and the heat exchanger 13 to suck in air that has exchanged heat in the heat exchanger 13 and discharge the air through the outlet 211, and includes a hub 112*a* coupled to the rotation axis 113 of the fan driving motor 111 and a plurality of wings 112*b* coupled to the outer circumferential surface of the hub 112*a*.

The diameter of the hub 112*a* gradually decreases in a direction to which the rotation axis 113 of the fan driving motor 111 is directed, i.e., a direction toward the rear surface of the housing body 12, so the outer circumferential surface of the hub 112*a* is slopingly formed. The blower fan 112 may be shaped like a mixed flow fan and arranged to discharge the air sucked in by the blower fan 112 to be slopingly discharged toward the outlet 211.

At least three of the wings 112*b* are arranged along the outer circumferential surface of the hub 112*a* at regular intervals. The wing 112*b* forms pressure gradient in the forward and backward directions of the blower fan 112 to create a constant air flow while the wing 112 is rotated along with the hub 112*a*.

The duct 17 is arranged in a circular shape that encloses the blower fan 112 to create a flow path of air for the air sucked in by the blower fan 112 to flow to the outlet 211.

The front surface of the duct 17 and the rear surface of the diffuser 210 may be coupled. Furthermore, as described above, the duct 17 may be arranged to support the bracket 216. Accordingly, the duct 17 may support the bracket 216 so that the bracket 216 is arranged on the rear surface of the center part 212.

The housing 10 may include a fixing frame 15 to fixedly support the duct 17. It is not, however, limited thereto, and the duct 17 may be coupled directly to one of the front panel 11 or the rear panel 12.

The heat exchanger 13 may be arranged between the blower fan unit 110 and an inlet 14 to absorb heat from the air brought in through the inlet 14 or deliver heat to the air brought in through the inlet 14.

There may be one or multiple heat exchangers 13 arranged in the indoor unit 1. Specifically, as many heat exchangers 13 as the number of the plurality of blower fan units 110, 120 and 130 may be arranged behind the plurality of blower fan units 110, 120 and 130 to match the plurality of blower fan units 110, 120 and 130, or a single heat exchanger 13 having a size corresponding to the whole of the plurality of blower fan units 110, 120 and 130 may be arranged. Furthermore, not all the heat exchangers 13 need to have the same heat exchange capacity. For example, one of the plurality of heat exchangers 13 that has relatively small heat exchange capacity may be arranged behind the one blower fan unit 110 and another heat exchanger that has relatively large heat exchange capacity may be arranged behind two or more blower fan units 120 and 130.

The inlet 14 is formed on the housing body 12 placed behind the heat exchanger 13 to guide the air outside the indoor unit 1 to flow into the indoor unit 1. The inlet 14 may be located at one or more of top, side, and rear surfaces of the housing body 12.

Like the heat exchanger 13, there may be one or multiple inlets 14 arranged on the housing body 12. As many inlets 14 as the number of the plurality of blower fan units 110, 120 and 130 may be arranged on the housing body 12 to match the plurality of blower fan units 110, 120 and 130, or a single inlet 14 having a size corresponding to the whole of the plurality of blower fan units 110, 120 and 130 may be arranged. Not all the plurality of inlets 14 need to have the same size.

In an embodiment of the disclosure, the indoor unit 1 may include the plurality of blower fan units 110, 120 and 130, the plurality of diffusers 210, 220 and 230, the plurality of heat exchangers 13, the plurality of inlets 14, and the plurality of openings 15. For convenience of explanation, as shown in FIG. 5, the plurality of blower fan units 100 includes the first blower fan unit 110, the second blower fan unit 120, and the third blower fan unit 130 separately arranged in a direction of the length of the indoor unit 1.

The plurality of diffusers 200 may be arranged in front of the plurality of blower fan units 100 and arranged on the plurality of openings 15. The plurality of diffusers 200 may include the first diffuser 210 matching the first blower fan unit 110, the second diffuser 220 matching the second blower fan unit 120, and the third diffuser 230 matching the third blower fan unit 130.

First to third heat exchangers 13*a*, 13*b* and 13*c* separately arranged in the direction of the length of the indoor unit 100 are included between the inlets 14. The plurality of inlets 14 include a first inlet 14*a*, a second inlet 14*b*, and a third inlet 14*c* separately arranged in the direction of the length of the indoor unit 100 behind the heat exchangers 130.

The plurality of heat exchangers 13 include the first heat exchanger 13*a*, the second heat exchanger 13*b*, and the third heat exchanger 13*c* separately arranged in the direction of the length of the indoor unit 1 between the plurality of blower fan units 10 and the inlets 14. The plurality of inlets 14 include the first inlet 14*a*, the second inlet 14*b*, and the third inlet 14*c* separately arranged in the direction of the length of the indoor unit 1 behind the heat exchangers 13.

The first diffuser 210, the first blower fan unit 110, the first heat exchanger 13*a*, and the first inlet 14*a* may be arranged to be aligned with one another, the second diffuser 220, the second blower fan unit 120, the second heat exchanger 13*b*, and the second inlet 14*b* may be arranged to be aligned with one another below the first diffuser 210, the first blower fan unit 110, the first heat exchanger 13*a*, and the first inlet 14*a*, respectively, and the third diffuser 230, the third blower fan unit 130, the third heat exchanger 13*c*, and the third inlet 14*c* may be arranged to be aligned with one another below the second diffuser 220, the second blower fan unit 120, the second heat exchanger 13*b*, and the second inlet 14*b*, respectively.

In this way, as the plurality of diffusers 210, 220 and 230, the plurality of blower fan units 110, 120 and 130, the plurality of heat exchangers 13*a*, 13*b* and 13*c*, and the plurality of inlets 14*a*, 14*b* and 14*c* arranged on upper, middle, and lower levels in the direction of the length of the indoor unit 100, are aligned in the front-back direction, the indoor unit may have a slim width, in which case the flow path formed between the inlet 14 and the outlet 211 becomes short, so the operation efficiency of the indoor unit 1 increases while the noise is reduced.

The first blower fan unit 110, the second blower fan unit 120, and the third blower fan unit 130 may be controlled to be separately turned on/off or rotated at different speeds, and the first heat exchanger 13*a*, the second heat exchanger 13*b*, and the third heat exchanger 13*c* corresponding to the first blower fan unit 110, the second blower fan unit 120, and the third blower fan unit 130, respectively, may be controlled to separately receive refrigerant according to the operation state (on/off) of the first to third blower fan units 110, 120 and 130. For example, when the first and second blower fan units 110 and 120 are activated (turned on) and the third blower fan unit 130 is stopped (turned off), the first and second heat exchangers 13*a* and 13*b* corresponding to the first and second blower fan units 110 and 120 may be controlled to receive the refrigerant while the third heat exchanger 13*c* corresponding to the third blower fan unit 130 is controlled not to receive the refrigerant. Although not shown, to control the refrigerant supplied to the first to third heat exchangers 13*a*, 13*b* and 13*c*, respective valves to block flow paths between refrigerant tubes connected to the respective first to third heat exchangers 13*a*, 13*b* and 13*c* and the first to third heat exchangers 13*a*, 13*b* and 13*c* may be installed, or a valve having multiple ports (e.g., three-way valve) connected to the first to third heat exchangers 13*a*, 13*b* and 13*c* may be installed, and as for types of such valves, there may be a solenoid based electronic on/off valve, a pneumatic on/ff valve, etc.

Furthermore, as will be described later, the first to third diffusers 210, 220 and 230 may be controlled to be separately turned on/off or rotated at different speeds.

The diffuser 200 will now be described in detail.

Figure 6:
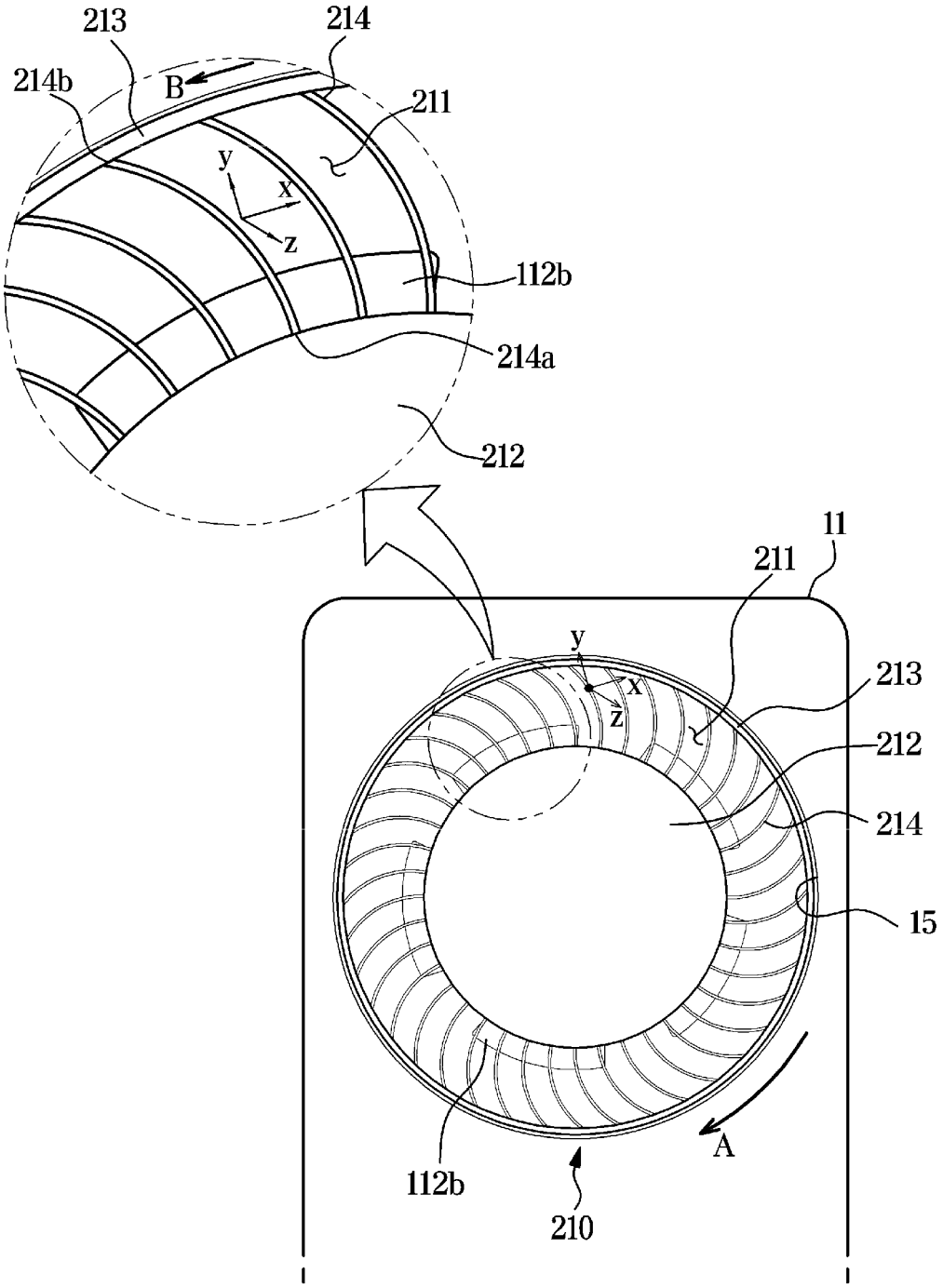
FIG. 6 illustrates a diffuser of the indoor unit of an air conditioner, according to the first embodiment of the disclosure.
Figure 7:
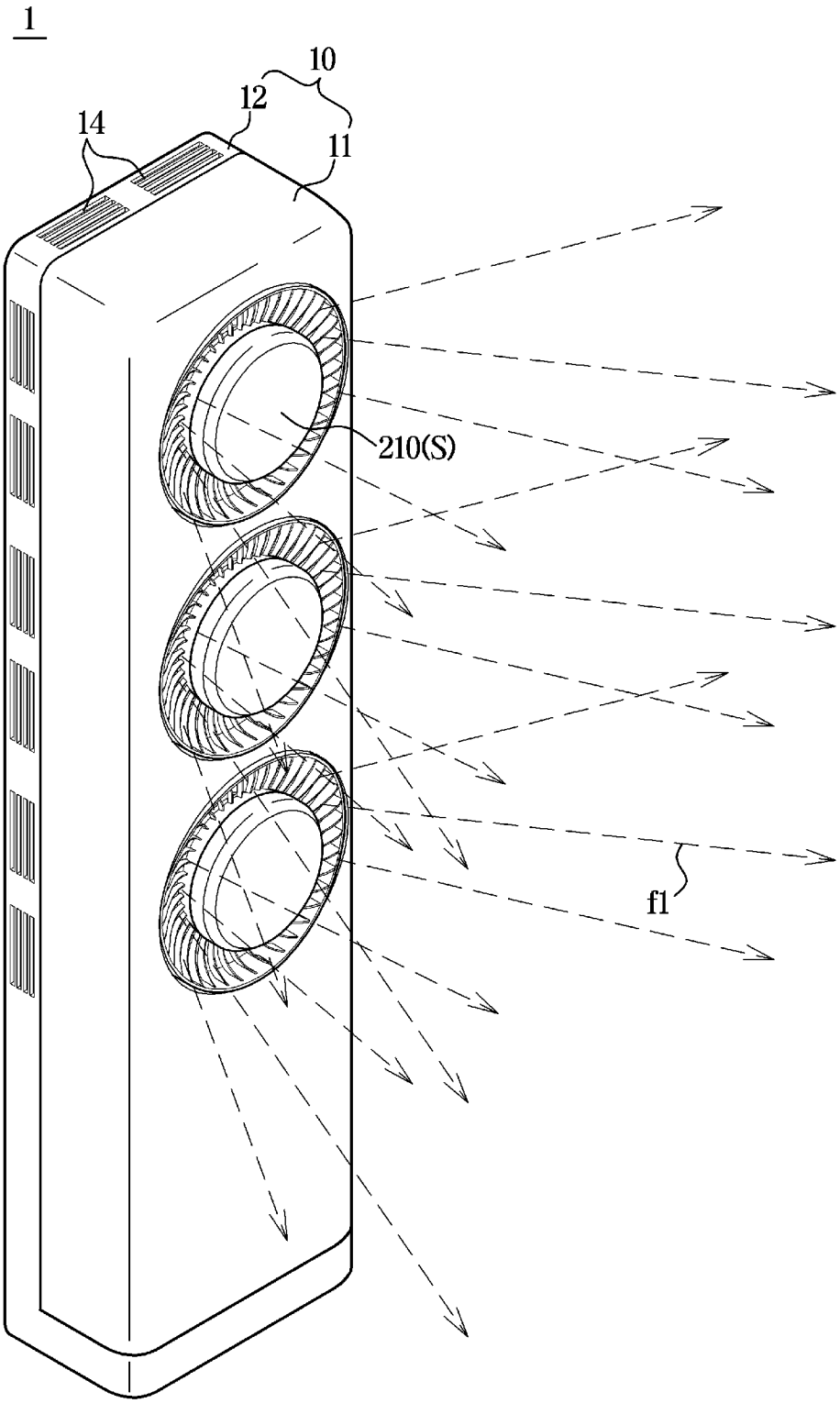
FIG. 7 schematically illustrates discharge airflows released from an outlet according to an operation mode of the indoor unit of the air conditioner, according to the first embodiment of the disclosure.
Figure 8:
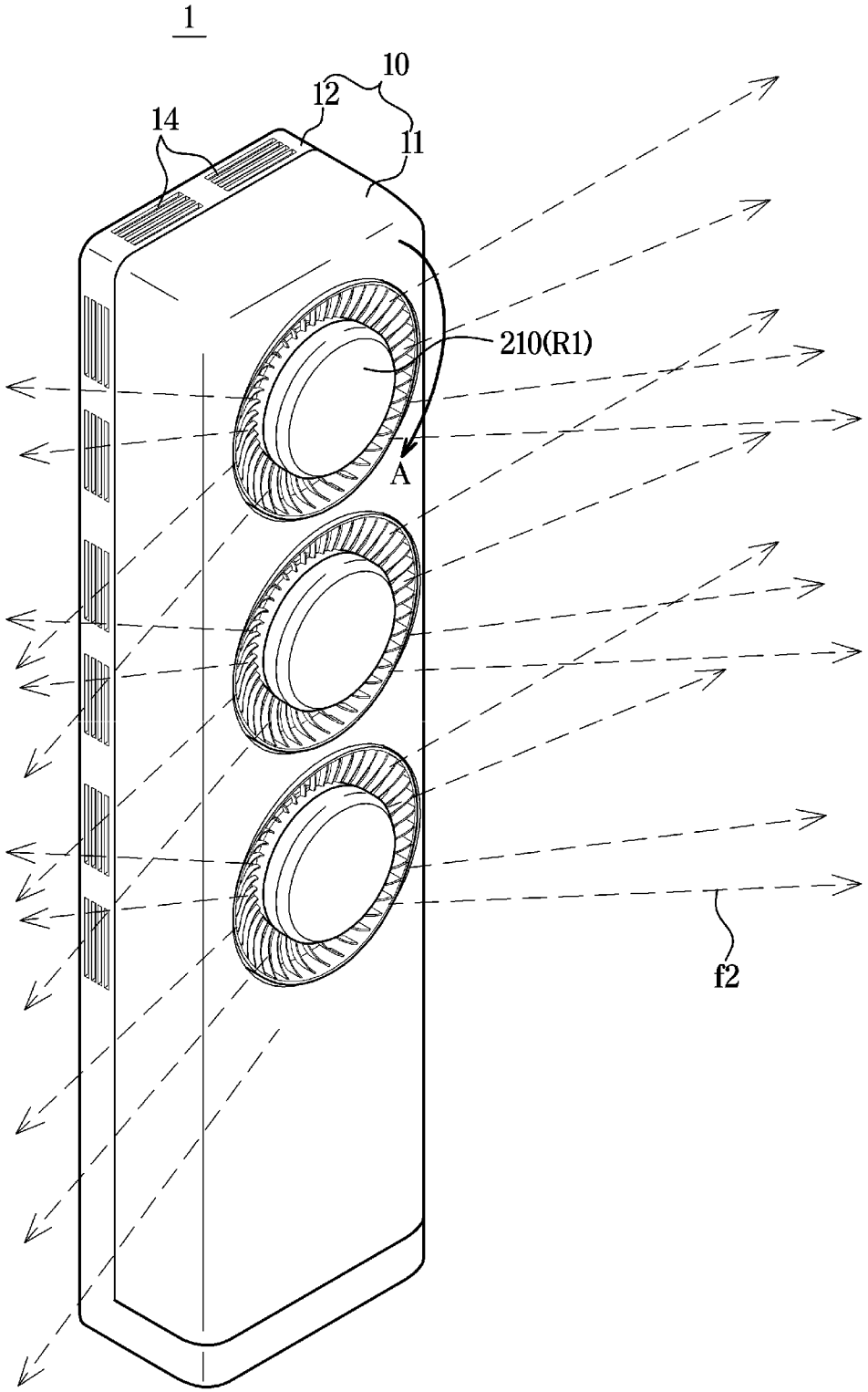
FIG. 8 schematically illustrates discharge airflows released from an outlet according to an operation mode of the indoor unit of the air conditioner, according to the first embodiment of the disclosure.
Figure 9:
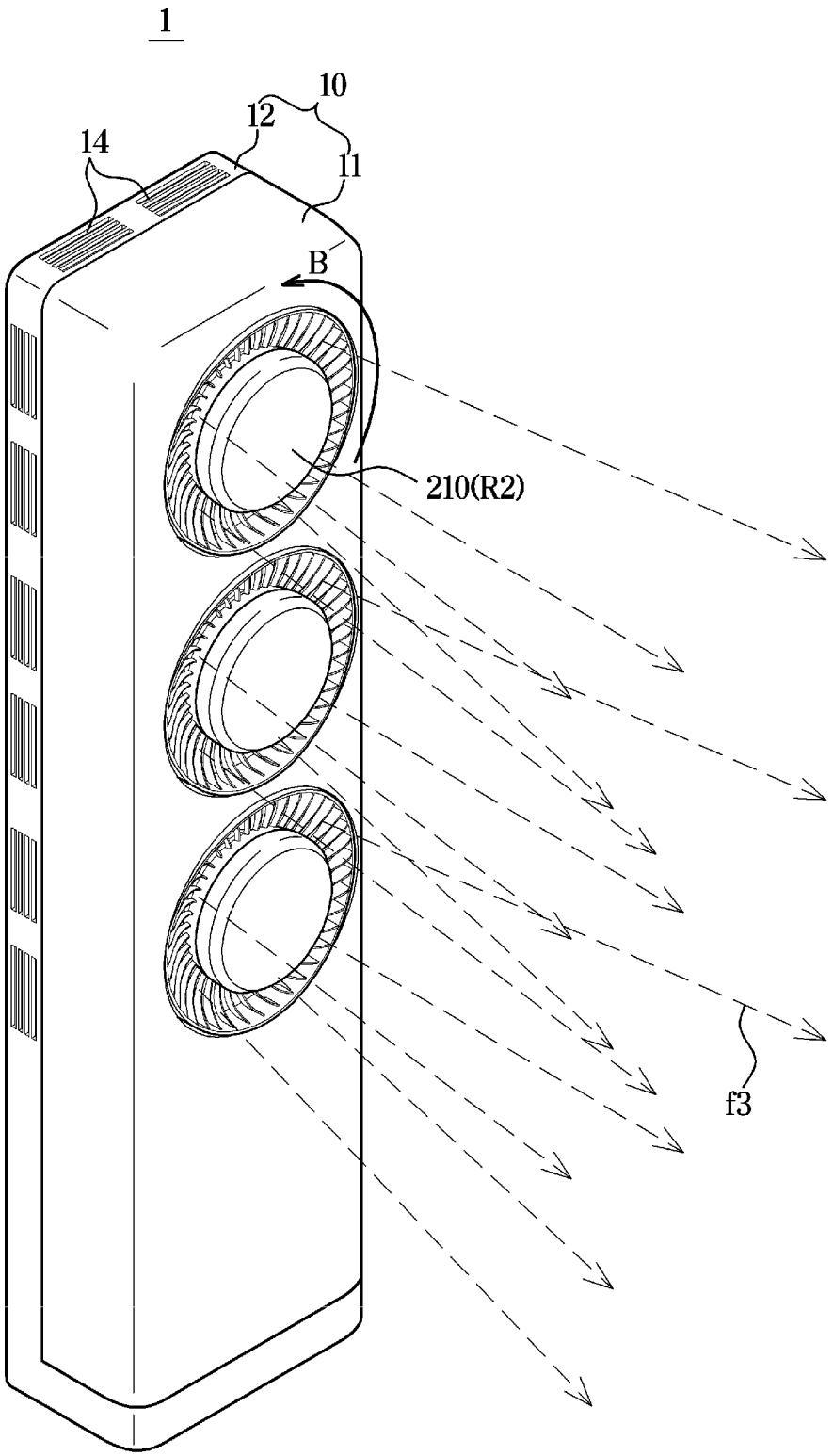
FIG. 9 schematically illustrates discharge airflows released from an outlet according to an operation mode of the indoor unit of the air conditioner, according to the first embodiment of the disclosure.

FIG. 6 illustrates a diffuser of the indoor unit of the air conditioner, according to the first embodiment of the disclosure, FIG. 7 schematically illustrates discharged air currents released from outlets according to an operation mode of the indoor unit of the air conditioner, according to the first embodiment of the disclosure, FIG. 8 schematically illustrates discharged air currents released from outlets according to an operation mode of the indoor unit of the air conditioner, according to the first embodiment of the disclosure, and FIG. 9 schematically illustrates discharged air currents released from outlets according to an operation mode of the indoor unit of the air conditioner, according to the first embodiment of the disclosure.

As shown in FIG. 6, the diffuser 210 may include a plurality of vanes 214 arranged between the center part 212 and the ring 213. The diffuser 210 may be arranged in front of the blower fan 112 for the air that has passed the blower fan 112 to be discharged to the front of the front panel 11 through the outlet 211. In this case, the air discharged through the plurality of vanes 214 arranged on the outlet 211 may be guided. The wind direction and wind volume of the air discharged through the outlet 211 may be controlled by adjusting the number, the shape, a placement angle or the like of the plurality of vanes 214.

The plurality of vanes 214 are formed in the shape of spiral wings from the center part 214 to the ring 213, thereby guiding the discharged air blown out from the blower fan 112 to be discharged to the outside.

The plurality of vanes 214 are formed to run from the center part 212 to the ring 213 in the radial direction of the ring 213. Specifically, one ends 214*a* of the plurality of vanes 214 may be arranged to be adjacent to the center part 212 and the other ends of the plurality of vanes 214 may be arranged to be adjacent to the ring 213.

Preferably, one ends 214*a* of the plurality of vanes 214 may be arranged to adjoin the outer circumferential surface of the center part 212 and the other ends of the plurality of vanes 214 may be arranged to adjoin the inner circumferential surface of the ring 213. The disclosure is not, however, limited thereto, and when the center part 212, the ring 213, and the plurality of vanes 214 are not integrally formed but may be separately formed, the one ends 214*a* and the other ends 214*b* of the plurality of vanes 214 may be arranged not to contact but to be adjacent to the center part 212 and the ring 213.

The plurality of vanes 214 may be curved toward a second direction B, opposite to a first direction A, which is the rotation direction of the blower fan 112 along the radial direction of the ring 213.

When the blower fan 112 is rotated clockwise when viewed from the front of the diffuser 210, the plurality of vanes 214 are formed to be curved counterclockwise from the center part 212 to the ring 213, and when the blower fan 112 is rotated counterclockwise, the plurality of vanes 214 are formed to be curved clockwise from the center part 214 to the ring 214.

Specifically, each of the plurality of vanes 214 includes the one end 214*a* arranged to be adjacent to the center part 214 and the other end 214*b* adjoining the ring 213, and may be formed to curved toward the second direction B opposite to the first direction A, which is the rotation direction of the blower fan 112, from the one end 214*a* to extend to the other end 214*b*. That is, each vane 214 may extend to be curved in the opposite direction of the rotation direction of the blower fan 112.

Accordingly, the plurality of vanes 214 may be arranged so that a flow of the air discharged from the diffuser 210 is a forward airflow when the diffuser 210 is stopped. The forward airflow refers to an airflow with high directivity to the forward direction.

On the contrary, when the plurality of vanes 214 extend from the center part 214 to the ring 213 to be curved toward the same direction A as the rotation direction of the blower fan 112, the discharged air blown out from the blower fan 112 is guided by the plurality of vanes 214 to form spreading airflows rather than the forward airflow. The spreading airflows refer to airflows that have little directivity to the forward direction but high directivity to other directions than the forward direction and that easily spread in all directions.

However, with a structure as in the disclosure, the plurality vanes 214 block the progress of the discharged air spreading in all directions and guide it to be changed into the forward airflow.

For example, assuming that a direction toward the front of the diffuser 210 is z direction, a radial direction from the center part 214 of the diffuser 210 is y direction, and a direction corresponding to the rotation direction A of the blower fan 112 in the tangential direction of the circular shape of the diffuser 210 is x direction, some of the discharged air blown out from the blower fan 112, which are in the x and y directions, are guided by the plurality of vanes 214 to the z direction.

The air discharged from the indoor unit 1 of the air conditioner may be discharged in the z direction by the blower fan 112. However, as the blower fan 112 is rotated in the first direction A, the air passing the blower fan 112 may have strong fluidity in the x direction corresponding to the rotation direction A of the blower fan 112, and accordingly have an increase in fluidity even in the y direction.

In other words, air fluidity increases in the direction in which the blower fan 112 is rotated, so that the air blown from the blower fan 112 may have an increase in fluidity not only in the z direction, which is a direction in which the air is discharged, but also in the x direction corresponding to the rotation direction A of the blower fan 112 and the y direction engaged with the x direction, thereby being formed into the spreading airflows.

As described above, the spreading airflow discharged through the blower fan 112 may have reduced fluidity in the x and y directions caused by the plurality of vanes 214 arranged in front of the blower fan 112 and have an increase in directivity to the z direction, thereby being changed into the forward airflow. The spreading airflow formed by the blower fan 112 may be changed by the diffuser 210 to the forward airflow.

Specifically, the fluidity of the spreading air in the x direction is limited by the plurality of vanes 214 formed to be curved to the second direction B, which is opposite to the rotation direction of the blower fan 112, so the fluidity in the y direction may decrease accordingly. The fluidity in the z direction increases as much as the air fluidity in the x and y directions decreases, making the force to move forward the air stronger, so the directivity of the spreading airflow may be changed into the forward airflow.

That is, the plurality of vanes 214 may guide the air fluidity in the x and y directions to the z direction, thereby making the air discharged from the diffuser 210 become the forward airflow.

When the plurality of vanes 214 are curved in the first direction A corresponding to the rotation direction of the blower fan 112, the plurality of vanes 214 is unable to limit the fluidity in the x and y directions of the discharge airflow, so the spreading airflow is further developed and progresses from the front of the air conditioner in all directions.

In an embodiment of the disclosure, the plurality of vanes 214 are curved to the second direction B, which is opposite to the rotation direction of the blower fan 112, so while the diffuser 210 is stopped, the discharged air is further developed into the forward airflow rather than the spreading airflow, forming the forward airflow from the front of the air conditioner, and thus far-distance wind blowing is possible. The opposite case will be described later in connection with another embodiment.

The spiral wings of the plurality of vanes 214 may be formed with ribs having certain width. As the plurality of vanes 214 serve to protect internal components such as the blower fan 112 in the indoor unit 1 from the outside but also aim to guide the discharged air blown out from the blower fan 112 to create an airflow, they may be formed with the ribs with certain width to guide the discharged air sufficiently.

As described above, in an embodiment of the disclosure, the indoor unit 1 of the air conditioner may be configured for the diffuser 210 to discharge a forward airflow while the diffuser 210 is stopped.

In this case, when the forward airflow directly reaches the user, the user may feel cold and unpleasant. On the contrary, when the user is at a distance, the discharged air is unable to reach to the space where the user is located even when the forward airflow is created, so the user may feel hot and unpleasant.

To increase the wind volume of the indoor unit of the air conditioner, in the traditional case, revolutions per minute (rpm) of the blower fan is increased to realize a wind velocity of the blower fan, or an amount of the refrigerant to be brought into the heat exchanger is increased to the max.

On the contrary, to minimize airflows that directly touches the user through the indoor unit of the air conditioner, a discharge plate structure formed with a micro-perforated plate is additionally formed on the front of the outlet of the indoor unit to physically reduce the wind speed of the discharge airflow that is passing the discharge plate, thereby making the user feel pleasant.

In the traditional case, the discharge plate structure is additionally used to create spreading airflows in particular, so the spreading airflows are created by making the air fluid speed constant in a certain area to reduce the speed and reducing the fluid speed of the discharged air.

In this case, as some of the airflows discharged from the outlet collide with the discharge plate, a pressure loss of the airflows occurs, so to reduce the pressure loss, there is a method of widening the area of the discharge plate or increasing the size and gap of the micro-porosity, but it is difficult to prevent the pressure loss of the airflow due to a size limit of the indoor unit of the air conditioner.

As described above, the discharge airflow may have an air fluidity loss due to resistance of a flow path formed by the discharge plate, and hence the wind volume may decrease and noise from the collision between the discharge plate and the airflow may increase.

To solve these problems, in an embodiment of the disclosure, the indoor unit 1 of the air conditioner may easily select and change the airflow discharged from the indoor unit 1 of the air conditioner to the forward airflow or the spreading airflow without including the discharge plate structure.

Specifically, the indoor unit 1 of the air conditioner according to an embodiment of the disclosure may control directivity of a discharge airflow so that the air passing the diffuser 210 becomes the forward airflow or the spreading airflow through rotation of the diffuser 210.

The diffuser 210 may be provided to rotate around the rotation axis C of the blower fan 112 in the first direction A, which is the rotation direction of the blower fan 112. Furthermore, the diffuser 210 may be provided to rotate around the rotation axis C of the blower fan 112 in the opposite direction B of the first direction A.

As shown in FIG. 7, while the diffuser 21 is in a stopped state S, the air discharged through the diffuser 210 may be formed into the first airflow f1 having high directivity toward the forward direction. The first airflow f1 may correspond to the aforementioned forward airflow.

The first airflow f1 shown in FIGS. 7 to 9 and second and third airflows f2 and f3, which will be described later, are illustrated in straight lines to increase visibility of the directivity.

As described above, as the plurality of vanes 214 are curved toward the second direction B, they restrict fluidity of the air discharged from the diffuser 210 from flowing in the x direction, which is a tangential direction of the rotation direction A of the blower fan 112, and guide the air to the z direction, which is a direction extended from the rotation axis C of the blower fan 112. Hence, the air passing the diffuser 210 may be formed into the first airflow f1 having higher directivity to the forward direction.

As shown in FIG. 8, when the diffuser 210 is driven in a rotation state R1 in which the diffuser 210 is rotated in the first direction A, the air passing the diffuser 210 may be formed into the second airflow f2 having less directivity toward the forward direction but larger spreadability than the first airflow f1. The second airflow f2 may correspond to the aforementioned spreading airflow.

The diffuser 210 may be provided to rotate in the first direction A, which is the rotation direction of the blower fan 112. As described above, the diffuser 210 may be rotated around the same axis as the rotation axis C of the blower fan 112.

Accordingly, the plurality of vanes 214 may also be provided to rotate in the first direction A. As the plurality of vanes 214 are rotated in the first direction A, they may increase fluidity of the air in the x direction. When the diffuser 210 is rotated in the first direction A, the fluidity of the air in the x direction increases, so the second airflow f2 spreading in all directions may be formed. As the diffuser 210 is rotated in the first direction A, rotationality in the first direction A of the air passing the diffuser 210 is strengthened, thereby increasing the fluidity in the x direction.

Specifically, when the plurality of vanes 214 are in the stopped state S, the plurality of vanes 214 may restrict the air directivity toward the x direction by blocking the air from flowing in the x direction, and change the air directivity into the z direction. However, when the plurality of vanes 214 are driven in the state R1 of rotation in the first direction A, the plurality of vanes 214 may fail to restrict but, on the contrary, increase the air fluidity in the x direction. This is because, as the plurality of vanes 214 are rotated in the same direction A as the blower fan 112, they guide the air to increase the air directivity toward the tangential direction.

The air blown by the blower fan 112 has a strengthened fluidity in the x direction due to rotation of the blower fan 112 and accordingly, the fluidity of the air may increase even in the y direction, and as the diffuser 210 is also rotated in the first direction A, the discharge airflow passing through the diffuser 210 has further increasing directivity toward the first direction A, creating force by which an airflow is formed in a substantially orthogonal direction to the z direction in which the air is discharged, thereby producing the spreading airflow.

Accordingly, when the diffuser 210 is driven in the state R1 of rotation in the first direction A, the air passing through the diffuser 210 may have an increase in fluidity in the x direction and may thus be formed into the second airflow f2 having high directivity in which the air spreads in all directions.

The second airflow f2 has a reduced flow volume and directivity in the forward direction, and may thus have a reduced flow velocity in the forward direction. However, flow distribution of the second airflow f2 spreads in all directions except for the forward direction, and the second airflow f2 may be discharged to the outside from the diffuser 210 at a reduced flow speed in the forward direction without a flow loss.

Accordingly, through the rotation of the diffuser 210, the indoor unit 1 of the air conditioner may cool or heat the room at a minimum wind speed at which the user may feel pleasant. Furthermore, the indoor unit 1 of the air conditioner may be provided to enable convection based cooling with minimum wind velocity in the forward direction and radiation based cooling through a cold air region formed in an adjoining region.

In the traditional case, flow path resistance of air is increased to reduce the flow velocity in the forward direction, causing a flow loss and reduction in flow velocity, thereby degrading cooling or heating efficiency.

A perforated plate with a plurality of discharge holes formed in a flow path of air was arranged to reduce fluid velocity in the forward direction, which caused a pressure loss of the discharged air and a flow loss of the indoor unit of the air conditioner and increases resistance in the discharge flow path, thereby making noise.

On the other hand, according to an embodiment of the disclosure, the indoor unit 1 of the air conditioner creates an airflow with reduced flow velocity in the forward direction without a flow loss of the discharged air by rotation of the diffuser 210, thereby providing fresh air to the user and maintaining the cooling or heating efficiency to a certain level.

On the contrary, as shown in FIG. 9, the diffuser 210 may be rotated in the second direction B, which is opposite to the rotation direction of the blower fan 112.

When the diffuser 210 is driven in a state R2 of being rotated in the second direction B, the air may be formed into a third airflow f3 having higher directivity toward the forward direction than the first airflow f1 when passing the diffuser 210.

The plurality of vanes 214 may guide air passing through the diffuser 210 to an opposite direction of the x direction while being rotated in an opposite direction B of the rotation direction of the blower fan 112. Accordingly, the plurality of vanes 214 may cancel out the fluidity of air discharged from the diffuser in the x and y directions and change the fluidity in the x and y directions to the z direction. In other words, the directivity of the discharge airflow to the x direction may be extinguished, and the discharge airflow may be guided to the forward airflow by changing moving directions of the discharged air spreading in all directions to the forward direction.

Accordingly, the diffuser 210 may guide the discharged air further to the forward direction when in the driven state R2 in which the diffuser 210 is rotated in the second direction B rather than when the diffuser 210 is in the stopped state S to block the airflow from flowing in the x direction.

In the state R2 in which the diffuser 210 is rotated in the second direction B, the plurality of vanes 214 are rotated in the opposite direction of the x direction, so they may further restrict the fluidity of air in the x direction rather than when the diffuser 210 is in the stopped state S.

Accordingly, when the diffuser 210 is in the state R2 of being rotated in the second direction B, the discharge air passing through the diffuser 210 may be formed into the third airflow f3 having higher directivity toward the forward direction than the first airflow f1 by having reduced fluidity in the y direction in proportion to the fluidity in the x direction and having increased fluidity in the z direction as compared to when the diffuser 210 is in the stopped state S.

When the indoor unit 1 of the air conditioner is provided to discharge the third airflow f3, the indoor unit 1 is able to force the air to flow to a far distance at a rapid flow velocity, thereby allowing air conditioning in a wide space and rapidly cooling or heating the space.

In other words, the indoor unit 1 of the air conditioner may be provided to create different types of airflows according to the respective states S, R1 and R2 of the diffuser 210. Especially, different types of airflows are created by simple rotation of the diffuser 210, and even when a different airflow is discharged, no flow loss of the airflow occurs, so the indoor unit 1 of the air conditioner may easily create different types of airflows without a loss of cooling or heating efficiency.

When the diffuser 210 is in the stopped state S, the first airflow f1 discharged through the diffuser 210 is a general forward airflow having certain directivity to the forward direction.

When the diffuser 210 is in the state R1 of being rotated in the first direction A, the second airflow f2 discharged through the diffuser 210 is a spreading airflow having fluidity spreading in all directions.

When the diffuser 210 is in the state R2 of being rotated in the second direction B, the third airflow f3 discharged through the diffuser 210 is a forward airflow with higher directivity to the forward direction than the first airflow f1.

According to the user's choice, the diffuser 210 may be driven in one of the stopped state S, the state R1 of being rotated in the first direction A, and the state R2 of being rotated in the second direction B, and accordingly, various types of airflows f1, f2 and f3 may be discharged through the indoor unit 1 of the air conditioner.

Although the three different airflows f1, f2 and f3 have thus far been taken as an example, more various airflows than the three airflows f1, f2 and f3 may be created because the plurality of diffusers 210, 220 and 230 are driven separately in the different states S, R1 and R2. For example, when the indoor unit 1 of the air conditioner is driven with the first diffuser 210 being in the stopped state S and the second and third diffusers 220 and 230 being in the state R1 of being rotated in the first direction A, an airflow having somewhat different fluidity from the second airflow f2 may be created.

However, for convenience of explanation, the three types of airflows f1, f2 and f2 have been described above as an example. It may be defined that the first airflow f1 is an airflow created when all of the plurality of diffusers 210, 220 and 230 are in the stopped state S, the second airflow f2 is an airflow created when all of the plurality of diffusers 210, 220 and 230 are in the state R1 of being rotated in the first direction A, and the third airflow f3 is an airflow created when all of the plurality of diffusers 210, 220 and 230 are in the state R2 of being rotated in the second direction B.

Other airflows than the first to third airflows f1, f2 and f3 will be described in connection with controlling the indoor unit 1 of the air conditioner. A method of controlling the indoor unit 1 of the air conditioner having the aforementioned structure will now be described in detail.

Figure 10:
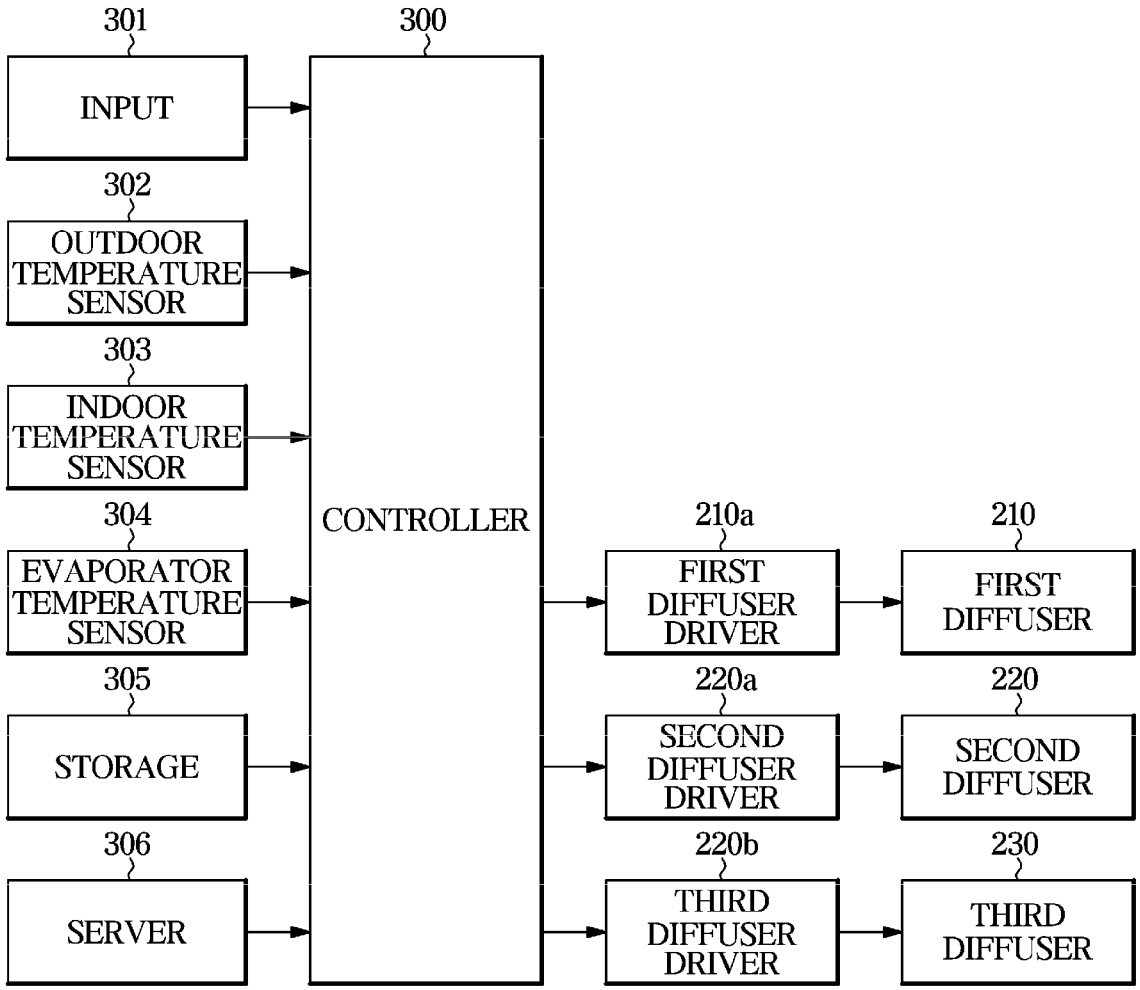
FIG. 10 illustrates a control system of the air conditioner, according to the first embodiment of the disclosure.
Figure 11:
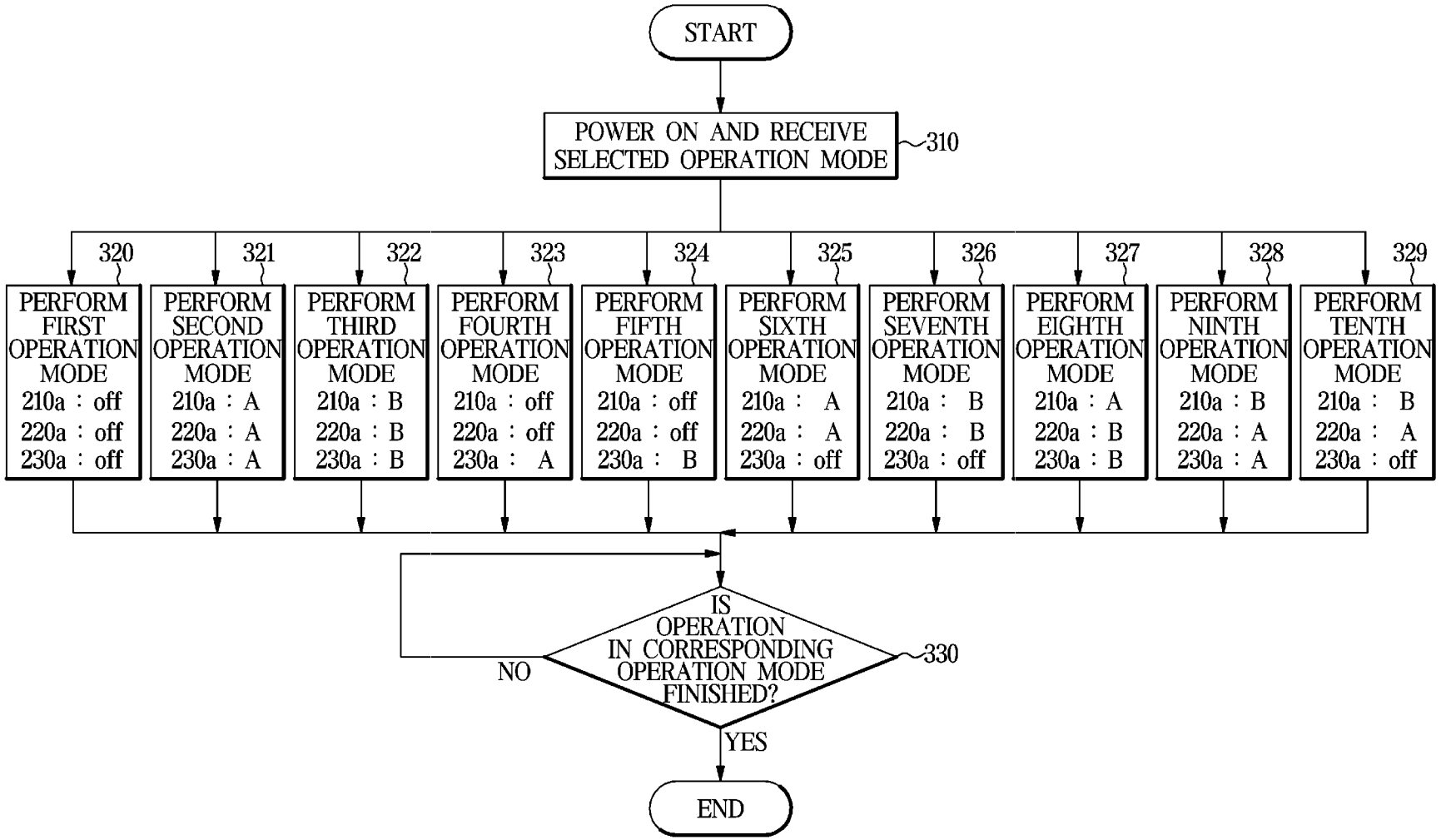
FIG. 11 is a flowchart illustrating a method of controlling the air conditioner, according to the first embodiment of the disclosure.

FIG. 10 illustrates a control system of the air conditioner, according to the first embodiment of the disclosure, and FIG. 11 is a flowchart illustrating a method of controlling the air conditioner, according to the first embodiment of the disclosure.

In an embodiment of the disclosure, the indoor unit 1 is equipped with the plurality of diffusers 210, 220 and 230 arranged in the vertical direction (of the indoor unit) for performing a target type of air conditioning by controlling the wind direction of air discharged through the plurality of diffusers 210, 220 and 230.

It is not limited thereto, but may control the wind volume or wind velocity of the air discharged through the plurality of blower fan units 110, 120 and 130, i.e., it may separately control the rpm of a blower fan in each of the blower fan units 110, 120 and 130 and control the wind volume and wind velocity of the air discharged from the indoor unit 1 of the air conditioner through on/off control. However, only the controlling of the wind direction by controlling the diffuser 200 according to an embodiment of the disclosure will now be described.

As shown in FIG. 10, the indoor unit 1 of the air conditioner may include a controller 300 for controlling general operation of the indoor unit 1 of the air conditioner.

An input end of the controller 300 may be electrically connected to an input 301, an outdoor temperature sensor 302, an indoor temperature sensor 303, an evaporator temperature sensor 304, etc., for communication.

Furthermore, it may be electrically connected to a storage 305 that stores operation history of the indoor unit 1 of the air conditioner and an external server 306 that stores the operation history of the indoor unit 1 of the air conditioner to store operation modes preferred by the user.

An output end of the controller 300 is electrically connected to first to third diffuser drivers 210*a*, 220*a* and 230*a* for communication. The first to third diffuser drivers 210*a*, 220*a* and 230*a* are for driving the first to third diffusers 210, 220 and 230, respectively, and are operated according to control commands from the controller 300 to control on/off and rotation speed of the diffuser driving motor 215 of each of the first to third diffusers 210, 220 and 230.

The controller 300 sends a control command to each of the first to third diffuser drivers 210*a*, 220*a* and 230*a* for controlling on/off and rotation speed of a corresponding one of the first to third diffusers 210, 220 and 230 to correspond to an operation mode selected by the user.

The control method in FIG. 11 is performed by the control system shown in FIG. 10. As shown in FIG. 11, when the user powers on the air conditioner and selects a desired operation mode, the controller 300 of the air conditioner receives information of the operation mode selected by the user, generates a control signal corresponding to the received operation mode, and delivers the control signal to each part of the air conditioner according to an embodiment of the disclosure to perform a target operation, in 310.

When any operation mode is not selected by the user, information about the most preferred operation mode based on information collected by the storage 305 or the external sever 306 is selectively sent to the controller 300 by considering outside temperature, inside temperature, etc., and based on this, the controller 300 may control the first to third diffuser drivers 210*a*, 220*a* and 230*a*.

When the operation mode selected by the user is a first operation mode, the controller 300 may send a control command to perform the first operation mode to each of the first to third diffuser drivers 210*a*, 220*a* and 230*a*. The first operation mode is an operation mode for the air conditioner to create the first airflow f1, and the controller 300 may control the first to third diffuser drivers 210*a*, 220*a* and 230*a* for the first to third diffusers 210, 220 and 230 to be in the stopped state S.

In the first operation mode, the first to third diffuser drivers 210*a*, 220*a* and 230*a* may control the diffuser driving motor 215 of each of the first to third diffusers 210, 220 and 230 to be not operated.

When the operation mode selected by the user is a second operation mode, the controller 300 may send a control command to perform the second operation mode to each of the first to third diffuser drivers 210*a*, 220*a* and 230*a*. The second operation mode is an operation mode for the air conditioner to create the second airflow f2, and the controller 300 may control the first to third diffuser drivers 210*a*, 220*a* and 230*a* in 321, for the first to third diffusers 210, 220 and 230 to be in the rotation state R1 in which the first to third diffusers 210, 220, and 230 are rotated in the first direction A, which is the rotation direction of the blower fan 112.

In the second operation mode, the first to third diffuser drivers 210*a*, 220*a* and 230*a* may control the diffuser driving motor 215 of each of the first to third diffusers 210, 220 and 230 so that the plurality of vanes 214 of each of the diffusers 210, 220 and 230 are rotated in the first direction A.

When the operation mode selected by the user is a third operation mode, the controller 300 may send a control command to perform the third operation mode to each of the first to third diffuser drivers 210*a*, 220*a* and 230*a*. The third operation mode is an operation mode for the air conditioner to create the third airflow f3, and the controller 300 may control the first to third diffuser drivers 210*a*, 220*a* and 230*a* in 322, for the first to third diffusers 210, 220 and 230 to be in the rotation state R2 in which the first to third diffusers 210, 220, and 230 are rotated in the second direction B, which is the opposite direction of the rotation direction of the blower fan 112.

In the third operation mode, the first to third diffuser drivers 210*a*, 220*a* and 230*a* may control the diffuser driving motor 215 of each of the first to third diffusers 210, 220 and 230 so that the plurality of vanes 214 of each of the diffusers 210, 220 and 230 are rotated in the second direction B.

When the operation mode selected by the user is a fourth operation mode, the controller 300 may send a control command to perform the fourth operation mode to each of the first to third diffuser drivers 210*a*, 220*a* and 230*a*. The fourth operation mode is an operation mode for the air conditioner to create a discharge airflow, which is similar to the first airflow f1, and the controller 300 may control the first to third diffuser drivers 210*a*, 220*a* and 230*a* in 323, so that one of the first to third diffusers 210, 220 and 230 is in the rotation state R1 of being rotated in the first direction A corresponding to the rotation direction of the blower fan 112 and the other two diffusers are in the stopped state S.

For example, as shown in FIG. 11, the controller 300 may control the first to third diffuser drivers 210*a*, 220*a* and 230*a* for the third diffuser 230 to be in the rotation state R1 of being rotated in the first direction A corresponding to the rotation direction of the blower fan 112 and for the first and second diffusers 210 and 220 to be in the stopped state S.

In other words, the controller 300 may control the first and second diffuser drivers 210*a* and 220*a* not to drive the driving motors 115 of the first and second diffusers 210 and 220 and control the third diffuser driver 230*a* for the driving motor 115 of the third diffuser 230 to rotate the third diffuser 230 in the first direction A.

The fourth operation mode may be provided to operate the indoor unit 1 of the air conditioner in a state in which also the first or second diffuser 210 or 220 is rotated in the first direction A and the other diffusers are stopped.

That is, the fourth operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the fourth operation mode has similar directivity to the first airflow f1 in that two diffusers discharge the airflow in the stopped state S, but is more spreadable than the first airflow f1 because one diffuser discharges a spreading airflow in the rotation state R1.

As the first to third diffusers 210, 220 and 230 are arranged to be spaced apart in the vertical direction, directivity of the airflow may vary depending on which one of the three diffusers 210, 220 and 230 is rotated in the first direction A.

That is, airflows discharged from the indoor unit 1 of the air conditioner may be classified into three sub-airflows in the fourth operation mode. The three sub-airflows may be classified as having different directivity due to a difference in discharge height of spreading airflows discharged from one of the first to third diffusers 210, 220 and 230, which is rotated in the first direction A.

When the operation mode selected by the user is a fifth operation mode, the controller 300 may send a control command to perform the fifth operation mode to each of the first to third diffuser drivers 210*a*, 220*a* and 230*a*. The fifth operation mode is an operation mode for the air conditioner to create a discharge airflow, which is similar to the first airflow f1, and the controller 300 may control the first to third diffuser drivers 210*a*, 220*a* and 230*a* in 324, so that one of the first to third diffusers 210, 220 and 230 is in the rotation state R2 of being rotated in the second direction B opposite to the rotation direction of the blower fan 112 and the other two diffusers are in the stopped state S.

For example, as shown in FIG. 11, the controller 300 may control the first to third diffuser drivers 210*a*, 220*a* and 230*a* for the third diffuser 230 to be in the rotation state R2 of being rotated in the second direction B corresponding →opposite to the rotation direction of the blower fan 112 and for the first and second diffusers 210 and 220 to be in the stopped state S.

In other words, the controller 300 may control the first and second diffuser drivers 210*a* and 220*a* not to drive the driving motors 115 of the first and second diffusers 210 and 220 and control the third diffuser driver 230*a* for the driving motor 115 of the third diffuser 230 to rotate the third diffuser 230 in the second direction B.

The fifth operation mode may be provided to operate the indoor unit 1 of the air conditioner in a state in which also the first or second diffuser 210 or 220 is rotated in the second direction B and the other diffusers are stopped.

That is, the fifth operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the fifth operation mode has similar directivity to the first airflow f1 in that two diffusers discharge the airflow in the stopped state S, but has higher directivity toward the forward direction than the first airflow f1 because one diffuser discharges the forward airflow in the rotation state R2.

That is, airflows discharged from the indoor unit 1 of the air conditioner may be classified into three sub-airflows in the fifth operation mode. The three sub-airflows may be classified as having different directivity due to a difference in discharge height of spreading airflows discharged from one of the first to third diffusers 210, 220 and 230, which is rotated in the second direction B.

When the operation mode selected by the user is a sixth operation mode, the controller 300 may send a control command to perform the sixth operation mode to each of the first to third diffuser drivers 210*a*, 220*a* and 230*a*. The sixth operation mode is an operation mode for the air conditioner to create a discharge airflow similar to the second airflow f2, and the controller 300 may control the first to third diffuser drivers 210*a*, 220*a* and 230*a* in 325, for one of the first to third diffusers 210, 220 and 230 to be in the stopped state S and for the other two diffusers to be in the rotation state R1 of being rotated in the first direction A corresponding to the rotation direction of the blower fan 112.

For example, as shown in FIG. 11, the controller 300 may control the first to third diffuser drivers 210*a*, 220*a* and 230*a* for the third diffuser 230 to be in the stopped state S and for the first and second diffusers 210 and 220 to be in the rotation state R1 of being rotated in the first direction A.

In other words, the controller 300 may control the first and second diffuser drivers 210*a* and 220*a* so that the driving motors 115 of the first and second diffusers 210 and 220 rotate the first and second diffusers 210 and 220 in the first direction A and control the third diffuser driver 230*a* for the driving motor 115 of the third diffuser 230 to be stopped.

The sixth operation mode may be provided for the indoor unit 1 of the air conditioner to be operated in a state in which also the first or second diffuser 210 or 220 is stopped and the other diffusers are rotated in the first direction A.

That is, the sixth operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the sixth operation mode has a similar directivity to the second airflow f2 in that two diffusers discharge the airflow in the state R1 of being rotated in the first direction A, but has higher directivity toward the forward direction than the second airflow f2 because one diffuser discharges an airflow in the stopped state S.

Furthermore, in the sixth operation mode, an airflow having higher directivity toward all directions than the airflow discharged in the fourth operation mode may be discharged.

Airflows discharged from the indoor unit 1 of the air conditioner may be classified into three sub-airflows in the sixth operation mode. The three sub-airflows may be classified as having different directivity caused by the discharge height of airflows discharged from two of the first to third diffusers 210, 220 and 230, which are rotated in the first direction A, and the discharge height of airflows discharged from the other diffuser which is stopped.

When the operation mode selected by the user is a seventh operation mode, the controller 300 may send a control command to perform the seventh operation mode to each of the first to third diffuser drivers 210*a*, 220*a* and 230*a*. The seventh operation mode is an operation mode for the air conditioner to create a discharge airflow similar to the third airflow f3, and the controller 300 may control the first to third diffuser drivers 210*a*, 220*a* and 230*a* in 326, for one of the first to third diffusers 210, 220 and 230 to be in the stopped state S and for the other two diffusers to be in the rotation state R2 of being rotated in the second direction B opposite to the rotation direction of the blower fan 112.

For example, as shown in FIG. 11, the controller 300 may control the first to third diffuser drivers 210*a*, 220*a* and 230*a* for the third diffuser 230 to be in the stopped state S and for the first and second diffusers 210 and 220 to be in the rotation state R2 of being rotated in the second direction B.

In other words, the controller 300 may control the first and second diffuser drivers 210*a* and 220*a* so that the driving motors 115 of the first and second diffusers 210 and 220 rotate the first and second diffusers 210 and 220 in the second direction B and control the third diffuser driver 230*a* for the driving motor 115 of the third diffuser 230 to be stopped.

The seventh operation mode may be provided for the indoor unit 1 of the air conditioner to be operated in a state in which also the first or second diffuser 210 or 220 is stopped and the other diffusers are rotated in the second direction B.

That is, the seventh operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the seventh operation mode has similar directivity to the third airflow f3 in that two diffusers discharge airflows in the rotation state R2 of being rotated in the second direction B, but has higher spreadability to all directions than the third airflow f3 because one diffuser discharges the airflow in the stopped state S.

Furthermore, in the seventh operation mode, an airflow having higher directivity toward the forward direction than the airflow discharged in the aforementioned fifth operation mode may be discharged.

Airflows discharged from the indoor unit 1 of the air conditioner may be classified into three sub-airflows in the seventh operation mode. The three sub-airflows may be classified as having different directivity caused by the discharge height of airflows discharged from two of the first to third diffusers 210, 220 and 230, which are rotated in the second direction B, and the discharge height of airflows discharged from the other diffuser which is stopped.

When the operation mode selected by the user is a eighth operation mode, the controller 300 may send a control command to perform the eighth operation mode to each of the first to third diffuser drivers 210*a*, 220*a* and 230*a*. The eighth operation mode is an operation mode for the air conditioner to create a discharge airflow similar to the third airflow f3, and the controller 300 may control the first to third diffuser drivers 210*a*, 220*a* and 230*a* in 327, for one of the first to third diffusers 210, 220 and 230 to be in the rotation state R1 of being rotated in the first direction A corresponding to the rotation direction of the blower fan 112 and for the other two diffusers to be in the rotation state R2 of being rotated in the second direction B opposite to the rotation direction of the blower fan 112.

For example, as shown in FIG. 11, the controller 300 may control the first to third diffuser drivers 210*a*, 220*a* and 230*a* for the first diffuser 210 to be in the rotation state R1 of being rotated in the first direction A and for the second and third diffusers 220 and 230 to be in the rotation state R2 of being rotated in the second direction B.

In other words, the controller 300 may control the second and third diffuser drivers 220*a* and 230*a* so that the driving motors 115 of the second and third diffusers 220 and 230 rotate the second and third diffusers 220 and 230 in the second direction B and control the first diffuser driver 210*a* for the driving motor 115 of the first diffuser 210 to rotate the first diffuser 210 in the first direction A.

The eighth operation mode may be provided for the indoor unit 1 of the air conditioner to be operated in a state in which also the second or third diffuser 220 or 230 is rotated in the first direction A and the other diffusers are rotated in the second direction B.

That is, the eighth operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the eighth operation mode has similar directivity to the third airflow f3 in that two diffusers discharge the airflow in the rotation state R2 of being rotated in the second direction B, but has higher spreadability to all directions than the third airflow f3 because one diffuser discharges the airflow in the state R1 of being rotated in the first direction A. Furthermore, it may discharge the airflow having higher spreadability to all directions than the airflow discharged in the seventh operation mode.

Airflows discharged from the indoor unit 1 of the air conditioner may be classified into three sub-airflows in the eighth operation mode. The three sub-airflows may be classified as having different directivity caused by the discharge height of airflows discharged from two of the first to third diffusers 210, 220 and 230, which are rotated in the second direction B and the discharge height of airflows discharged from the other diffuser rotated in the first direction A.

When the operation mode selected by the user is a ninth operation mode, the controller 300 may send a control command to perform the ninth operation mode to each of the first to third diffuser drivers 210*a*, 220*a* and 230*a*. The ninth operation mode is an operation mode for the air conditioner to create a discharge airflow similar to the second airflow f2, and the controller 300 may control the first to third diffuser drivers 210*a*, 220*a* and 230*a* in 328, for two of the first to third diffusers 210, 220 and 230 to be in the rotation state R1 of being rotated in the first direction A corresponding to the rotation direction of the blower fan 112 and for the other one diffuser to be in the rotation state R2 of being rotated in the second direction B opposite to the rotation direction of the blower fan 112.

For example, as shown in FIG. 11, the controller 300 may control the first to third diffuser drivers 210*a*, 220*a* and 230*a* for the first diffuser 210 to be in the rotation state R2 of being rotated in the second direction B and for the second and third diffusers 220 and 230 to be in the rotation state R1 of being rotated in the first direction A.

In other words, the controller 300 may control the second and third diffuser drivers 220*a* and 230*a* so that the driving motors 115 of the second and third diffusers 220 and 230 rotate the second and third diffusers 220 and 230 in the first direction A and control the first diffuser driver 210*a* for the driving motor 115 of the first diffuser 210 to rotate the first diffuser 210 in the second direction B.

The ninth operation mode may be provided for the indoor unit 1 of the air conditioner to be operated in a state in which also the second or third diffuser 220 or 230 is rotated in the second direction B and the other diffuser are rotated in the first direction A.

That is, the ninth operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the ninth operation mode has similar directivity to the second airflow f2 in that two diffusers discharge the airflow in the rotation state R1 of being rotated in the first direction A, but has higher directivity toward the forward direction than the second airflow f2 because one diffuser discharges the airflow in the state R2 of being rotated in the second direction B. Furthermore, it may discharge the airflow having higher directivity toward the forward direction than the airflow discharged in the sixth operation mode.

Airflows discharged from the indoor unit 1 of the air conditioner may be classified into three sub-airflows in the ninth operation mode. The three sub-airflows may be classified as having different directivity caused by the discharge height of airflows discharged from two of the first to third diffusers 210, 220 and 230, which are rotated in the first direction A, and the discharge height of airflows discharged from the other diffuser rotated in the second direction B.

When the operation mode selected by the user is a tenth operation mode, the controller 300 may send a control command to perform the tenth operation mode to each of the first to third diffuser drivers 210*a*, 220*a* and 230*a*. The tenth operation mode is an operation mode for the air conditioner to create a discharge airflow, which is a mixture of the first, second and third air flows f1, f2 and f3, and the controller 300 may control the first to third diffuser drivers 210*a*, 220*a* and 230*a* in 329, for one of the first to third diffusers 210, 220 and 230 to be in the rotation state R1 of being rotated in the first direction A corresponding to the rotation direction of the blower fan 112, for another diffuser to be in the rotation state R2 of being rotated in the second direction B opposite to the rotation direction of the blower fan 112, and for the other diffuser to be in the stopped state S.

For example, as shown in FIG. 11, the controller 300 may control the first to third diffuser drivers 210*a*, 220*a* and 230*a* for the first diffuser 210 to be in the rotation state R2 of being rotated in the second direction B, for the second diffuser 220 to be in the rotation state R1 of being rotated in the first direction A, and for the third diffuser 230 to be in the stopped state S.

In other words, the controller 300 may control the second diffuser driver 220*a* so that the driving motor 115 of the second diffuser 220 rotates the second diffuser 220 in the first direction A, control the first diffuser driver 210*a* so that the driving motor 115 of the first diffuser 210 rotates the first diffuser 210 in the second direction B, and control the third diffuser driver 230*a* so that the driving motor 115 of the third diffuser 230 is stopped.

The tenth operation mode may be provided for the indoor unit 1 of the air conditioner to be operated in a state in which the second or third diffuser 220 or 230 is rotated in the second direction B and another diffuser is rotated in the first direction A and the other diffuser is stopped.

That is, the tenth operation mode may be subdivided into six types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

A mixture of first, second and third airflows f1, f2 and f3 may be discharged in the tenth operation mode because one diffuser discharges an airflow in the rotation state R1 of being rotated in the first direction A, another diffuser discharges an airflow in the rotation state R2 of being rotated in the second direction B, and the other diffuser discharges an airflow in the stopped state S.

Airflows discharged from the indoor unit 1 of the air conditioner may be classified into six sub-airflows in the tenth operation mode. The six sub-airflows may be classified as having different directivity caused by the discharge height of airflows discharged from the respective diffusers as the first to third diffusers 210, 220 and 230 are each driven in one of the stopped state S, the rotation state R1 of being rotated in the first direction A and the rotation state R2 of being rotated in the second direction B.

In this way, operation in the selected operation mode is performed, and when the operation in the operation mode is finished, operation of the air conditioner is stopped, in 330.

The indoor unit 1 of the air conditioner according to a second embodiment of the disclosure will now be described. Configurations other than the operation modes of the first to third diffuser drivers 210*a*, 220*a*, and 230*a* of the indoor unit 1 of the air conditioner are the same as in the indoor unit 1 of the air conditioner according to the first embodiment of the disclosure, so overlapping descriptions will not be repeated.

Figure 12:
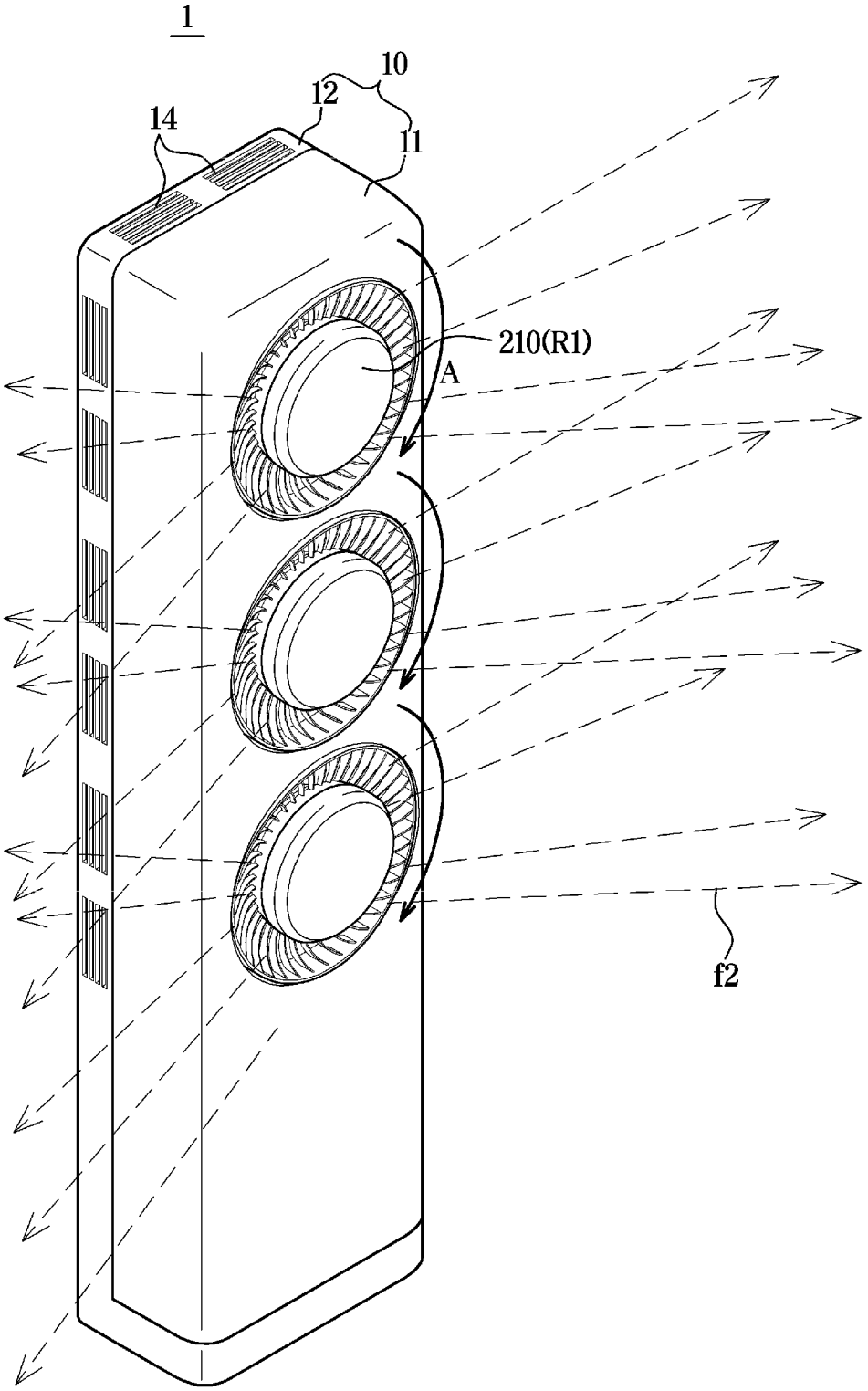
FIG. 12 schematically illustrates discharge airflows released from an outlet according to an operation mode of an indoor unit of an air conditioner, according to a second embodiment of the disclosure.
Figure 13:
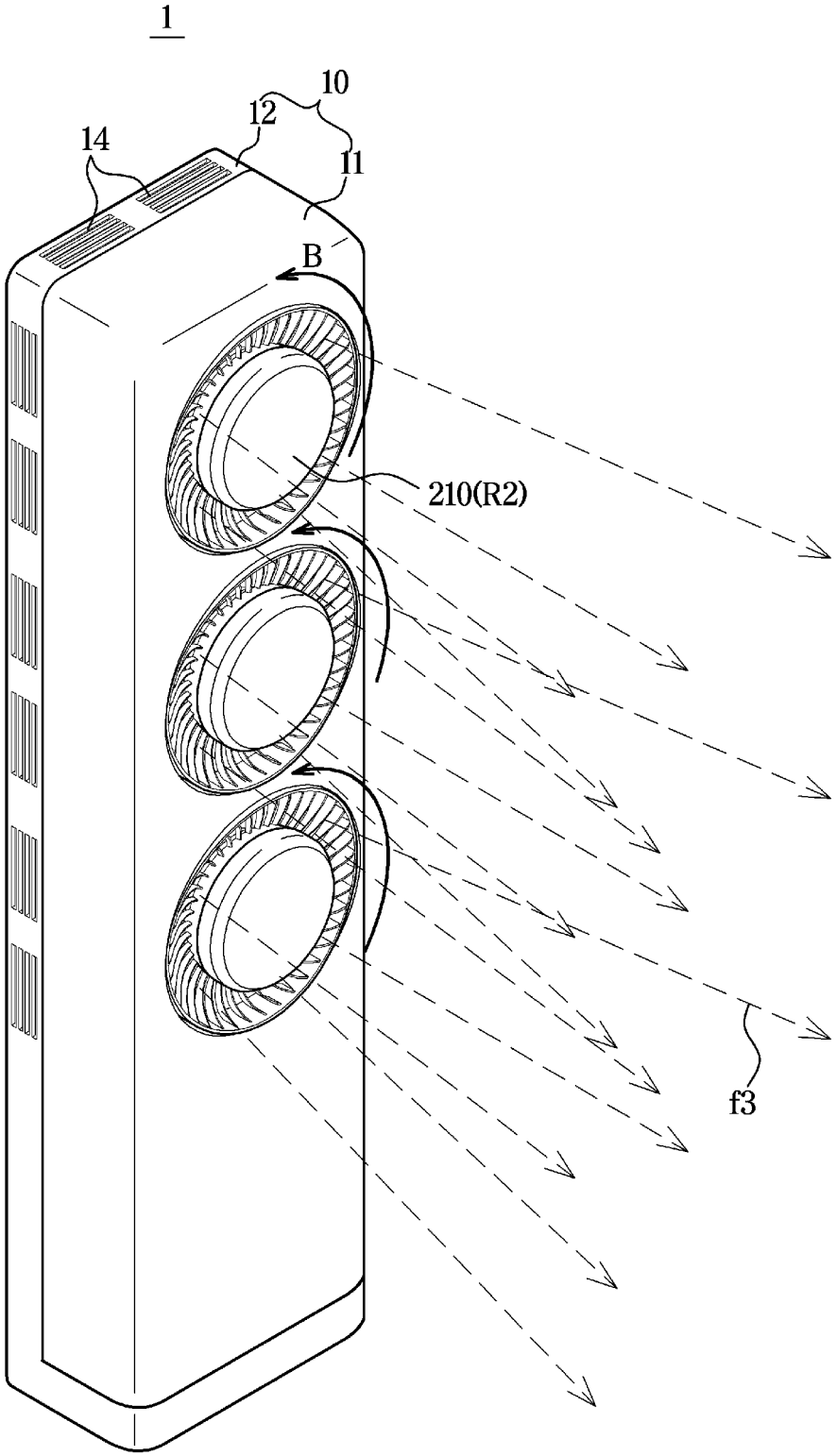
FIG. 13 schematically illustrates discharge airflows released from an outlet according to an operation mode of the indoor unit of the air conditioner, according to the second embodiment of the disclosure.
Figure 14:
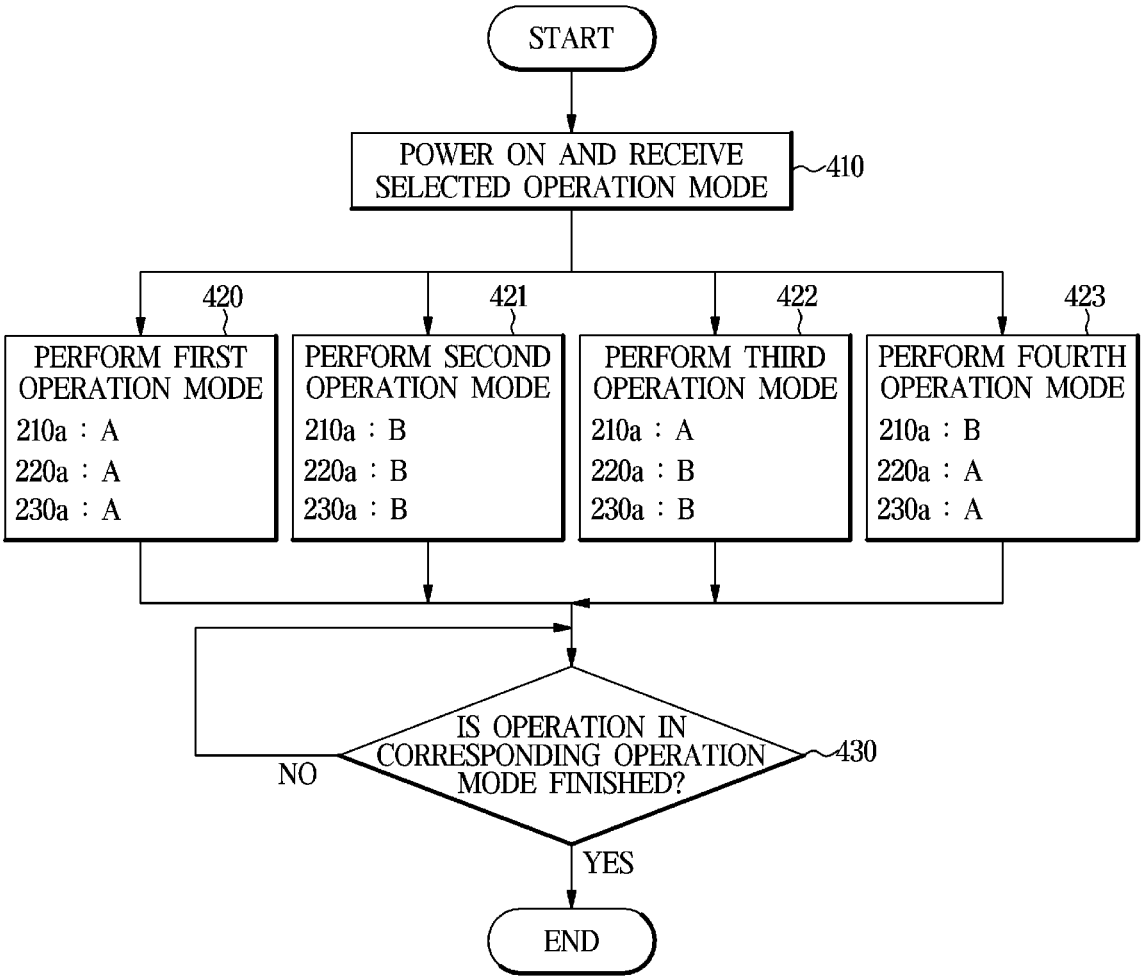
FIG. 14 is a flowchart illustrating a method of controlling the air conditioner, according to the second embodiment of the disclosure.

FIG. 12 schematically illustrates discharge airflows released from an outlet according to an operation mode of an indoor unit of an air conditioner, according to a second embodiment of the disclosure, FIG. 13 schematically illustrates discharge airflows released from the outlet according to an operation mode of the indoor unit of the air conditioner, according to the second embodiment of the disclosure, and FIG. 14 is a flowchart illustrating a method of controlling the air conditioner, according to the second embodiment of the disclosure.

Specifically, the indoor unit 1 of the air conditioner according to the second embodiment of the disclosure may control directivity of the discharge airflow so that the air passing through the diffuser 210 becomes the forward airflow or the spreading airflow by rotation of the diffuser 210.

The diffuser 210 may be provided to rotate around the rotation axis C of the blower fan 112 in the first direction A, which is the rotation direction of the blower fan 112. Furthermore, the diffuser 210 may be provided to rotate around the rotation axis C of the blower fan 112 in the opposite direction B of the first direction A.

while the indoor unit 1 of the air conditioner according to the first embodiment of the disclosure is provided with the diffuser driven in one of the stopped state S, the state R1 of being rotated in the first direction A and the state R2 of being rotated in the second direction B, the indoor unit 1 of the air conditioner according to the second embodiment of the disclosure may be provided with the diffuser driven in one of the state R1 of being rotated in the first direction A and the state R2 of being rotated in the second direction B.

As shown in FIG. 12, when the diffuser 210 is driven in a rotation state R1 of being rotated in the first direction A, the air passing through the diffuser 210 may be formed into the second airflow f2 having little directivity toward the forward direction but high spreadability. The second airflow f2 may correspond to the spreading airflow.

The diffuser 210 may be provided to rotate in the first direction A, which is the rotation direction of the blower fan 112. As described above, the diffuser 210 may be rotated around the same axis as the rotation axis C of the blower fan 112.

Accordingly, the plurality of vanes 214 may also be provided to rotate in the first direction A. As the plurality of vanes 214 are rotated in the first direction A, they may increase fluidity of the air in the x direction. When the diffuser 210 is rotated in the first direction A, the air fluidity in the x direction increases, so the second airflow f2 spreading in all directions may be formed. As the diffuser 210 is rotated in the first direction A, rotationality in the first direction A of the air passing the diffuser 210 is strengthened, thereby increasing the fluidity in the x direction.

On the contrary, as shown in FIG. 13, the diffuser 210 may be rotated in the second direction B, which is opposite to the rotation direction of the blower fan 112.

When the diffuser 210 is driven in a state R2 of being rotated in the second direction B, the air may be formed into the third airflow f3 having higher directivity toward the forward direction than the second airflow f2 when passing through the diffuser 210.

The plurality of vanes 214 may guide air passing through the diffuser 210 to an opposite direction of the x direction while being rotated in an opposite direction B of the rotation direction of the blower fan 112. Accordingly, the plurality of vanes 214 may cancel out the fluidity of air discharged from the diffuser 210 in the x and y directions and change the fluidity in the x and y directions to the z direction. In other words, the directivity of the discharge airflow to the x direction may be extinguished, and the discharge airflow may be guided to the forward airflow by changing moving directions of the discharged air spreading in all directions to the forward direction.

In other words, the indoor unit 1 of the air conditioner may be provided to create different types of airflows according to the respective states R1 and R2 of the diffuser 210. Especially, different types of airflows are created by simple rotation of the diffuser 210, and even when a different airflow is discharged, no flow loss of the airflow occurs, so the indoor unit 1 of the air conditioner may easily create different types of airflows without a loss of cooling or heating efficiency.

When the diffuser 210 is in the state R1 of being rotated in the first direction A, the second airflow f2 discharged through the diffuser 210 is a spreading airflow having fluidity spreading in all directions.

When the diffuser 210 is in the state R2 of being rotated in the second direction B, the third airflow f3 discharged through the diffuser 210 is a forward airflow with higher directivity to the forward direction than the second airflow f2.

According to the user's choice, the diffuser 210 may be driven in one of the state R1 of being rotated in the first direction A and the state R2 of being rotated in the second direction B, and accordingly, various types of airflows f2 and f3 may be discharged through the indoor unit 1 of the air conditioner.

Although the two different airflows f2 and f3 have been described as an example, more various airflows than the two airflows f2 and f3 may be formed because the plurality of diffusers 210, 220 and 230 are driven independently in the different states R1 and R2. For example, when the indoor unit 1 of the air conditioner is driven with the first diffuser 210 being in the state R2 of being rotated in the second direction B and the second and third diffusers 220 and 230 being in the state R1 of being rotated in the first direction A, an air flow having somewhat different fluidity from the second airflow f2 may be created.

However, for convenience of explanation, the two types of airflows f2 and f3 have been described as an example. It may be defined that the second airflow f2 is an airflow created when all of the plurality of diffusers 210, 220 and 230 are in the state R1 of being rotated in the first direction A, and the third airflow f3 is an airflow created when all of the plurality of diffusers 210, 220 and 230 are in the state R2 of being rotated in the second direction B.

In other words, unlike the diffuser 210 in the first embodiment of the disclosure, the diffuser 210 in the second embodiment of the disclosure may be provided to rotate in the first direction A or the second direction B, and may not be controlled by the diffuser driver 210*a* to be driven in the stopped state S.

Accordingly, the indoor unit 1 of the air conditioner according to the second embodiment of the disclosure may be provided to select the airflow discharged from the diffuser 210 to be the spreading airflow f2 or the forward airflow f3 by controlling the diffuser 210 to be selectively in one of the two states R1 and R2 instead of the three states S, R1 and R2.

Other airflows than the second and third airflows f2 and f3 will be described in connection with controlling the indoor unit 1 of the air conditioner. A method of controlling the indoor unit 1 of the air conditioner having the aforementioned structure will now be described in detail.

As shown in FIG. 14, when the user powers on the air conditioner and selects a desired operation mode, the controller 300 of the air conditioner receives information of the operation mode selected by the user, generates a control signal corresponding to the received operation mode, and delivers the control signal to each part of the air conditioner according to this embodiment of the disclosure to perform a target operation, in 410.

When any operation mode is not selected by the user, information about the most preferred operation mode based on information collected by the storage 305 or the external sever 306 is selectively sent to the controller 300 by considering outside temperature, inside temperature, etc., and based on this, the controller 300 may control the first to third diffuser drivers 210*a*, 220*a* and 230*a*.

When the operation mode selected by the user is a first operation mode, the controller 300 may send a control command to perform the first operation mode to each of the first to third diffuser drivers 210*a*, 220*a* and 230*a*. The first operation mode is an operation mode for the air conditioner to create the second airflow f2, and the controller 300 may control the first to third diffuser drivers 210*a*, 220*a* and 230*a* in 420, for the first to third diffusers 210, 220 and 230 to be in the rotation state R1 of being rotated in the first direction A, which is the rotation direction of the blower fan 112.

In the first operation mode, the first to third diffuser drivers 210*a*, 220*a* and 230*a* may control the diffuser driving motor 215 of each of the first to third diffusers 210, 220 and 230 so that the plurality of vanes 214 of each of the diffusers 210, 220 and 230 are rotated in the first direction A.

When the operation mode selected by the user is a second operation mode, the controller 300 may send a control command to perform the second operation mode to each of the first to third diffuser drivers 210*a*, 220*a* and 230*a*. The second operation mode is an operation mode for the air conditioner to create the third airflow f3, and the controller 300 may control the first to third diffuser drivers 210*a*, 220*a* and 230*a* in 421, for the first to third diffusers 210, 220 and 230 to be in the rotation state R2 of being rotated in the second direction B, which is the opposite direction of the rotation direction of the blower fan 112.

In the second operation mode, the first to third diffuser drivers 210*a*, 220*a* and 230*a* may control the diffuser driving motor 215 of each of the first to third diffusers 210, 220 and 230 so that the plurality of vanes 214 of each of the diffusers 210, 220 and 230 are rotated in the second direction B.

When the operation mode selected by the user is a third operation mode, the controller 300 may send a control command to perform the third operation mode to each of the first to third diffuser drivers 210*a*, 220*a* and 230*a*. The third operation mode is an operation mode for the air conditioner to create a discharge airflow similar to the third airflow f3, and the controller 300 may control the first to third diffuser drivers 210*a*, 220*a* and 230*a* in 422, for one of the first to third diffusers 210, 220 and 230 to be in the rotation state R1 of being rotated in the first direction A corresponding to the rotation direction of the blower fan 112 and for the other two diffusers to be in the rotation state R2 of being rotated in the second direction B opposite to the rotation direction of the blower fan 112.

For example, as shown in FIG. 14, the controller 300 may control the first to third diffuser drivers 210*a*, 220*a* and 230*a* for the first diffuser 210 to be in the rotation state R1 of being rotated in the first direction A and for the second and third diffusers 220 and 230 to be in the rotation state R2 of being rotated in the second direction B.

In other words, the controller 300 may control the second and third diffuser drivers 220*a* and 230*a* so that the driving motors 115 of the second and third diffusers 220 and 230 rotate the second and third diffusers 220 and 230 in the second direction B and control the first diffuser driver 210*a* for the driving motor 115 of the first diffuser 210 to rotate the first diffuser 210 in the first direction A.

The third operation mode may be provided for the indoor unit 1 of the air conditioner to be operated in a state in which also the second or third diffuser 220 or 230 is rotated in the first direction A and the other two diffusers are rotated in the second direction B.

That is, the third operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the third operation mode has similar directivity to the third airflow f3 in that two diffusers discharge the airflow in the rotation state R2 of being rotated in the second direction B, but has higher spreadability to all directions than the third airflow f3 because one diffuser discharges the airflow in the state R1 of being rotated in the first direction A.

Airflows discharged from the indoor unit 1 of the air conditioner may be classified into three sub-airflows in the third operation mode. The three sub-airflows may be classified as having different directivity caused by the discharge height of airflows discharged from two of the first to third diffusers 210, 220 and 230, which are rotated in the second direction B and the discharge height of airflows discharged from the other diffuser rotated in the first direction A.

When the operation mode selected by the user is a fourth operation mode, the controller 300 may send a control command to perform the fourth operation mode to each of the first to third diffuser drivers 210*a*, 220*a* and 230*a*. The fourth operation mode is an operation mode for the air conditioner to create a discharge airflow similar to the second airflow f2, and the controller 300 may control the first to third diffuser drivers 210*a*, 220*a* and 230*a* in 423, for two of the first to third diffusers 210, 220 and 230 to be in the rotation state R1 of being rotated in the first direction A corresponding to the rotation direction of the blower fan 112 and for the other one diffuser to be in the rotation state R2 of being rotated in the second direction B opposite to the rotation direction of the blower fan 112.

For example, as shown in FIG. 14, the controller 300 may control the first to third diffuser drivers 210*a*, 220*a* and 230*a* for the first diffuser 210 to be in the rotation state R2 of being rotated in the second direction B and for the second and third diffusers 210 and 220 to be in the rotation state R1 of being rotated in the first direction A.

In other words, the controller 300 may control the second and third diffuser drivers 220*a* and 230*a* so that the driving motors 115 of the second and third diffusers 220 and 230 rotate the second and third diffusers 220 and 230 in the first direction A and control the first diffuser driver 210*a* for the driving motor 115 of the first diffuser 210 to rotate the first diffuser 210 in the second direction B.

The fourth operation mode may be provided for the indoor unit 1 of the air conditioner to be operated in a state in which also the second diffuser 220 or third 230 is rotated in the second direction B and the other two diffusers are rotated in the first direction A.

That is, the fourth operation mode may be subdivided into three types of sub-operation modes. In this case, based on information entered by the user or information sent from each of the sensors 302, 303 and 304, the storage 305, or the server 306, the controller 300 may control the first to third diffuser drivers 210*a*, 220*a*, and 230*a*.

Airflow discharged in the fourth operation mode has similar directivity to the second airflow f2 in that two diffusers discharge the airflow in the rotation state R1 of being rotated in the first direction A, but has higher directivity toward the forward direction than the second airflow f2 because one diffuser discharges the airflow in the state R2 of being rotated in the second direction B.

Airflows discharged from the indoor unit 1 of the air conditioner may be classified into three sub-airflows in the fourth operation mode. The three sub-airflows may be classified as having different directivity caused by the discharge height of airflows discharged from two of the first to third diffusers 210, 220 and 230, which are rotated in the first direction A, and the discharge height of airflows discharged from the other diffuser rotated in the second direction B.

In this way, operation in the selected operation mode is performed, and when the operation in the operation mode is finished, operation of the air conditioner is stopped, in 430.

According to the first embodiment of the disclosure, the diffuser 200 is driven in three states S, R1 and R2, thereby controlling the nature of airflows discharged from the indoor unit 1 of the air conditioner. On the contrary, in the second embodiment of the disclosure, the diffuser 200 is driven in two states R1 and R2 to control the nature of airflows discharged from the indoor unit 1 of the air conditioner, in which case the controller 300 may control the status of each of the diffusers 210, 220 and 230 separately so that the indoor unit 1 of the air conditioner may discharge multiple types of airflows having various directivity even though the diffuser 200 is driven in the two states R1 and R2.

As described above, the indoor unit 1 of the air conditioner according to the second embodiment of the disclosure may be provided to select the airflow discharged from the diffuser 210 to be the spreading airflow f2 or the forward airflow f3 by controlling the diffuser 210 to be selectively in one of the two states R1 and R2.

It is not, however, limited thereto, and the diffuser 210 of the indoor unit 1 of the air conditioner may be controlled to be selectively in one of the stopped state S and the state R1 of being rotated in the first direction A, so that the airflow discharged from the diffuser 210 may be selected to be the first airflow f1 or the second airflow f2.

Alternatively, the diffuser 210 of the indoor unit 1 of the air conditioner may be controlled to be selectively in one of the stopped state S and the state R2 of being rotated in the second direction B, so that the airflow discharged from the diffuser 210 may be selected to be the first airflow f1 or the third airflow f3.

The indoor unit 1 of the air conditioner according to a third embodiment of the disclosure will now be described. Components other than the diffuser 210 of the indoor unit 1 of the air conditioner are the same as in the indoor unit 1 of the air conditioner according to the first embodiment of the disclosure, so overlapping descriptions will not be repeated.

Figure 15:
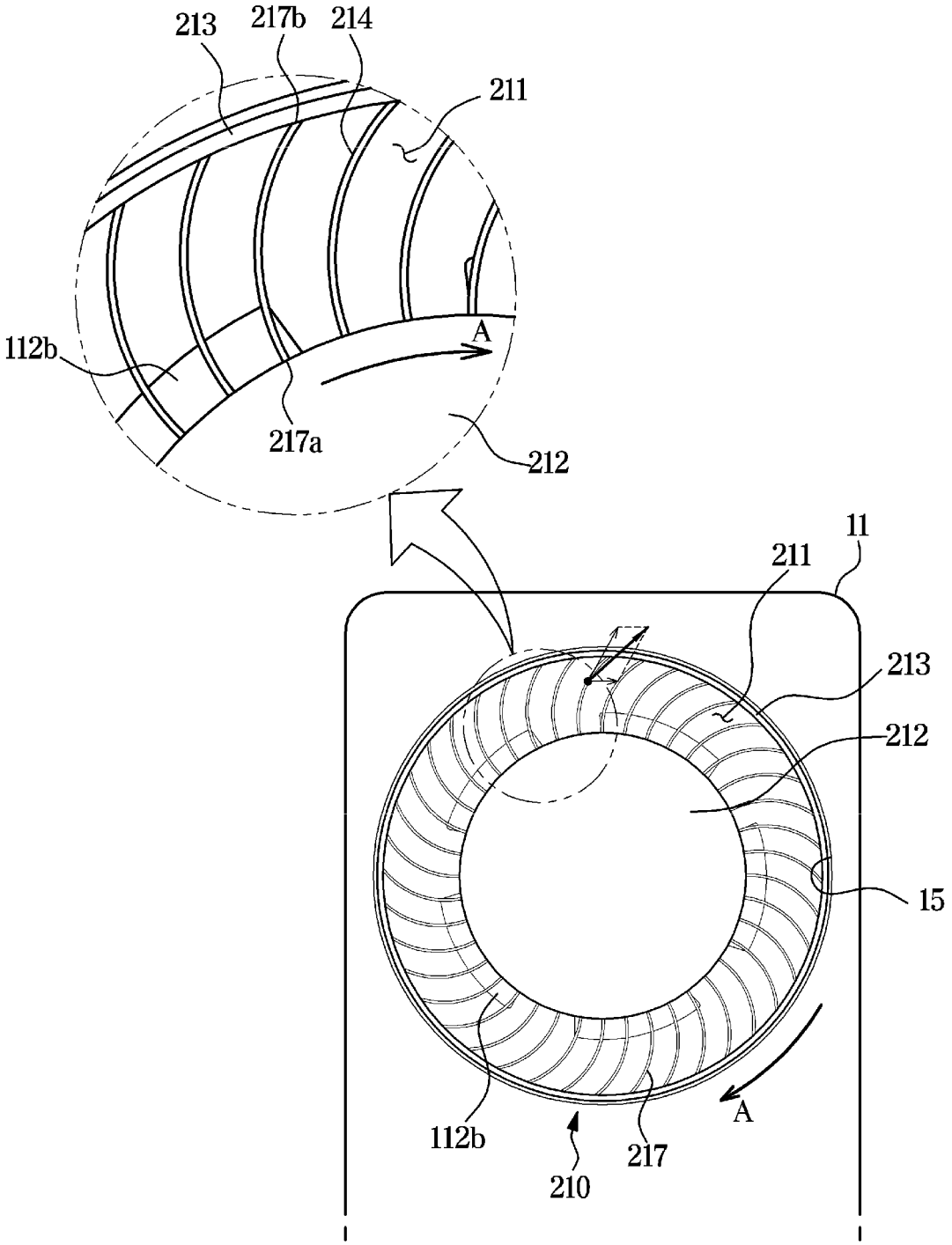
FIG. 15 illustrates a diffuser of an indoor unit of an air conditioner, according to a third embodiment of the disclosure.

FIG. 15 illustrates a diffuser of an indoor unit of an air conditioner, according to a third embodiment of the disclosure.

As described above, the diffuser 200 of the indoor unit 1 of the air conditioner may include the first to third diffusers 210, 220 and 230, each of which has the same structure, so the first diffuser 210 will now be described as a representative. In other words, although only the first diffuser 210 is shown in FIG. 15, the second and third diffusers 220 and 230 may also be formed to be identical to the first diffuser 210 as shown in FIG. 15.

As shown in FIG. 15, the diffuser 210 may include a plurality of vanes 217 arranged between the center part 212 and the ring 213. The diffuser 210 may be arranged in front of the blower fan 112 for the air that has passed the blower fan 112 to be discharged forward from the front panel 11 through the outlet 211. In this case, the air discharged through the plurality of vanes 217 arranged on the outlet 211 may be guided. The wind direction and wind volume of the air discharged through the outlet 211 may be controlled by adjusting the number, the shape, a placement angle or the like of the plurality of vanes 217.

The plurality of vanes 217 are formed in the shape of spiral wings from the center part 214 to the ring 213, thereby guiding the discharged air blown out from the blower fan 112 to be discharged to the outside.

The plurality of vanes 217 are formed to run from the center part 212 to the ring 213 in the radial direction of the ring 213. Specifically, one ends 217*a* of the plurality of vanes 217 may be arranged to be adjacent to the center part 212 and the other ends 217*b* of the plurality of vanes 217 may be arranged to be adjacent to the ring 213.

The plurality of vanes 217 may be curved toward the first direction A, which is the rotation direction of the blower fan 112, in the radial direction of the ring 213.

When the blower fan 112 is rotated clockwise when viewed from the front of the diffuser 210, the plurality of vanes 217 are formed to extend from the center part 212 to the ring 213 to be curved clockwise, and when the blower fan 112 is rotated counterclockwise, the plurality of vanes 217 are formed to extend from the center part 214 to the ring 214 to be curved counterclockwise.

Specifically, each of the plurality of vanes 217 includes the one end 217*a* arranged to be adjacent to the center part 217 and the other end 217*b* adjoining the ring 213, and may be formed to extend from the one end 217*a* to the other end 217*b* to be curved toward the first direction A, which is the rotation direction of the blower fan 112. That is, each vane 217 may extend to be curved in the rotation direction of the blower fan 112.

Accordingly, when the diffuser 210 is stopped, the discharge air blown out from the blower fan 112 is guided by the plurality of vanes 217 to be formed into the spreading airflow rather than the forward airflow.

Assuming that a direction toward the front of the diffuser 210 is z direction, a radial direction from the center part 214 of the diffuser 210 is y direction, and a direction corresponding to the rotation direction A of the blower fan 112 in a tangential direction of the circular shape of the diffuser 210 is x direction, the plurality of vanes 217 are unable to restrict fluidity of the discharge airflow in the x and y directions, so the spreading airflow is further developed and proceeds in all directions from the front of the air conditioner.

The air may be discharged by the blower fan 112 in the z direction. However, as the blower fan 112 is rotated in the first direction A, the air passing the blower fan 112 may have strong fluidity in the x direction corresponding to the rotation direction A of the blower fan 112, and accordingly have an increase in fluidity even in the y direction.

In other words, air fluidity increases in the direction in which the blower fan 112 is rotated, so that the air blown from the blower fan 112 may have a growing fluidity not only in the z direction, which is a direction in which the air is discharged, but also in the x direction corresponding to the rotation direction A of the blower fan 112 and the y direction engaged with the x direction, thereby being formed into the spreading airflows.

In this case, as the plurality of vanes 217 are curved in the rotation direction A of the blower fan 112, they may additionally guide the airflow in the x direction, and accordingly, fluidity in the x direction and proportionally in the y direction rises, which strengthens power of fluidity in all directions, thereby creating the spreading airflow.

The diffuser 210 in the third embodiment of the disclosure may be provided to form the discharged air into the spreading airflow, while the plurality of vanes 214 of the indoor unit 1 of the air conditioner in the first embodiment of the disclosure are provided to guide air in the x and y directions among the discharge air blown out from the blower fan 112 to the z direction so that the air passing through the diffuser 210 is formed into the forward airflow.

Specifically, spreading airflows are formed when the diffuser 210 is in the stopped state S, and spreading airflows having higher spreadability than the airflows discharged when the diffuser 210 is in the stopped state S may be discharged when the diffuser 210 is in the state R1 of being rotated in the first direction A.

On the other hand, when the diffuser 210 is in the state R2 of being rotated in the second direction B, some air discharged from the diffuser 210 in the x and y directions is guided to the z direction as the plurality of vanes 217 are rotated in the second direction B, and thus, the forward airflow may be discharged.

When the airflow discharged from the diffuser 210 in the third embodiment of the disclosure is compared with the airflow discharged from the diffuser 210 in the first embodiment of the disclosure, the discharge airflow discharged when the diffuser 210 is in the stopped state S in the third embodiment may have higher spreadability than the discharge airflow f1 discharged when the diffuser 210 is in the stopped state S in the first embodiment.

The discharge airflow discharged when the diffuser 210 is in the state R1 of being rotated in the first direction A in the third embodiment may have higher spreadibility than the discharge airflow f2 discharged when the diffuser 210 is in the state R1 of being rotated in the first direction A in the first embodiment.

The discharge airflow discharged when the diffuser 210 is in the state R2 of being rotated in the second direction B in the third embodiment may have higher spreadibility than the discharge airflow f2 discharged when the diffuser 210 is in the state R2 of being rotated in the second direction B in the first embodiment. The airflow discharged when the diffuser 210 is in the state R2 of being rotated in the second direction B in the first and third embodiments is formed as the forward airflow, in which case, however, the forward airflow in the third embodiment has less directivity to the forward direction than the forward airflow in the first embodiment.

Controlling the rotation state S, R1 or R2 of each of the diffusers 210, 220 and 230 in the third embodiment of the disclosure may be the same as in one of the first embodiment or the second embodiment of the disclosure.

Specifically, each of the diffusers 210, 220 and 230 is provided to be driven in one of the stopped state S, the state R1 of being rotated in the first direction A, and the state R2 of being rotated in the second direction B, or each of the diffusers 210, 220 and 230 is provided to be driven in one of the state R1 of being rotated in the first direction A, and the state R2 of being rotated in the second direction B.

The indoor unit 1 of the air conditioner according to a fourth embodiment of the disclosure will now be described.

Components other than the diffuser 210 of the indoor unit 1 of the air conditioner are the same as in the indoor unit 1 of the air conditioner according to the first embodiment of the disclosure, so overlapping descriptions will not be repeated.

Figure 16:
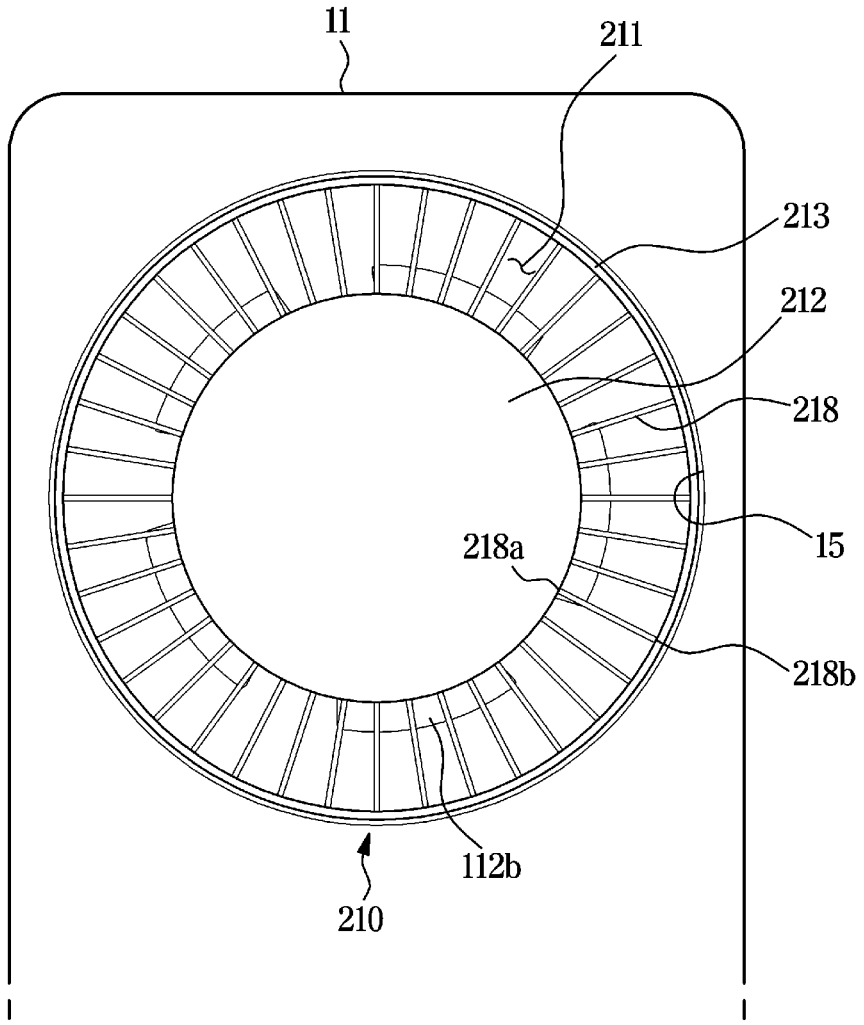
FIG. 16 illustrates a diffuser of an indoor unit of an air conditioner, according to a fourth embodiment of the disclosure.

FIG. 16 illustrates a diffuser of an indoor unit of an air conditioner, according to the fourth embodiment of the disclosure.

As described above, the diffuser 200 of the indoor unit 1 of the air conditioner may include the first to third diffusers 210, 220 and 230, each of which has the same structure, so the first diffuser 210 will now be described as a representative. In other words, although only the first diffuser 210 is shown in FIG. 16, the second and third diffusers 220 and 230 may also be formed to be identical to the first diffuser 210 as shown in FIG. 16.

As shown in FIG. 16, the diffuser 210 may include a plurality of vanes 218 arranged between the center part 212 and the ring 213. The diffuser 210 may be arranged in front of the blower fan 112 for the air that has passed the blower fan 112 to be discharged forward from the front panel 11 through the outlet 211. In this case, the air discharged through the plurality of vanes 218 arranged on the outlet 211 may be guided. The wind direction and wind volume of the air discharged through the outlet 211 may be controlled by adjusting the number, the shape, a placement angle or the like of the plurality of vanes 218.

The plurality of vanes 218 are formed to run from the center part 212 to the ring 213 in the radial direction of the ring 213. Specifically, one ends 218*a* of the plurality of vanes 218 may be arranged to be adjacent to the center part 212 and the other ends 218*b* of the plurality of vanes 218 may be arranged to be adjacent to the ring 213.

The plurality of vanes 218 may extend straight in the radial direction of the ring 213. In the first and third embodiments of the disclosure, the plurality of vanes 214 and 217 are provided to be curved in the first direction A or the second direction B, but the plurality of vanes 218 in the fourth embodiment of the disclosure may extend straight.

Accordingly, the airflow discharged through the diffuser 210 in the fourth embodiment may have higher spreadability than the airflow discharged through the diffuser 210 in the first embodiment and higher directivity to the forward direction than the airflow discharged through the diffuser 210 in the third embodiment When the airflow discharged from the diffuser 210 in the fourth embodiments of the disclosure is compared with the airflow discharged from the diffuser 210 in the first and third embodiments of the disclosure, the discharge airflow discharged when the diffuser 210 is in the stopped state S in the fourth embodiment may have higher spreadability than the discharge airflow f1 discharged when the diffuser 210 is in the stopped state S in the first embodiment, and may have higher directivity to the forward direction than the discharge airflow discharged when the diffuser 2210 is in the stopped state S in the third embodiment.

The discharge airflow discharged when the diffuser 210 is in the state R1 of being rotated in the first direction A in the fourth embodiment may have higher spreadability than the discharge airflow f2 discharged when the diffuser 210 is in the state R1 of being rotated in the first direction A in the first embodiment, and may have higher directivity to the forward direction than the discharge airflow discharged when the diffuser 210 is in the state R1 of being rotated in the first direction A in the third embodiment.

The discharge airflow discharged when the diffuser 210 is in the state R2 of being rotated in the second direction B in the fourth embodiment may have higher spreadability than the discharge airflow f3 discharged when the diffuser 210 is in the state R2 of being rotated in the second direction B in the first embodiment, and may have higher directivity to the forward direction than the discharge airflow discharged when the diffuser 210 is in the state R2 of being rotated in the second direction B in the third embodiment.

In other words, the discharge airflow discharged from the diffuser 210 in the fourth embodiment may have higher spreadability than the discharge airflow discharged from the diffuser 210 in the first embodiment and may have higher directivity to the forward direction than the discharge airflow discharged from the diffuser 210 in the third embodiment.

Controlling the rotation state S, R1 or R2 of each of the diffusers 210, 220 and 230 in the fourth embodiment of the disclosure may be the same as in one of the first embodiment or the second embodiment of the disclosure.

Specifically, each of the diffusers 210, 220 and 230 may be provided to be driven in one of the stopped state S, the state R1 of being rotated in the first direction A, and the state R2 of being rotated in the second direction B, or each of the diffusers 210, 220 and 230 may be provided to be driven in one of the state R1 of being rotated in the first direction A, and the state R2 of being rotated in the second direction B.

The indoor unit 1 of the air conditioner according to a fifth embodiment of the disclosure will now be described. Components other than a diffuser 400 of the indoor unit 1 of the air conditioner are the same as in the indoor unit 1 of the air conditioner according to the first embodiment of the disclosure, so overlapping descriptions will not be repeated.

Figure 17:
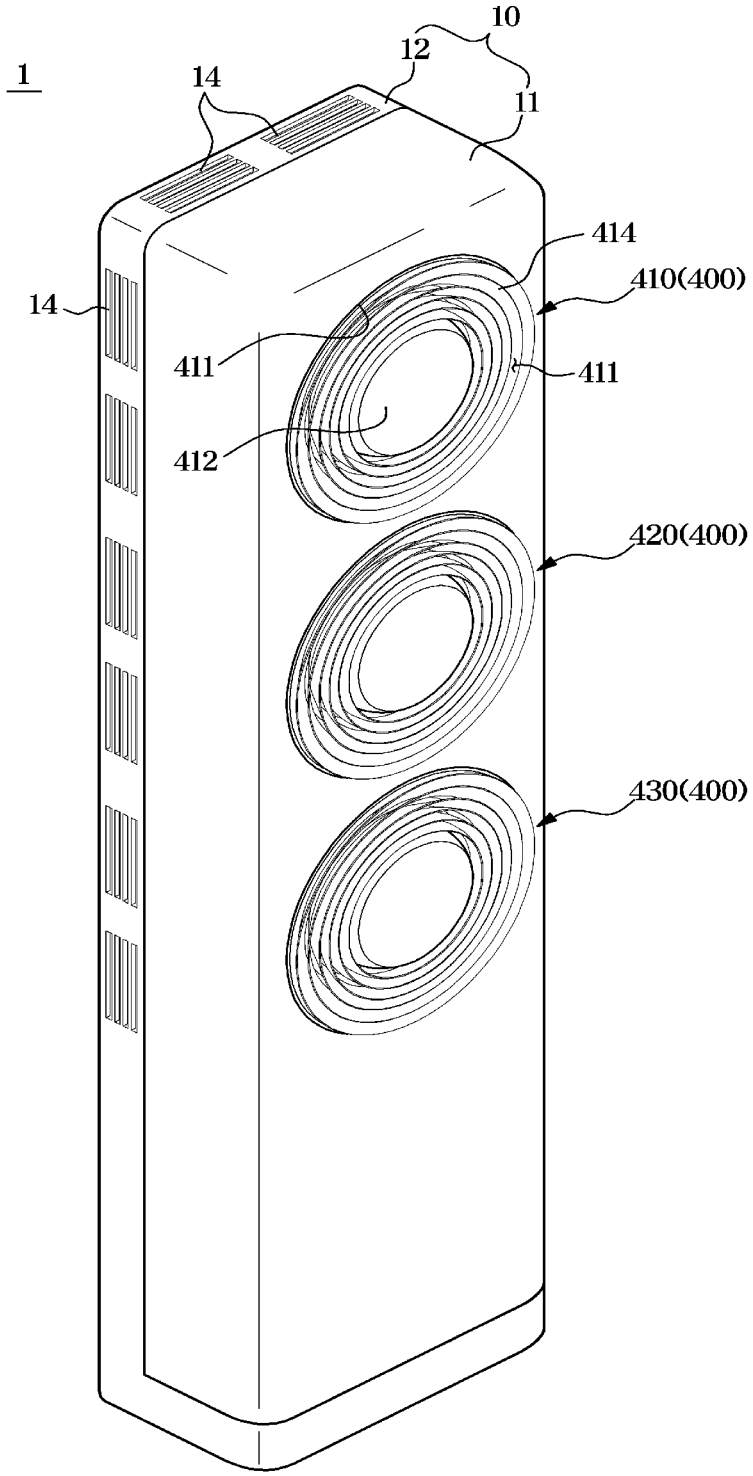
FIG. 17 illustrates an indoor unit of an air conditioner, according to a fifth embodiment of the disclosure.
Figure 18:
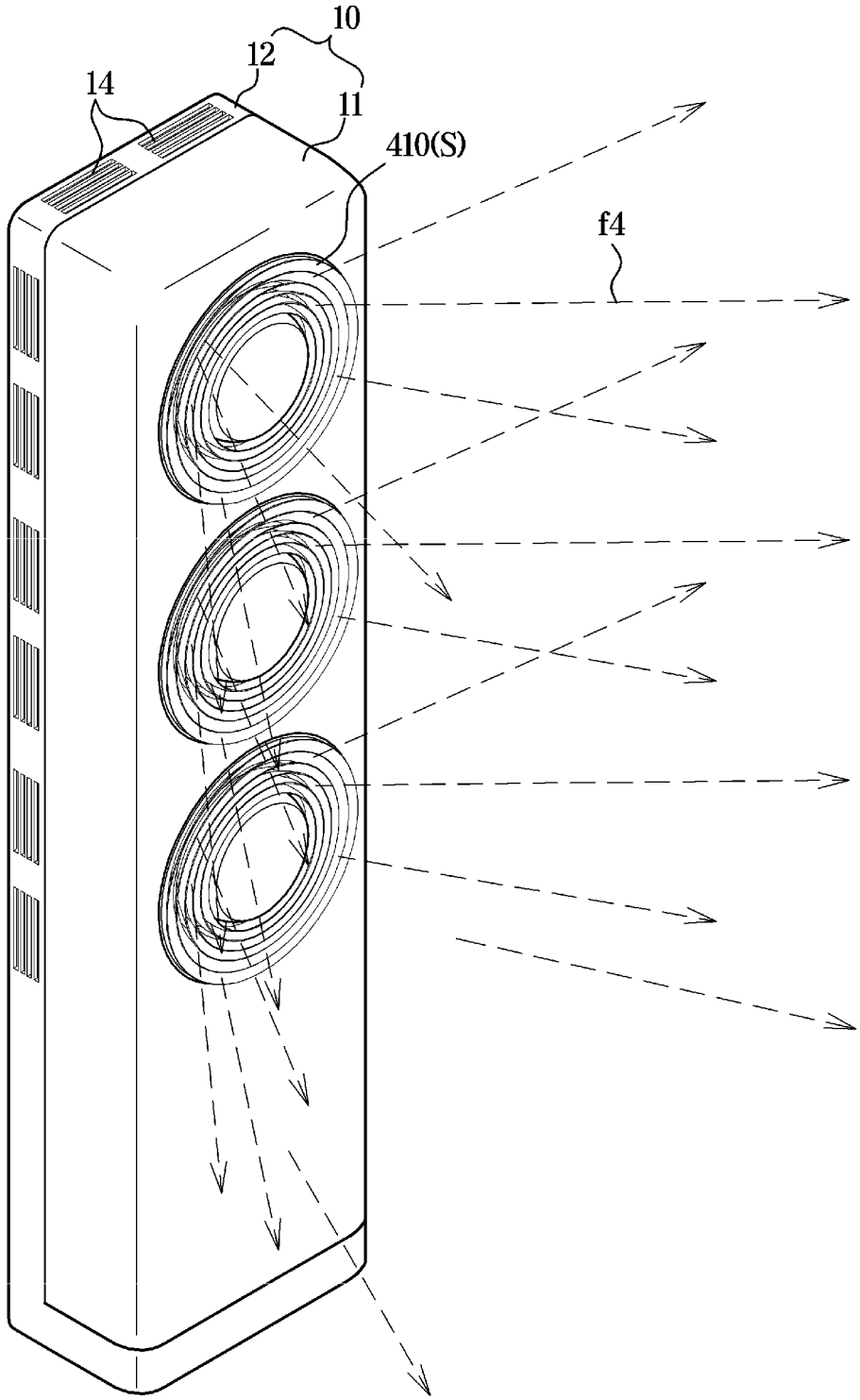
FIG. 18 schematically illustrates discharge airflows released from an outlet according to an operation mode of the indoor unit of the air conditioner, according to the fifth embodiment of the disclosure.
Figure 19:
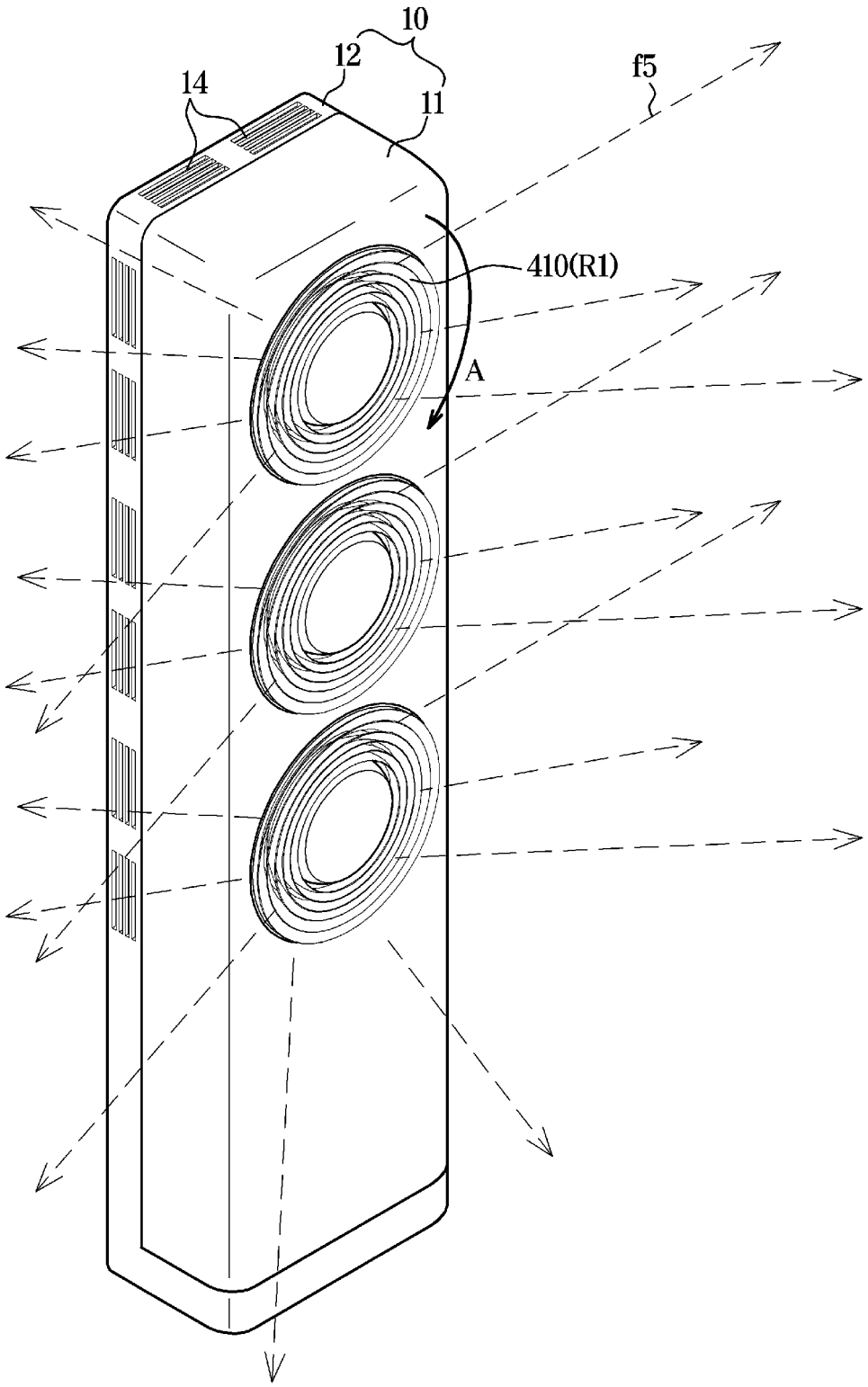
FIG. 19 schematically illustrates discharge airflows released from an outlet according to an operation mode of the indoor unit of the air conditioner, according to the fifth embodiment of the disclosure.
Figure 20:
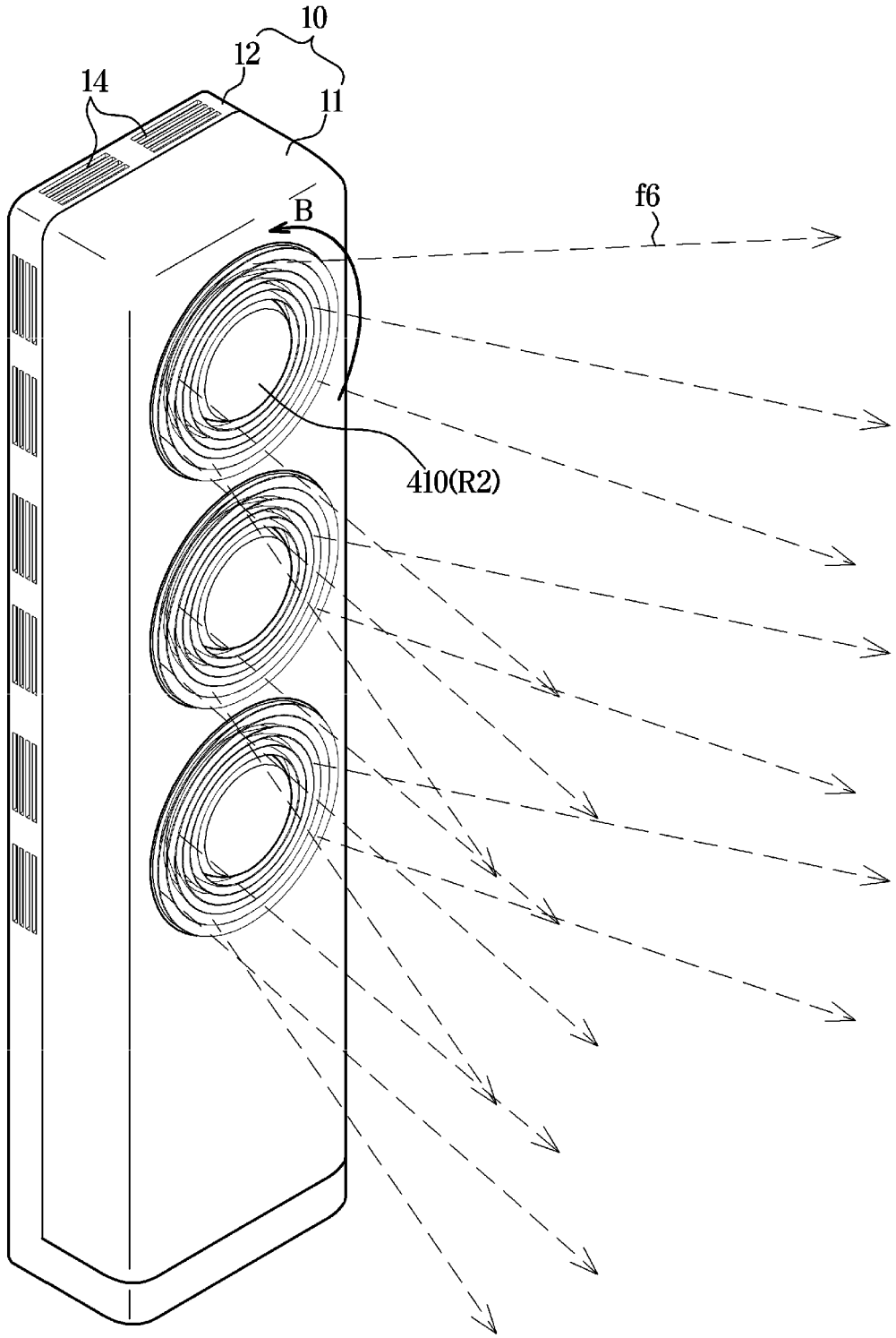
FIG. 20 schematically illustrates discharge airflows released from an outlet according to an operation mode of the indoor unit of the air conditioner, according to the fifth embodiment of the disclosure.

FIG. 17 illustrates an indoor unit of an air conditioner, according to the fifth embodiment of the disclosure, FIG. 18 schematically illustrates discharge airflows released from an outlet according to an operation mode of the indoor unit of the air conditioner, according to the fifth embodiment of the disclosure, FIG. 19 schematically illustrates discharge airflows released from an outlet according to an operation mode of the indoor unit of the air conditioner, according to the fifth embodiment of the disclosure, and FIG. 20 schematically illustrates discharge airflows released from an outlet according to an operation mode of the indoor unit of the air conditioner, according to the fifth embodiment of the disclosure.

As shown in FIG. 17, the diffuser 400 may include a first diffuser 410, a second diffuser 420, and a third diffuser 430. The diffusers 410, 420 and 430 may be separately arranged in the vertical direction. Unlike the embodiment of the disclosure, there may be fewer or more than three diffusers 400. The plurality of diffusers 410, 420 and 430 are formed in the same structure, so the first diffuser 410 will be described for an example of the diffuser 400.

The diffuser 410 may include a plurality of vanes 414 arranged between a center part 412 and a ring 413. The diffuser 410 may be arranged in front of the blower fan 112 for the air that has passed the blower fan 112 to be discharged forward from the front panel 11 through an outlet 411. In this case, the air discharged through the plurality of vanes 414 arranged on the outlet 411 may be guided. The wind direction and wind volume of the air discharged through the outlet 411 may be controlled by adjusting the number, the shape, a placement angle or the like of the plurality of vanes 414.

The plurality of vanes 414 may be provided in the form of rings. The plurality of vanes 414 may each be provided in the form of a ring having a different radius. The plurality of vanes 414 may be arranged in the order of growing radius from the center part 412 to the ring 413 in the radial direction of the ring 413.

Accordingly, the outlet 411 may have the shape of a ring between the vanes 414.

Assuming that a direction toward the front of the diffuser 410 is z direction, a radial direction from the center part 412 of the diffuser 410 is y direction, and a direction corresponding to the rotation direction A of the blower fan 112 in a tangential direction of the circular shape of the diffuser 410 is x direction, some of the discharge air blown out from the blower fan 112, which are in the x and y directions, are guided by the plurality of vanes 414 and flow intact in the x and y directions.

While in the first embodiment, the plurality of vanes 214 are provided to block some of the discharged air that are flowing in the x and y directions to be guided to the z direction, the plurality of vanes 414 in the fifth embodiment may be provided not to block some of the discharged air that are flowing in the x and y directions and not to guide the air flowing in the x and y directions to the z direction.

Accordingly, while the diffuser 410 is stopped, the plurality of vanes 414 may be arranged so that the flow of the air discharged from the diffuser 410 becomes the spreading airflow.

Specifically, while the indoor unit 1 of the air conditioner is provided to discharge the forward airflow when the diffuser 210 is in the stopped state S in the first embodiment, the indoor unit 1 of the air conditioner may be provided to discharge the spreading airflow when the diffuser 210 is in the stopped state S in the fifth embodiment.

Unlike the diffuser 210 in the first or third embodiment, the diffuser 410 in the fifth embodiment may be provided to minimize controlling of the directivity of an airflow produced by the blower fan 112 in discharging the air while in the stopped state S.

However, in the fifth embodiment, the indoor unit 1 of the air conditioner may control directivity of the discharge airflow so that the air passing the diffuser 410 becomes the forward airflow or the spreading airflows by rotation of the diffuser 410.

The diffuser 410 may be provided to rotate around the rotation axis C of the blower fan 112 in the first direction A, which is the rotation direction of the blower fan 112. Furthermore, the diffuser 410 may be provided to rotate around the rotation axis C of the blower fan 112 in the opposite direction B of the first direction A.

As shown in FIG. 18, while the diffuser 21 is in the stopped state S, the air discharged through the diffuser 410 may be formed into a fourth airflow f4 having directivity caused by the blower fan 112.*b* The fourth airflow f4 may correspond to the spreading airflow having directivity to x and y directions caused by the blower fan 112.

As described above, as the plurality of vanes 414 are shaped like rings separately arranged in the radial direction, the flow of air discharged from the diffuser 410 may be maintained so that the air flows in the x direction, which is a tangential direction of the rotation direction A of the blower fan 112 and the y direction, which is a radial direction. Hence, the air passing through the diffuser 410 may be formed into the fourth airflow f4 having high directivity to all directions.

The fourth airflow f4 may have higher spreadability than the first airflow f1 formed when the diffuser 210 is stopped S in the indoor unit 1 of the air conditioner according to the first embodiment of the disclosure.

As shown in FIG. 19, when the diffuser 410 is driven in a rotation state R1 of being rotated in the first direction A, the air passing through the diffuser 410 may be formed into a fifth airflow f5 having less directivity toward the forward direction but higher spreadability than the fourth airflow f4. The fifth airflow f5 may correspond to the spreading airflow having higher spreadability than the fourth airflow f4.

The diffuser 410 may be provided to rotate in the first direction A, which is the rotation direction of the blower fan 112. As described above, the diffuser 410 may be rotated around the same axis as the rotation axis C of the blower fan 112.

Accordingly, the plurality of vanes 414 may also be provided to rotate in the first direction A. As the plurality of vanes 414 are rotated in the first direction A, they may increase fluidity of the air in the x direction. When the diffuser 410 is rotated in the first direction A, the air passing through the diffuser 410 has further directivity to the x direction, leading to a further increase in air fluidity in the x direction.

Specifically, when the plurality of vanes 414 are in the stopped state S, the plurality of vanes 414 do not add the directivity to the x direction, so the directivity formed by the blower fan 112 is maintained while the air is passing through the diffuser 410. On the other hand, when the plurality of vanes 414 are rotated in the first direction A, the discharged air has further directivity to the x direction and accordingly, the directivity of air to the z direction is, on the contrary, canceled out, thereby increasing spreadability of the discharge airflow.

Accordingly, when the diffuser 410 is driven in a rotation state R1 of being rotated in the first direction A, the air passing through the diffuser 410 may have an increase in fluidity in the x direction and may thus be formed into the fifth airflow f5 having high directivity in which the air spreads in all directions.

As shown in FIG. 20, the diffuser 410 may be rotated in the second direction B, which is opposite to the rotation direction of the blower fan 112.

When the diffuser 410 is driven in the state R2 of being rotated in the second direction B, the air may be formed into a sixth airflow f6 having higher directivity toward the forward direction than the fourth airflow f4 when passing through the diffuser 410.

The plurality of vanes 414 may guide air passing through the diffuser 410 to an opposite direction of the x direction while being rotated in the opposite direction B of the rotation direction of the blower fan 112. Accordingly, the plurality of vanes 414 may cancel out the fluidity of air discharged from the diffuser 410 in the x and y directions and change the fluidity in the x and y directions to the z direction.

In other words, the directivity of the discharge airflow to the x direction may be extinguished, and the discharge airflow may be guided to the forward airflow by changing moving directions of the discharged air spreading in all directions to the forward direction. This is because the air passing the plurality of vanes 414 has further directivity to the opposite direction of the x direction as the plurality of vanes 414 are rotated in the second direction B.

Accordingly, when the diffuser 410 is in the state R2 of being rotated in the second direction B, the discharged air passing through the diffuser 210 may be formed into the sixth airflow f6 having higher directivity toward the forward direction than the fourth airflow f4 by having reduced fluidity in the y direction in proportion to the fluidity in the x direction and having increased fluidity in the z direction as compared to when the diffuser 410 is in the stopped state S.

When the indoor unit 1 of the air conditioner is provided to discharge the sixth airflow f6, the indoor unit 1 is able to force the air to be moved to a far distance at a rapid flow velocity, thereby enabling air conditioning in a wide space and rapidly cooling or heating the space.

In other words, the indoor unit 1 of the air conditioner may be provided to create different types of airflows according to the respective states S, R1 and R2 of the diffuser 410. Especially, different types of airflows are created by simple rotation of the diffuser 410, and even when a different airflow is discharged, no flow loss of the airflow occurs, so the indoor unit 1 of the air conditioner may easily create different types of airflows without a loss of cooling or heating efficiency.

When the diffuser 410 is in the stopped state S, the fourth airflow f4 discharged through the diffuser 410 is a general spreading airflow having the directivity formed by the blower fan 112. It may be an airflow having higher spreadability than the airflow discharged when the diffuser 210 is in the stopped state S in the first embodiment.

When the diffuser 410 is in the state R1 of being rotated in the first direction A, the fifth airflow f5 discharged through the diffuser 410 is a spreading airflow having higher fluidity spreading in all directions than the fourth airflow f4.

When the diffuser 210 is in the state R2 of being rotated in the second direction B, the sixth airflow f6 discharged through the diffuser 410 is a forward airflow with higher directivity to the forward direction than the fourth and fifth airflows f4 and f5.

According to the user's choice, the diffuser 410 may be operated in one of the stopped state S, the state R1 of being rotated in the first direction A, and the state R2 of being rotated in the second direction B, and accordingly, various types of airflows f4, f5 and f6 may be discharged through the indoor unit 1 of the air conditioner.

Although the three different airflows f4, f5 and f6 have been described above as an example, more various airflows than the three airflows f4, f5 and f6 may be created as the plurality of diffusers 410, 420 and 430 are driven independently in the different states S, R1 and R2. For example, when the indoor unit 1 of the air conditioner is driven with the first diffuser 410 being in the stopped state S and the second and third diffusers 420 and 430 being in the state R1 of being rotated in the first direction A, an airflow having somewhat different fluidity from the fifth airflow f5 may be created.

However, for convenience of explanation, the three types of airflows f4, f5 and f6 have been described above as an example. It may be defined that the fourth airflow f1 is an airflow created when all the plurality of diffusers 410, 420 and 430 are in the stopped state S, the fifth airflow f5 is an airflow created when all of the plurality of diffusers 410, 420 and 430 are in the state R1 of being rotated in the first direction A, and the sixth airflow f6 is an airflow created when all of the plurality of diffusers 410, 420 and 430 are in the state R2 of being rotated in the second direction B.

As in the indoor unit 1 of the air conditioner shown in the above first or second embodiment, the plurality of diffusers 410, 420 and 430 are controlled separately to discharge airflows having three or more different types of directivity.

For example, the plurality of diffusers 410, 420 and 430 may discharge air while being driven separately in the three states S, R1 and R2 or in the two states R1 and R2. This is the same as the above description of the controlling of the indoor unit 1 of the air conditioner according to the first or second embodiment, so the overlapping description will not be repeated.

An indoor unit 1' of the air conditioner according to a sixth embodiment of the disclosure will now be described. Components of the diffuser 400 and a method of controlling the diffuser 400 for the indoor unit 1' of the air conditioner are the same as in the indoor unit 1 of the air conditioner according to the fifth embodiment, so overlapping descriptions will not be repeated.

Figure 21:
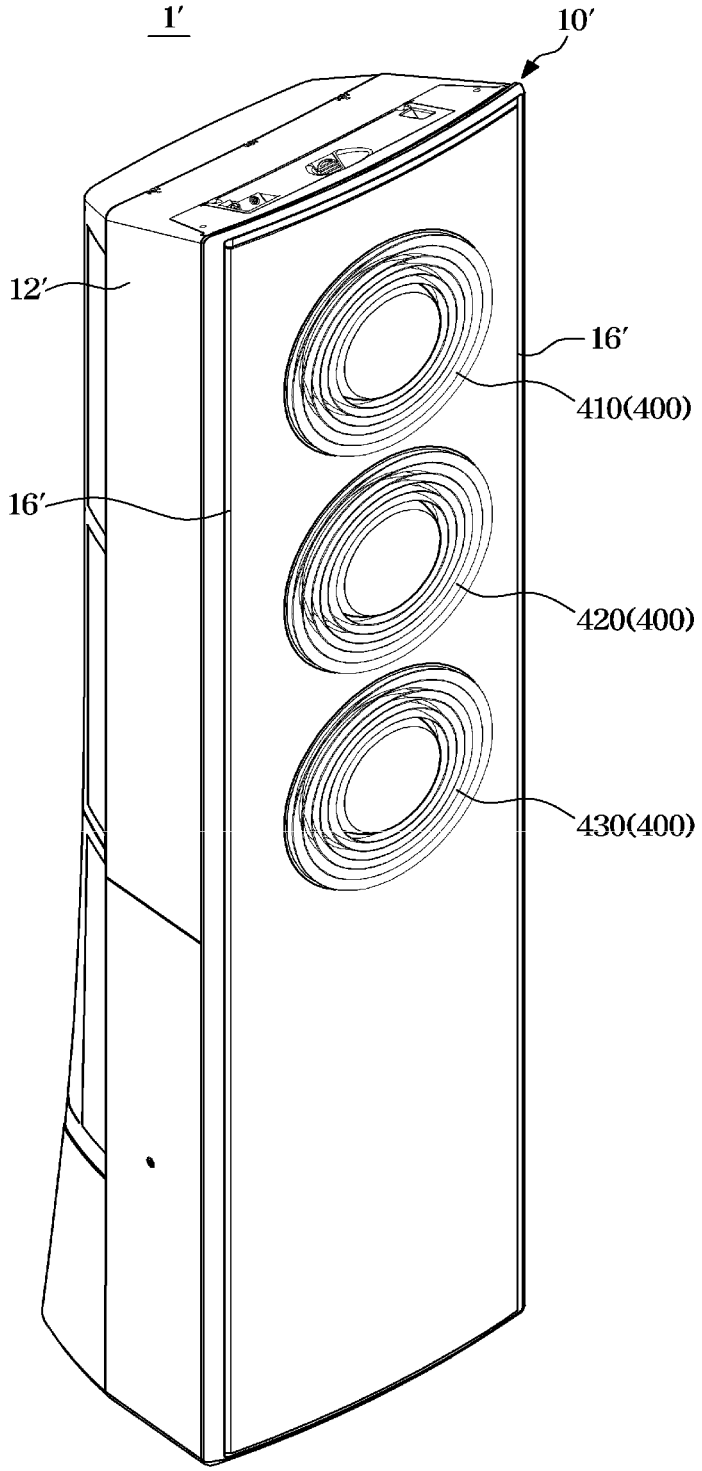
FIG. 21 illustrates an indoor unit of an air conditioner, according to a sixth embodiment of the disclosure.
Figure 22:
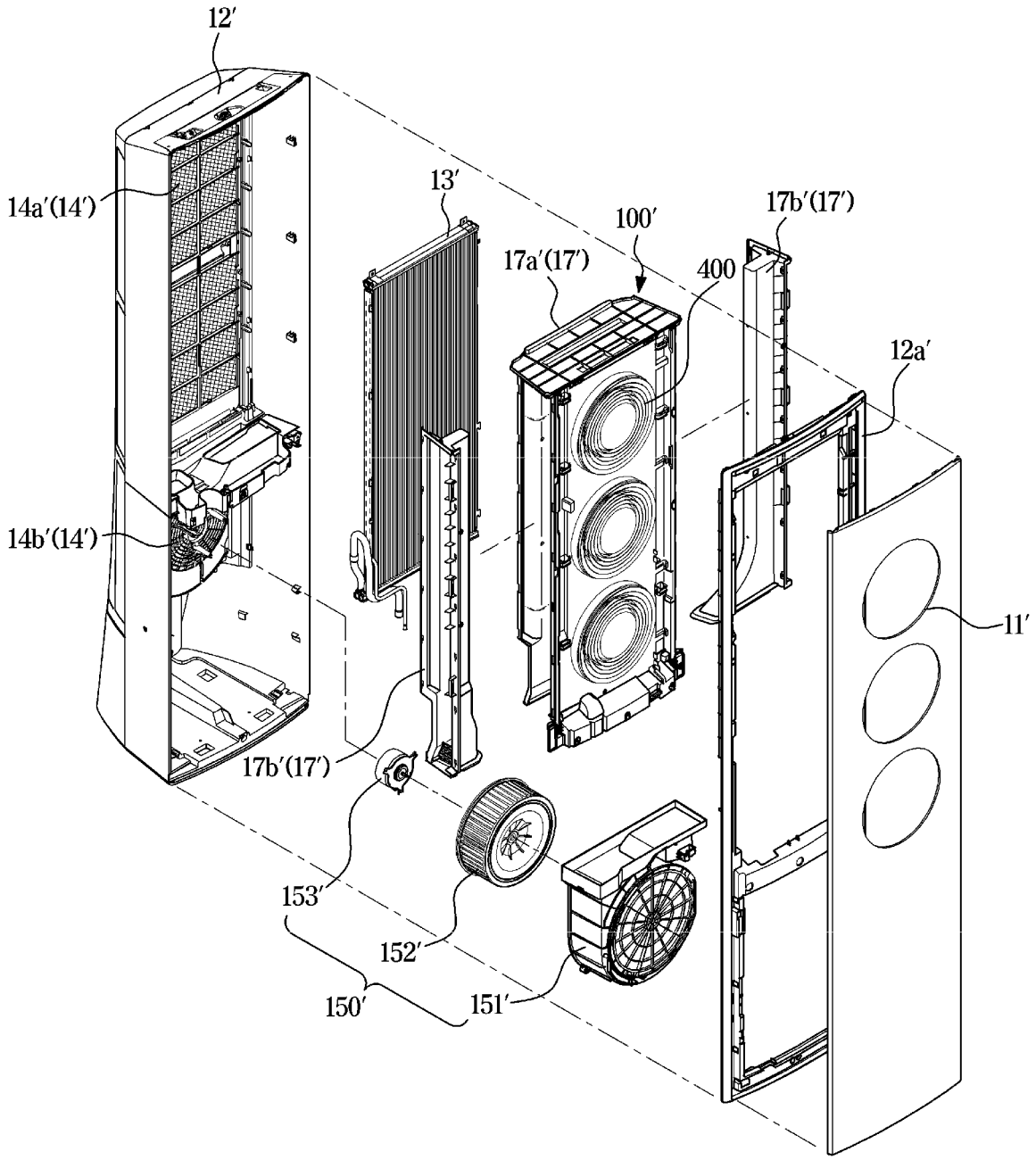
FIG. 22 is an exploded perspective view of a portion of the indoor unit shown in FIG. 21.
Figure 23:
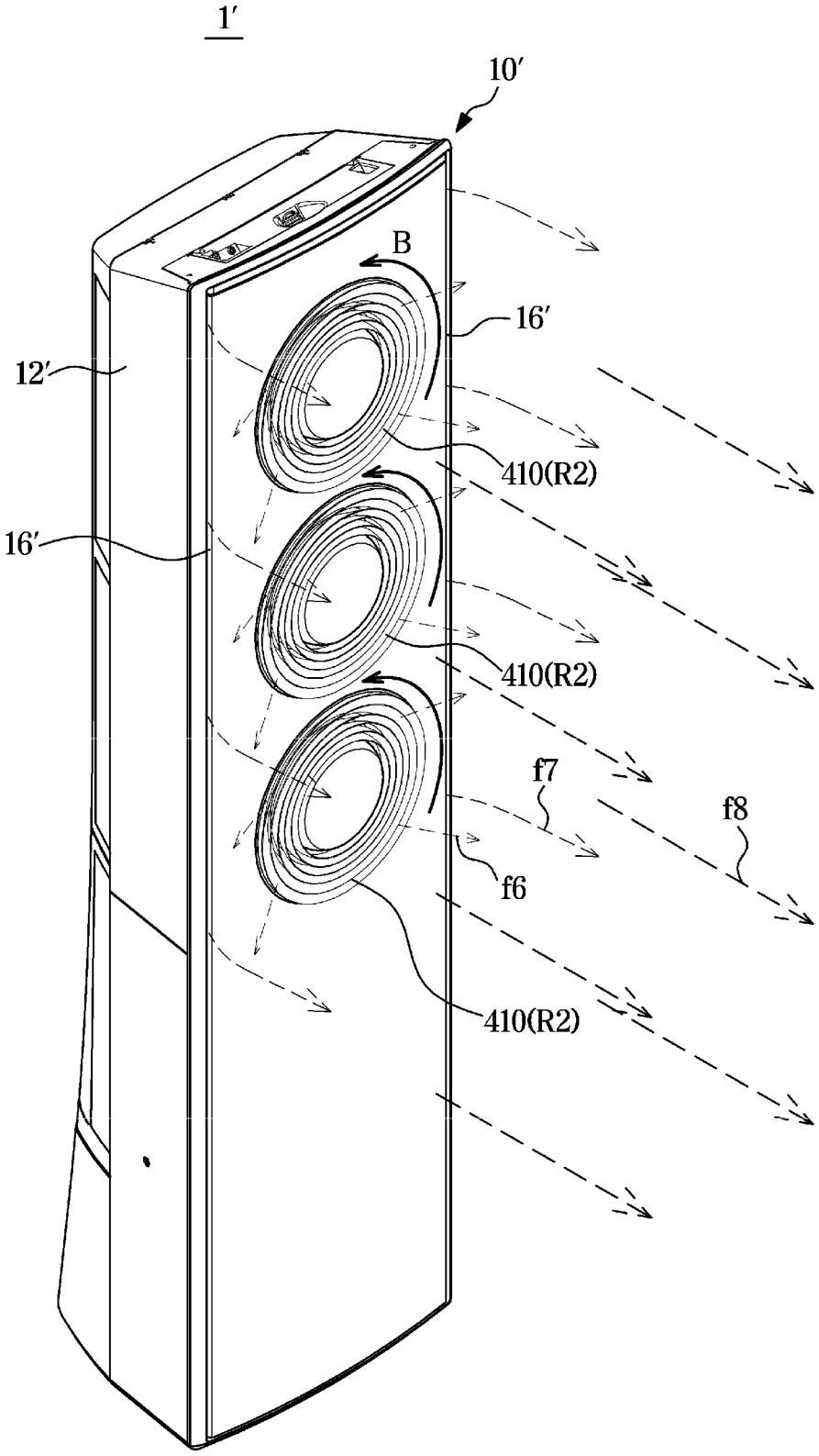
FIG. 23 schematically illustrates discharge airflows released from an outlet according to an operation mode of the indoor unit of the air conditioner, according to the sixth embodiment of the disclosure.

FIG. 21 illustrates an indoor unit of an air conditioner, according to the sixth embodiment of the disclosure, FIG. 22 is an exploded perspective view of a portion of the indoor unit shown in FIG. 21, and FIG. 23 schematically illustrates discharge airflows released from an outlet according to an operation mode of the indoor unit of the air conditioner, according to the sixth embodiment of the disclosure.

Referring to FIGS. 21 and 22, the indoor unit 1' of the air conditioner may include a housing 10' that forms an external appearance, a blower fan unit 100' for circulating air into or out of the housing 10', and a heat exchanger 13' for exchanging heat with air brought into the housing 10'.

Unlike the indoor unit 1 of the air conditioner according to the first embodiment, the indoor unit 1' of the air conditioner according to the sixth embodiment may also include an auxiliary blower fan unit 150' for additionally circulating the air and an auxiliary outlet 16' through which the air that has flown into the housing 10' is discharged through the auxiliary blower fan unit 150'.

The air having flown into the housing 10' through the blower fan unit 10' is subject to heat exchange in the housing 10' by the heat exchanger 13' and then discharged to the outside through the diffuser 400, and the air having flown into the housing 10' may be discharged out of the housing 10' through the auxiliary outlet 16' through the auxiliary blower fan unit 150' without being subject to heat exchange in the housing 10'.

The indoor unit 1' of the air conditioner may be provided such that the air brought in through the blower fan unit 100' and the auxiliary blower fan unit 150' may flow to the diffuser 400 and the auxiliary outlet 16' through separate flow paths, respectively, to avoid being mixed in the housing 10'.

Specifically, the housing 10' may include a housing body 12' equipped with the blower fan unit 100' and the heat exchanger 13', and a front panel 11' that covers the front of the housing body 12'. The housing 10' may include an inlet 14'. The housing body 12' may form a rear surface, both side surfaces, top surface, and a bottom surface of the indoor unit 1' of the air conditioner. The housing body 12' may have an open front. The inlet 14' may be arranged on the rear surface of the housing body 12'. It is not, however, limited thereto, and may be additionally arranged on at least one surface of the housing body 12'.

The housing body 12' may include a front frame 12*a*' arranged on the front opening of the housing body 12' and coupled to the front panel 11'. The front frame 12*a*' may include the auxiliary outlet 16' as will be described later. It is not, however, limited thereto, and the front frame 12*a*' may be integrally formed with the housing body 12'.

The front panel 11' may be coupled to a body case opening 11*a*. Although the front panel 11' is shown to be separable from the housing body case 12' in FIG. 22, the front panel 11' and the housing body case 12' may be integrally formed.

The front panel 11' may include an opening 15' connected to the blower fan unit 100'. The air blown from the blower fan unit 100' may be discharged to the opening 15' of the front panel 11' through the diffuser 400. The number of openings 15' may correspond to the number of diffusers 400.

The inlet 14' may include a first inlet 14*a*' and a second inlet 14*b*'. The inlets 14*a*' and 14*b*' may be arranged at the housing body 12'. The second inlet 14*b*' may be formed under the first inlet 14*a*'. Although there are two first inlets 14*a*' shown in FIG. 22, the number of the first inlets 14*a*' is not limited thereto but the number may vary as required. Furthermore, the first inlet 14*a*' is shown to be formed in a rectangle, but the shape of the first inlet 14*a*' is not limited thereto, but may have various forms as required. Like the first inlet 14*a*', the number and/or shape of the second inlet 14*b*' may vary as required.

With the front frame 12*a*', the front panel 11' may form the auxiliary outlet 16'. The auxiliary outlet 16' may be formed on the left and/or right side of the front panel 11'. It is not, however, limited thereto, and it may be formed on the top side of the front panel 11'.

It is not limited thereto, and the auxiliary outlet 16' may be arranged on the front panel 11' or may be arranged only on the front frame 12*a*'. The auxiliary outlet 16' may be arranged a certain distance away from the opening 15'.

The auxiliary outlet 16' may extend in the vertical direction of the housing body 12'. The auxiliary outlet 16' may be provided for the air that has flown into the housing 10' by the auxiliary blower fan unit 150' and has not exchanged heat in the housing 10' to be discharged out of the housing 10'. The auxiliary outlet 16' may be provided to discharge the air brought in through the second inlet 14*b'*.

The auxiliary outlet 16' may be formed to mix the air discharged from the auxiliary outlet 16' with the air discharged from the diffuser 400. Specifically, the indoor unit 1' of the air conditioner may include a guide (not shown) arranged in a portion of the front panel 11' that forms the auxiliary outlet 16' for guiding the air discharged from the auxiliary outlet 16' to be mixed with the air discharged from the diffuser 400. The guide is not limited thereto, but may be arranged in the form of a blade in the auxiliary outlet 16' to guide the air discharged through the auxiliary outlet 16'.

The auxiliary outlet 16' may be formed to give directivity to the forward direction to the air discharged from the auxiliary outlet 16' to the opening opened to the front.

The indoor unit 1' of the air conditioner may include a duct 17' arranged for the air brought into the housing 10' to flow to the diffuser 400 and the auxiliary outlet 16'.

Assuming an air flow path connecting the first inlet 14*a*' to the diffuser 400 is called a first flow path and an air flow path connecting the second inlet 14*b*' to the auxiliary outlet 16' is called a second flow path, the duct 17' may be arranged to separate the first flow path from the second flow path, thereby preventing the air moving in the first and second flow paths from being mixed together.

The heat exchanger 13' may be arranged in the first flow path. Hence, the air flowing in the first flow path may exchange heat with the heat exchanger 13'. The second flow path is separately arranged from the first flow path and the air flowing in the second flow path may not exchange heat with the heat exchanger 13'.

The duct 17' may include a first duct 17*a*' that forms the first flow path. The first duct 17*a*' may guide the air brought in from the first inlet 14*a*' to flow to the diffuser 400 by the blower fan unit 100'. The blower fan unit 100' is identical to the blower fan unit 100 of the indoor unit 1 of the air conditioner according to the first embodiment, so the overlapping description will not be repeated.

The duct 17' may include a second duct 17*b*' that forms the second flow path. The second duct 17*b*' may guide the air brought in from the second inlet 14*b*' to flow to the auxiliary outlet 16' by the auxiliary blower fan unit 150'.

The first duct 17*a*' and the second duct 17*b*' may be arranged to have internal spaces separated from each other. This separates the first flow path from the second flow path, thereby preventing the air flowing in the respective flow paths from being mixed.

The second duct 17*b*' may be provided in the plural to be arranged on either side of the first duct 17*a*'. The second ducts 17*b*' may be detachably coupled onto the either side of the first duct 17*a*'. It is not, however, limited thereto, and the second duct 17*b*' and the first duct 17*a*' may be integrally formed.

The second duct 17*b*' may extend in the vertical direction. The second duct 17*b*' may be connected to the auxiliary blower fan unit 150'. The second duct 17*b*' may be connected to a fan outlet 151' of the auxiliary blower fan unit 150'. The second duct 17*b*' may guide the air blown by the auxiliary blower fan unit 150' to the auxiliary outlet 16'.

The indoor unit 1' of the air conditioner may discharge air that has exchanged heat with the heat exchanger 13' through the diffuser 400 and discharge air that has not gone through the heat exchanger 13 through the auxiliary outlet 16'. That is, the auxiliary outlet 16' may be provided to discharge the air that is not subject to heat exchange.

As the heat exchanger 13' is arranged in the first flow path, the air discharged through the diffuser 400 may be heat-exchanged air. The second flow path has no heat exchanger arranged therein, so the air discharged through the auxiliary outlet 16' may be the air that has not exchanged heat.

It is not, however, limited thereto, and an auxiliary heat exchanger may be arranged in the second flow path. In this case, the air discharged from the auxiliary outlet 16' may exchange heat with the auxiliary heat exchanger and may then be discharged through the auxiliary outlet 16'. The auxiliary heat exchanger may be driven in the same manner as the heat exchanger 13', and may be independently driven with a different capacity. Accordingly, the air discharged through the diffuser 400 and the air discharged through the auxiliary heat exchanger 16' may have the same amount of heat exchange or different amounts of heat exchange.

The auxiliary blower fan unit 150' may include an auxiliary blower fan 152'. The auxiliary blower fan 152' may be provided to be driven independently from the blower fan unit 100'. The blower fan unit 100' may be arranged in the first flow path formed between the first inlet 14*a*' and the opening 15'.

The auxiliary blower fan unit 150' may include an auxiliary blower fan driving motor 153' for driving the auxiliary blower fan 152', and an auxiliary blower fan case 151'.

The auxiliary blower fan 152' may employ a centrifugal fan. However, the type of the auxiliary blower fan 152' is not limited thereto as long as the auxiliary blower fan 152' has a structure that forces the air brought in from the outside of the housing 10' to be discharged back to the outside of the housing 10'. For example, the auxiliary blower fan 152' may be a cross fan, a turbo fan, or a sirocco fan.

Although one auxiliary blower fan 152' is shown in the sixth embodiment, the number of auxiliary blower fans 152' is not limited thereto but may vary as required.

The heat exchanger 13' may be arranged between the blower fan unit 100' and the first inlet 14*a*'. As described above, the heat exchanger 13' may be arranged in the first flow path.

An airflow discharged from the auxiliary outlet 16' has higher directivity to the forward direction than the airflow discharged from the diffuser 400.

Accordingly, when the airflow discharged from the diffuser 400 is mixed with the airflow discharged from the auxiliary outlet 16', the whole airflows discharged from the indoor unit 1' of the air conditioner may be formed into airflows having higher directivity to the forward direction than when the air is discharged only from the diffuser 400.

The plurality of vanes 414 of the diffuser 400 of the indoor unit 1 of the air conditioner according to the fifth embodiment may not be arranged to block or press the airflow moving in the x and y directions but may guide the airflow to flow in the x and y directions.

Accordingly, the diffuser 400 according to the fifth embodiment is less involved in the increase or decrease in fluidity of the discharge airflow in the x and y directions than the diffuser 400 according to the first embodiment. The airflow discharged from the diffuser 400 according to the fifth embodiment may be forced to pass through the diffuser 400 while maintaining the power of rotation formed by rotation of the blower fan 112, and may have the nature of spreading airflow.

Specifically, the diffuser 400 according to the fifth embodiment may control directivity of the discharge airflow based on the driving state S, R1 or R2 of the diffuser 400, but the discharge airflow may be discharged through the diffuser 400 while maintaining spreadability of the airflow itself according to the rotational power of the blower fan 112.

As the diffuser 400 according to the fifth embodiment controls the airflow to an extent that guides the discharge airflow with intense directivity of spreading by adding spreadability or straightness of the airflow, it may have a smaller control range for the amount of change in directivity of the discharge airflow than the diffuser 200 according to the first embodiment.

On the other hand, the diffuser 200 according to the first embodiment may be provided to be actively involved in the increase or decrease in fluidity of the discharge airflow in the x and y directions as compared to the diffuser 400 according to the fifth embodiment. It is because the plurality of vanes 214 of the diffuser 200 block or pressurize the discharge airflow flowing in the x and y directions. Accordingly, the diffuser 200 according to the first embodiment may have a larger control range for the amount of change in directivity of the discharge airflow as compared to the diffuser 400 according to the fifth embodiment.

Especially, as the indoor unit 1 of the air conditioner according to the fifth embodiment has higher spreadability of the discharge airflow itself and a smaller control range for the amount of change in directivity of the discharge airflow than the airflow discharged from the indoor unit 1 of the air conditioner according to the first embodiment, it may have difficulty in forming an airflow having higher directivity to the forward direction than in the indoor unit 1 of the air conditioner according to the first embodiment.

However, in the case of the indoor unit 1' of the air conditioner according to the sixth embodiment, the air discharged from the auxiliary outlet 16' flows after being mixed with the airflow discharged from the diffuser 400 as described above, thereby facilitating creation of an airflow having higher directivity to the forward direction.

In other words, the indoor unit 1' of the air conditioner according to the sixth embodiment includes the same diffuser 400 as in the indoor unit 1 of the air conditioner according to the fifth embodiment, but may be configured for the discharge airflow having directivity to the forward direction to be discharged from the auxiliary outlet 16', thereby creating an airflow with high directivity to the forward direction.

Accordingly, when the airflow discharged from the diffuser 400 is mixed with the airflow discharged from the auxiliary outlet 16', the whole airflows discharged from the indoor unit 1' of the air conditioner may have higher directivity to the forward direction than the airflow discharged from the indoor unit 1 of the air conditioner according to the fifth embodiment.

The indoor unit 1' of the air conditioner according to the sixth embodiment may include the same diffuser 400 as the diffuser 400 of the indoor unit 1 of the air conditioner according to the fifth embodiment. Accordingly, the diffuser 400 may be arranged to discharge different types of discharge airflows f4, f5 and f6 according to the stopped state S, the state R1 of being rotated in the first direction A, and the state R2 of being rotated in the second direction B.

While the diffuser 400 is in the stopped state S, the air discharged through the diffuser 400 may be formed into the fourth airflow f4 having directivity caused by the blower fan. The fourth airflow f4 may correspond to the spreading airflow having directivity to x and y directions caused by the rotational power.

When the diffuser 400 is driven in a rotation state R1 of being rotated in the first direction A, the air passing through the diffuser 400 may be formed into the fifth airflow f5 having less directivity toward the forward direction but higher spreadability than the fourth airflow f4. The fifth airflow f5 may correspond to the spreading airflow having higher spreadability than the fourth airflow f4.

When the diffuser 400 is driven in the state R2 of being rotated in the second direction B, the air may be formed into a sixth airflow f6 having higher directivity toward the forward direction than the fourth airflow f4 when passing through the diffuser 400.

As shown in FIG. 23, the indoor unit 1' of the air conditioner according to the sixth embodiment may be provided to drive the auxiliary blower fan unit 150' when the diffuser 400 is driven in the state R2 of being rotated in the second direction B.

The diffuser 400 is driven in the state R2 of being rotated in the second direction B to form the discharge airflow to be the forward airflow, in which case the directivity of the discharge airflow to the forward direction is further increased.

The airflow discharged through the auxiliary outlet 16' with the directivity to the forward direction may be defined to be a seventh airflow f7. When discharged from the indoor unit 1', the seventh airflow f7 may be guided to have the directivity to the forward direction, and may have a nature of having higher directivity to the forward direction than the sixth airflow f6.

When the diffuser 400 is in the state R2 of being rotated in the second direction B and the auxiliary blower fan unit 150' is driven, the sixth airflow f6 and the seventh airflow f7 discharged through the diffuser 400 may be mixed.

The seventh airflow is an airflow having high directivity to the forward direction, and may be formed into an eighth airflow f8 by being mixed with the sixth airflow f6. The eighth airflow f8 may be formed as an airflow with higher directivity to the forward direction than the sixth airflow f6.

It is not, however, limited thereto, and the indoor unit 1' of the air conditioner according to the sixth embodiment may be provided to drive the auxiliary blower fan unit 150' when the diffuser 400 is driven in the stopped state S. In this case, the fourth airflow f4 discharged when the diffuser 400 is in the stopped state S and the seventh airflow f7 discharged from the auxiliary outlet 16' are mixed into an airflow having different directivity.

According to the user's choice, the diffuser 400 may be operated in one of the stopped state S, the state R1 of being rotated in the first direction A, and the state R2 of being rotated in the second direction B, and accordingly, various types of airflows f4, f5 and f6 may be discharged through the indoor unit 1 of the air conditioner.

Furthermore, while the auxiliary blower fan unit 150' is additionally driven, the airflow f8 having higher directivity to the forward direction than the aforementioned airflow f4, f5 or f6 may be discharged through the indoor unit 1' of the air conditioner.

Although the four different airflows f4, f5, f6, and f8 have been described as an example, more various airflows than the four airflows f4, f5, f6 and f8 may be created by the plurality of diffusers 410, 420 and 430 driven independently in the different states S, R1 and R2 and the extra auxiliary blower fan unit 150' driven independently.

For example, when the indoor unit 1 of the air conditioner is driven with the first diffuser 410 being in the stopped state S and the second and third diffusers 420 and 430 being in the state R2 of being rotated in the second direction A→B, an airflow having somewhat different fluidity from the sixth airflow f6 may be created.

Furthermore, in this case, when the auxiliary blower fan 150' is further driven, an airflow having somewhat different fluidity from the eighth airflow f8 may be created.

However, for convenience of explanation, the four types of airflows f4, f5, f6 and f8 have been described above as an example. It may be defined that the fourth airflow f4 is an airflow created when all the plurality of diffusers 410, 420 and 430 are in the stopped state S, the fifth airflow f5 is an airflow created when all of the plurality of diffusers 410, 420 and 430 are in the state R1 of being rotated in the first direction A, the sixth airflow f6 is an airflow created when all of the plurality of diffusers 410, 420 and 430 are in the state R2 of being rotated in the second direction B, and the eighth airflow f8 is an airflow resulting from mixing the seventh airflow f7 discharged through the auxiliary outlet 16' with the sixth airflow f6 that has been created.

As in the indoor unit 1 of the air conditioner shown in the above first or second embodiment, the plurality of diffusers 410, 420 and 430 are controlled separately to discharge airflows having three or more different types of directivity.

For example, the plurality of diffusers 410, 420 and 430 may discharge air while being driven separately in the three states S, R1 and R2 or in the two states R1 and R2. This is the same as the above description of the controlling of the indoor unit 1 of the air conditioner according to the first or second embodiment, so the overlapping description will not be repeated.

In addition, the indoor unit 1' of the air conditioner according to the sixth embodiment may have the auxiliary blower fan unit 150' that is driven independently, and thus may discharge more various airflows than in the indoor unit 1 of the air conditioner according to the fifth embodiment. Especially, it may more easily form a discharge airflow having higher directivity to the forward direction than the indoor unit 1 of the air conditioner according to the fifth embodiment of the disclosure.

The indoor unit 1 of the air conditioner according to a seventh embodiment of the disclosure will now be described. Components other than a diffuser 500 of the indoor unit 1 of the air conditioner are the same as those of the indoor unit 1 of the air conditioner according to the first embodiment of the disclosure, so overlapping descriptions will not be repeated.

Figure 24:
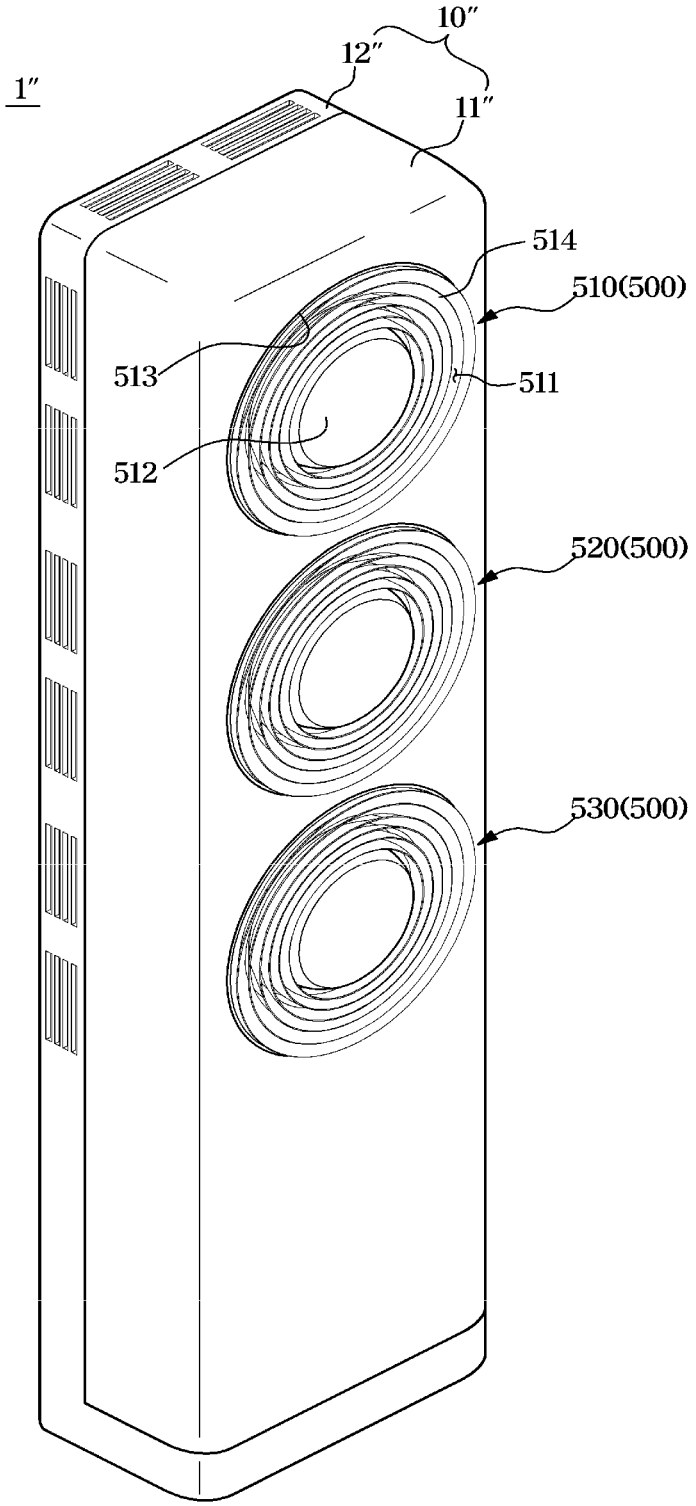
FIG. 24 illustrates an indoor unit of an air conditioner, according to a seventh embodiment of the disclosure.
Figure 25:
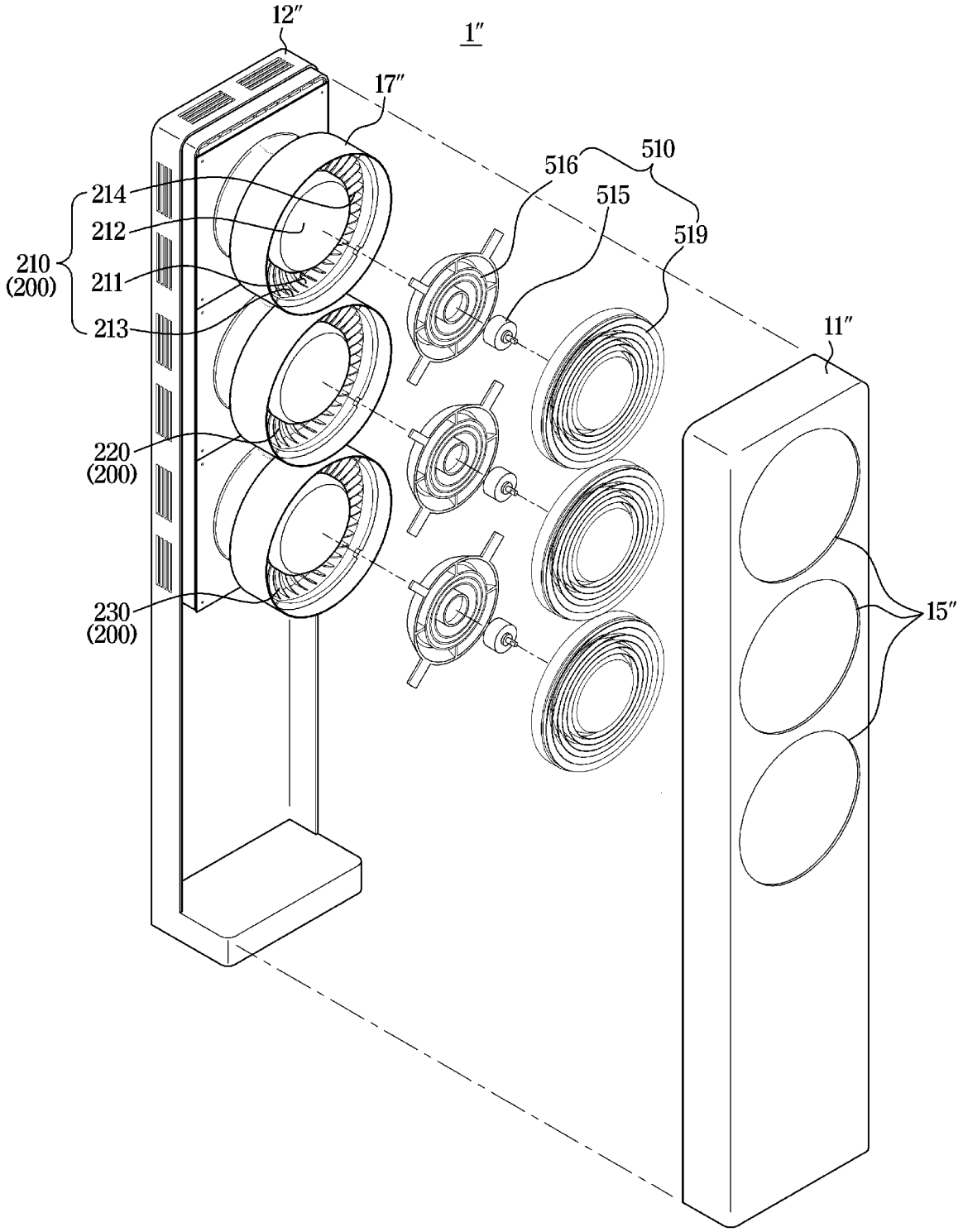
FIG. 25 illustrates the indoor unit shown in FIG. 24 with some components separated therefrom.

FIG. 24 illustrates an indoor unit of an air conditioner, according to the seventh embodiment of the disclosure, and FIG. 25 illustrates the indoor unit shown in FIG. 24 with some components separated therefrom.

In the seventh embodiment, an indoor unit 1" of an air conditioner may include a front panel 11" at which an opening 15" opened to the front is formed, and a housing 10" including a housing body 12" coupled to the back of the front panel 11".

The indoor unit 1" of the air conditioner may include the front diffuser 500 that forms an outlet 511 of the blower fan unit, is arranged on the opening 15" of the housing 10", and is arranged in front of the diffuser 200.

The air blown by the blower fan unit may successively pass the diffuser 200 and the front diffuser 500 and may then be discharged out of the housing 10".

The front diffuser 500 may be provided as a plurality of front diffusers 510, 520 and 530 to match the plurality of diffusers 210, 220 and 230. The plurality of front diffusers 510, 520 and 530 may be arranged to match the plurality of openings 15".

The plurality of diffusers 210, 220 and 230 or the plurality of front diffusers 510, 520 and 530 are the same as each other, so one of the diffusers, e.g., 210 or one of the front diffusers, e.g., 510, will be described as a representative to avoid repetition of explanation.

The indoor unit 1" of the air conditioner may include a duct 17" arranged to cover at least some of the diffuser 210 and the front diffuser 510 from behind the diffuser 210 to form a flow path in which air flows while the air sucked in by the blower fan 210 is being discharged to the outlet 211 of the diffuser 210 and an outlet 511 of the front diffuser 510.

The diffuser 210 may include the center part 212 arranged in the middle of the opening 15", the ring 213 arranged outside of the center part 212 to form sides of the diffuser 210, the outlet 211 formed between the center part 212 and the ring 213, and the plurality of vanes 214 formed between the center part 212 and the ring 213. The diffuser 210 may be formed to be identical to the diffuser 210 according to the first embodiment of the disclosure.

The front diffuser 510 may include a center part 512 arranged in the middle of the opening 15", a ring 513 arranged outside of the center part 512 to form sides of the front diffuser 510, an outlet 511 formed between the center part 513 and the ring 513, and a plurality of vanes 514 formed between the center part 512 and the ring 513. The center part 512, the ring 513, and the plurality of vanes 514 may be integrally formed into a diffuser body 519. Furthermore, the front diffuser 510 may be formed to be identical to the diffuser 410 according to the fourth embodiment of the disclosure.

The front diffuser 510 may include a front diffuser driving motor 515 provided to rotate the plurality of vanes 514 in a rotation direction of the blower fan or in the opposite direction of the rotation direction. The front diffuser driving motor 515 may be provided to rotate the diffuser body 519.

The front diffuser 510 may include a front bracket 516 to support the front diffuser driving motor 515. At least some of the front bracket 516 may be arranged on the rear surface of the center part 512 of the front diffuser 510 so that the front diffuser driving motor 515 is arranged on the rear surface of the center part 512.

The bracket 516 may be coupled to the duct 17" not to restrict rotation of the plurality of vanes 214 of the diffuser 210 and the plurality of vanes 514 of the front diffuser 510 and support the front diffuser driving motor 515. It is also not limited thereto, and the bracket 516 may be coupled directly to the housing 10" to support the front diffuser driving motor 515.

Although the front bracket 516 is described as a part of the front diffuser 510 in the embodiment of the disclosure, it is not limited thereto, and the front bracket 516 may be a part of the duct 17" or may be a separate part not included in the front diffuser 510 nor the duct 17".

It is also not limited thereto, and the driving motor 215 for delivering driving force to the diffuser 210 disclosed in the first embodiment may be arranged at the front bracket 516 instead of the bracket 216. In this case, the driving motor 215 may be arranged in front of the center part 212 to deliver the rotational power to the diffuser 210. Specifically, it may be in front of the center part 212 and coupled to the center part 212 to allow the plurality of vanes 214 to be rotated.

The diffuser 210 and the front diffuser 510 are separately controlled to be driven in the stopped state S, the state R1 of being rotated in the first direction A or the state R2 of being rotated in the second direction B.

The air may successively pass the diffuser 210 and the front diffuser 510 and may then be discharged into the housing 10". The air brought into the housing 10" may be formed into an airflow having certain directivity while passing through the diffuser 210 and the front diffuser 510 and discharged from the housing 10".

In other words, the air brought into the housing 10" may become an airflow having certain directivity while passing through the diffuser 210 first. The air may be formed into an airflow having the same directivity as one of the first, second and third airflows f1, f2 and f3 depending on the driving state S, R1 or R2, and may then flow to the front diffuser 510.

Again, the airflow flowing into the front diffuser 510 may be formed into an airflow having certain directivity depending on the driving state S, R1, or R2 of the front diffuser 510. As the airflow flowing into the front diffuser 510 has different directivity from the directivity of the airflow flowing into the diffuser 410 disclosed in the fourth embodiment, the airflow passing through the front diffuser 510 is not formed into the airflow having the same directivity as the fourth, fifth, or sixth airflow but may be formed into an airflow having new directivity with somewhat similar directivity added.

That is, the indoor unit 1" of the air conditioner according to the seventh embodiment has the diffuser 210 and the front diffuser 510 arranged in sequence to form an airflow having more various directivity than in the indoor unit 1 or 1' of the air conditioner according to the other aforementioned embodiments.

Furthermore, as described above, the diffuser 210 and the front diffuser 510 may be separately driven, in which case when only the front diffuser 510 is driven while the diffuser 210 is in the stopped state, a similar airflow to the airflow discharged from the diffuser 410 disclosed in the fourth embodiment may be discharged and when only the diffuser 210 is driven while the front diffuser 510 is in the stopped state, a similar airflow to the airflow discharged from the diffuser 410 disclosed in the first embodiment may be discharged.

The diffuser 210 and the front diffuser 510 may be separately and selectively driven to discharge airflows having various directivity.

Moreover, as in the first and fifth embodiments, the first, second, and third diffusers 210, 220 and 230 and the first, second and third front diffuser 510, 520 and 530 are separately driven in the stopped state S, the state R1 of being rotated in the first direction A or the state R2 of being rotated in the second direction B. Accordingly, they may be provided to discharge an airflow having additional directivity.

Other structures and operation principles are the same as those of the indoor unit 1 of the air conditioner according to the aforementioned embodiments of the disclosure, so the detailed description thereof are omitted.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. An indoor unit of an air conditioner comprising:

a housing having a first opening and a second opening;

a heat exchanger arranged in the housing to heat exchange air drawn into the housing;

a fan arranged in the housing and rotatable around a rotation axis, the rotation axis formed to extend along a direction toward the first opening and the second opening;

a first diffuser placed at the first opening, and a second diffuser placed at the second opening, the first diffuser and the second diffuser arranged to be independently rotated, and through which heat exchanged air blown by the fan is discharged; and a controller configured to control rotation of the first diffuser and the second diffuser, wherein the first diffuser and the second diffuser include a plurality of vanes configured to guide the heat exchanged air blown by the fan, and the first diffuser and the second diffuser being further configured to be selectively rotatable in a same direction as a rotation direction of the fan, the plurality of vanes are arranged to guide the heat exchanged air blown by the fan in a rotation direction of the first diffuser and the second diffuser while the first diffuser and/or the second diffuser are rotated, and the controller is configured to control the first diffuser and the second diffuser by selecting one of:

a first state in which both the first diffuser and the second diffuser are rotated in the rotation direction of the fan, a second state in which one of the first diffuser and the second diffuser is stopped while another of the first diffuser and the second diffuser is rotated in the rotation direction of the fan, and a third state in which both the first diffuser and the second diffuser are stopped.

2. The indoor unit of the air conditioner of claim 1, wherein at least one of the first diffuser and the second diffuser is arranged to be selectively rotatable in an opposite direction of the rotation direction of the fan.

3. The indoor unit of the air conditioner of claim 1, wherein at least one of the first opening and the second opening is formed in a circle shape, wherein at least one of the first diffuser and the second diffuser further comprises a ring corresponding to the first opening or second opening and a center part arranged in a middle of the ring, and the plurality of vanes are arranged to extend from the center part to the ring.

4. The indoor unit of the air conditioner of claim 2, wherein at least one of the first opening and the second opening is formed in a circle shape, wherein at least one of the first diffuser and the second diffuser further comprises a ring corresponding to the opening and a center part arranged in a middle of the ring, and wherein the plurality of vanes are arranged to extend from the center part to the ring and guide the heat exchanged air blown from the fan in an opposite direction of the rotation direction of the fan while the at least one of the first diffuser and the second diffuser is rotated in the opposite direction of the rotation direction of the fan.

5. The indoor unit of the air conditioner of claim 3, wherein each vane of the plurality of vanes have one end placed to be adjacent to the center part, respectively, and another end connected to the ring, respectively, and wherein each of the plurality of vanes are provided to be curved in the rotation direction of the fan from the one end to the other end, respectively.

6. The indoor unit of the air conditioner of claim 3, wherein each vane of the plurality of vanes has one end connected to the center part, respectively, and another end connected to the ring, respectively, and wherein the plurality of vanes are each provided to be curved in an opposite direction of the rotation direction of the fan from the one end to the other end, respectively.

7. The indoor unit of the air conditioner of claim 3, wherein each vane of the plurality of vanes has one end connected to the center part, respectively, and another end connected to the ring, respectively, and wherein each vane of the plurality of vanes are each provided to extend from the one end to the other end in a radial direction of the ring, respectively.

8. The indoor unit of the air conditioner of claim 2, wherein the controller is configured to control the first diffuser and the second diffuser by selecting a fourth state in which at least one of the first diffuser and the second diffuser is rotated in an opposite direction of the rotation direction of the fan.

9. The indoor unit of the air conditioner of claim 1, further comprising: an auxiliary fan arranged in the housing, wherein the housing further comprises an auxiliary outlet formed to discharge air blown from the auxiliary fan.

10. The indoor unit of the air conditioner of claim 9, wherein the housing further comprises an auxiliary flow path for auxiliary air brought into the housing to flow to the auxiliary outlet through the auxiliary fan, and wherein the auxiliary flow path is arranged to prevent the auxiliary air flowing in the auxiliary flow path from passing through the heat exchanger.

11. The indoor unit of the air conditioner of claim 2, wherein the first diffuser and the second diffuser are arranged to be independently rotated.

12. The indoor unit of the air conditioner of claim 11, wherein the controller is configured to control rotation of the first diffuser and the second diffuser by selecting one of:

a fourth state in which both the first diffuser and the second diffuser are rotated in an opposite direction of the rotation direction of the fan, a fifth state in which one of the first diffuser and the second diffuser is stopped while another of the first diffuser and the second diffuser is rotated in the opposite direction of the rotation direction of the fan, and a sixth state in which one of the first diffuser and the second diffuser is rotated in the rotation direction of the fan while another of the first diffuser and the second diffuser is rotated in the opposite direction of the rotation direction of the fan.

13. An indoor unit of an air conditioner comprising:

a housing having an opening;

a heat exchanger arranged in the housing to heat exchange air drawn into the housing;

a fan arranged in the housing and rotatable around a rotation axis, the rotation axis formed to extend along a direction toward the opening;

a controller; and a diffuser placed at the opening and through which heat exchanged air blown by the fan is discharged, wherein the diffuser includes a plurality of vanes configured to guide the heat exchanged air blown by the fan, the diffuser being configured to be selectively rotatable in a same direction as a rotation direction of the fan, the plurality of vanes are arranged to guide the heat exchanged air blown by the fan in a rotation direction of the diffuser while the diffuser is rotated, the diffuser is arranged to be selectively rotatable in an opposite direction of the rotation direction of the fan, the opening includes a first opening and a second opening separately arranged from the first opening, the diffuser includes a first diffuser arranged on the first opening and a second diffuser arranged on the second opening, the first diffuser and the second diffuser are arranged to be independently rotated, and the controller is configured to control rotation of the first diffuser and the second diffuser, wherein the controller is configured to control rotation of the first diffuser and the second diffuser by selecting one of:

a first state in which both the first diffuser and the second diffuser are rotated in the rotation direction of the fan, a second state in which one of the first diffuser and the second diffuser is stopped while another of the first diffuser and the second diffuser is rotated in the rotation direction of the fan, a third state in which both the first diffuser and the second diffuser are stopped, a fourth state in which both the first diffuser and the second diffuser are rotated in an opposite direction of the rotation direction of the fan, a fifth state in which one of the first diffuser and the second diffuser is stopped while another of the first diffuser and the second diffuser is rotated in the opposite direction of the rotation direction of the fan, and a sixth state in which one of the first diffuser and the second diffuser is rotated in the rotation direction of the fan while another of the first diffuser and the second diffuser is rotated in the opposite direction of the rotation direction of the fan.

* * * * *